US005966566A

United States Patent [19]

Odagawa et al.

[11] Patent Number: 5,966,566

[45] Date of Patent: Oct. 12, 1999

[54] RECYCLE METHOD FOR PROCESS CARTRIDGE AND IMAGE FORMING APPARATUS

[75] Inventors: Kazuyoshi Odagawa, Koshigaya; Hiroo Kobayashi, Yokohama; Isao Ikemoto, Kawasaki; Masahiko Yashiro, Yokohama; Toshiyuki Karakama, Tokyo; Atsushi Numagami, Hadano; Tsutomu Nishiuwatoko, Tokyo; Minoru Sato, Yokohama, all of Japan

[73] Assignee: Canon Kabushiki Kaisha, Tokyo, Japan

[21] Appl. No.: 08/870,269

[22] Filed: Jun. 6, 1997

Related U.S. Application Data

[63] Continuation of application No. 08/215,735, Mar. 22, 1994, abandoned.

[30] Foreign Application Priority Data

Mar. 24, 1993 [JP] Japan ..... 5-087813

[51] Int. Cl.[6] ..... G03G 21/18

[52] U.S. Cl. ..... 399/109; 399/113

[58] Field of Search ..... 399/109–111, 113

[56] References Cited

U.S. PATENT DOCUMENTS

| | | | |
|---|---|---|---|
| 3,985,436 | 10/1976 | Tanaka et al. . | |
| 4,500,195 | 2/1985 | Hosono . | |
| 4,540,268 | 9/1985 | Toyono et al. . | |
| 4,627,701 | 12/1986 | Onoda et al. . | |
| 4,816,877 | 3/1989 | Keen | 355/260 |
| 4,851,960 | 7/1989 | Nakamura et al. | 361/225 |
| 5,040,025 | 8/1991 | Fukuchi | 355/260 |
| 5,208,634 | 5/1993 | Ikemoto et al. | 355/215 |
| 5,220,379 | 6/1993 | Fukuchi et al. | 355/200 |
| 5,221,943 | 6/1993 | Hasegawa | 355/245 |
| 5,223,068 | 6/1993 | Baley | 156/250 |
| 5,249,026 | 9/1993 | Kojima | 355/327 |
| 5,260,749 | 11/1993 | Yahata | 355/260 |
| 5,294,960 | 3/1994 | Nomura et al. | 355/210 |
| 5,325,163 | 6/1994 | Nishio | 355/260 |

FOREIGN PATENT DOCUMENTS 63-149669 6/1988 Japan .

OTHER PUBLICATIONS

Murata, Yuji, "Surface Polymer and Electrostatics", Surface Film Molecule Design, Series 5, pp. 11 through 17. (Partial English Translation).

*Primary Examiner*—William Royer

*Attorney, Agent, or Firm*—Fitzpatrick, Cella, Harper & Scinto

[57] ABSTRACT

The present invention provides a method for recycling a process cartridge removably mountable to an image forming apparatus, comprising the steps of: (a) dividing a process cartridge into a first frame including an image bearing member, and a second frame including a developing means and a developer containing means for containing developer used by the developing means and having an opening through which the developer is supplied to the developing means; (b) thereafter, removing the developing means from the second frame; (c) thereafter, replenishing developer to the developer containing means through the opening; (d) thereafter, removably attaching a seal for closing the opening to the opening; and (e) thereafter, locking the first and second frames to each other, thereby assembling the process cartridge.

33 Claims, 58 Drawing Sheets

RECYCLE METHOD FOR PROCESS CARTRIDGE AND IMAGE FORMING APPARATUS

This application is a continuation of application Ser. No. 08/215,735, filed Mar. 22, 1994, now abandoned.

BACKGROUND OF THE INVENTION

1. Field of the Invention

The present invention relates to a method for recycling a process cartridge and an image forming apparatus. The image forming apparatus may be, for example, an electrophotographic copying machine, a laser beam printer, an LED printer, a word processor, a facsimile machine and the like.

2. Related Background Art

In image forming apparatuses such as printers, a latent image is formed on a uniformly charged image bearing member by selective exposure, the latent image is then visualized as a toner image, and the toner image is transferred to a recording medium, thereby forming an image on the recording medium. In such image forming apparatuses, the maintenance for various parts must be repeated periodically.

In consideration of the above, various process cartridges wherein an image bearing member, a charger, a developing device, a cleaning device and the like are integrally housed in a frame as a cartridge unit which can removably be mounted to an image forming apparatus so that the process cartridge can be exchanged when toner is used up or when a service life of any part (for example, image bearing member) is expired, thereby facilitating the maintenance have been proposed and put to practical use (for example, refer to U.S. Pat. Nos. 3,985,436; 4,500,195; 4,540,268 and 4,627,701).

In this way, only by changing the cartridge without periodical maintenance, maintenance can be omitted and toner can be replenished, thereby facilitating the handling of the copying machines, printers and the like.

On the other hand, recently, the destruction of the natural environment and the increase of dust and garbage have arisen as social problems. Thus, it is desirable to utilize resources effectively.

SUMMARY OF THE INVENTION

An object of the present invention is to provide a method for recycling a process cartridge, and an image forming apparatus, which can effectively utilize resources.

Another object of the present invention is to provide a method for recycling a process cartridge, and an image forming apparatus, which is simple.

A further object of the present invention is to provide a method for recycling a process cartridge, and an image forming apparatus. Wherein, in recycling the process cartridge, the cartridge is disassembled and divided into a first frame including an image bearing member and a second frame including a developer containing means for containing developer used by a developing means, and, thereafter, the developer can be replenished and a seal can be attached, thereby preventing the image bearing member from damaging.

The other object of the present invention is to provide a simple method for recycling a process cartridge which contributes to the protection of the natural environment by utilizing resources effectively.

DETAILED DESCRIPTION OF THE PREFERRED EMBODIMENTS

First of all, a process cartridge and an image forming apparatus using such process cartridge, according to a first embodiment, will be explained with reference to the accompanying drawings.

{General Explanation of Process Cartridge and Image Forming Apparatus Having Such Process Cartridge Mounted thereto}:

The whole construction of an image forming apparatus is firstly explained. Incidentally, FIG. 1 is an elevational sectional view of a laser beam printer having a process cartridge mounted thereto, according to one aspect of the present invention, FIG. 2 is a perspective view of the laser beam printer, FIG. 3 is a cross-sectional view of the process cartridge, and FIG. 4 is a perspective view of the process cartridge.

Figure 1:
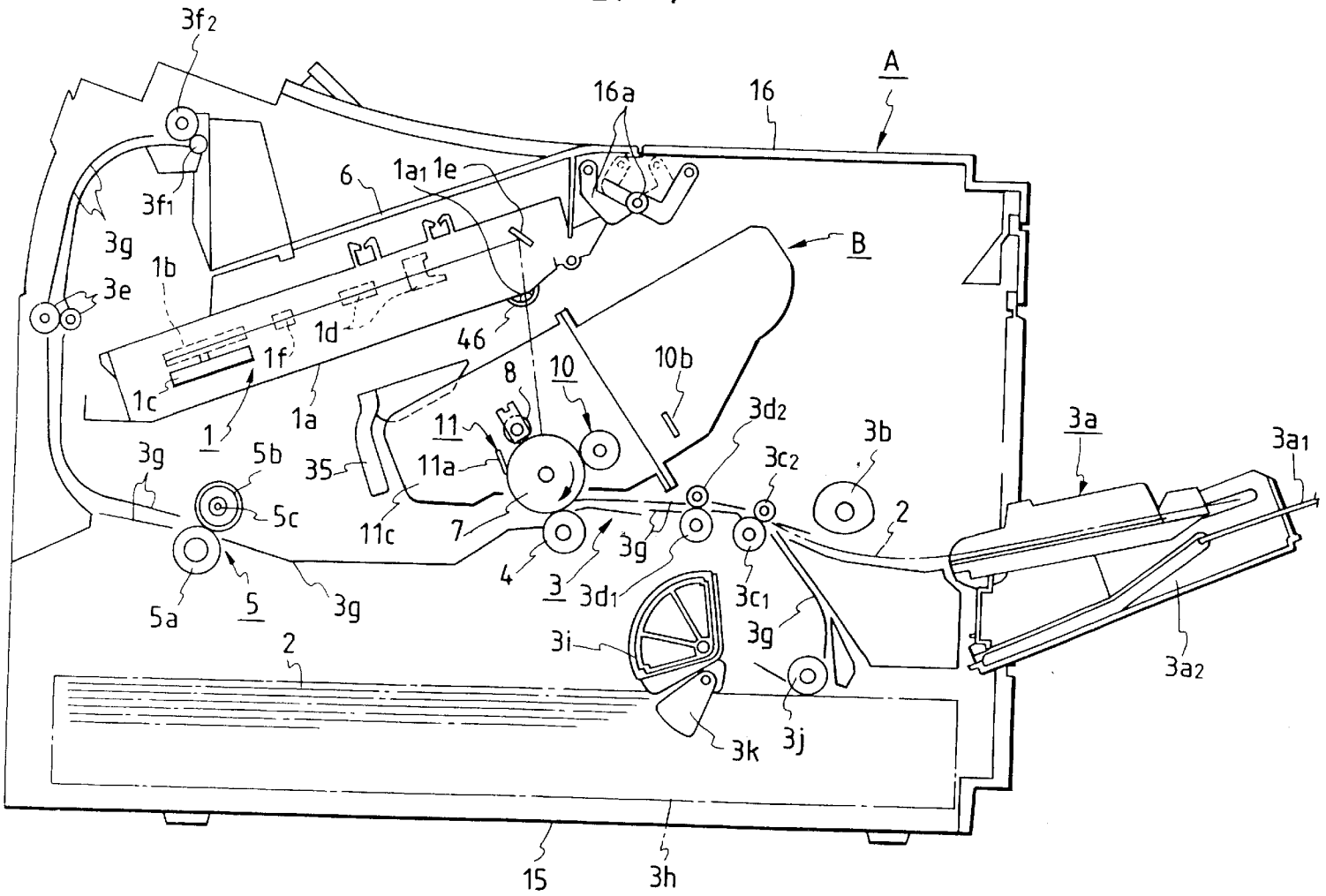
FIG. 1 is an elevational sectional view of an image forming apparatus to which a process cartridge is mounted.
Figure 2:
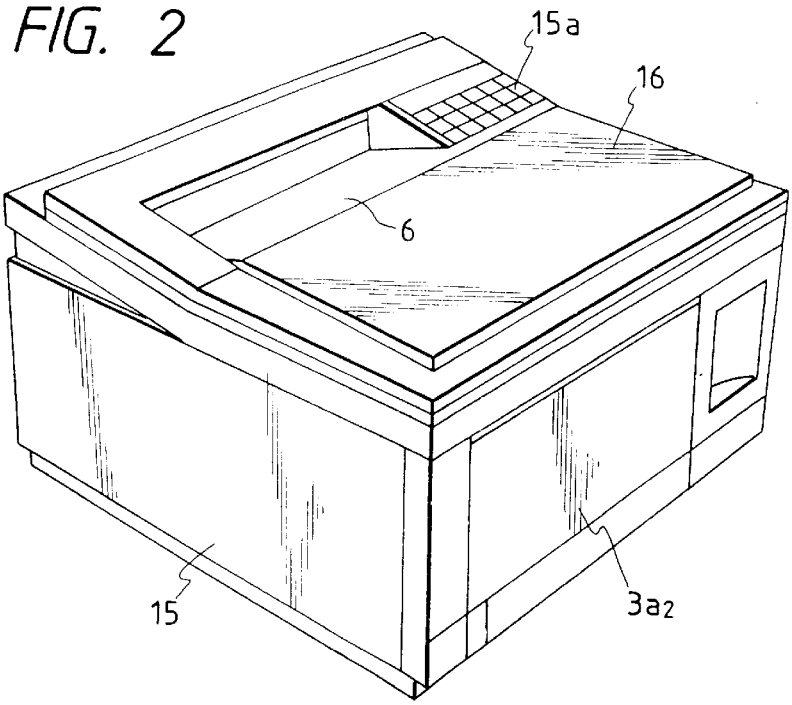
FIG. 2 is a perspective view of the image forming apparatus.

As shown in FIG. 1, the image forming apparatus A is so designed that a latent image is formed on a photosensitive drum (as an example of an image bearing member) by illuminating light image from an optical system 1 onto the drum in response to image information, and the latent image is developed with developer (referred to as "toner" hereinafter) to form a toner image. In synchronous with the formation of the toner image, a recording medium 2 is fed by a convey means 3 to an image forming station of a process cartridge B, and, in the image forming station, the toner image formed on the photosensitive drum is transferred onto the recording medium 2 by a transfer means 4. Then, the recording medium 2 is sent to a fixing means 5, where the transferred toner image is fixed to the recording medium. Thereafter, the recording medium is discharged to a discharge portion 6.

Figure 3:
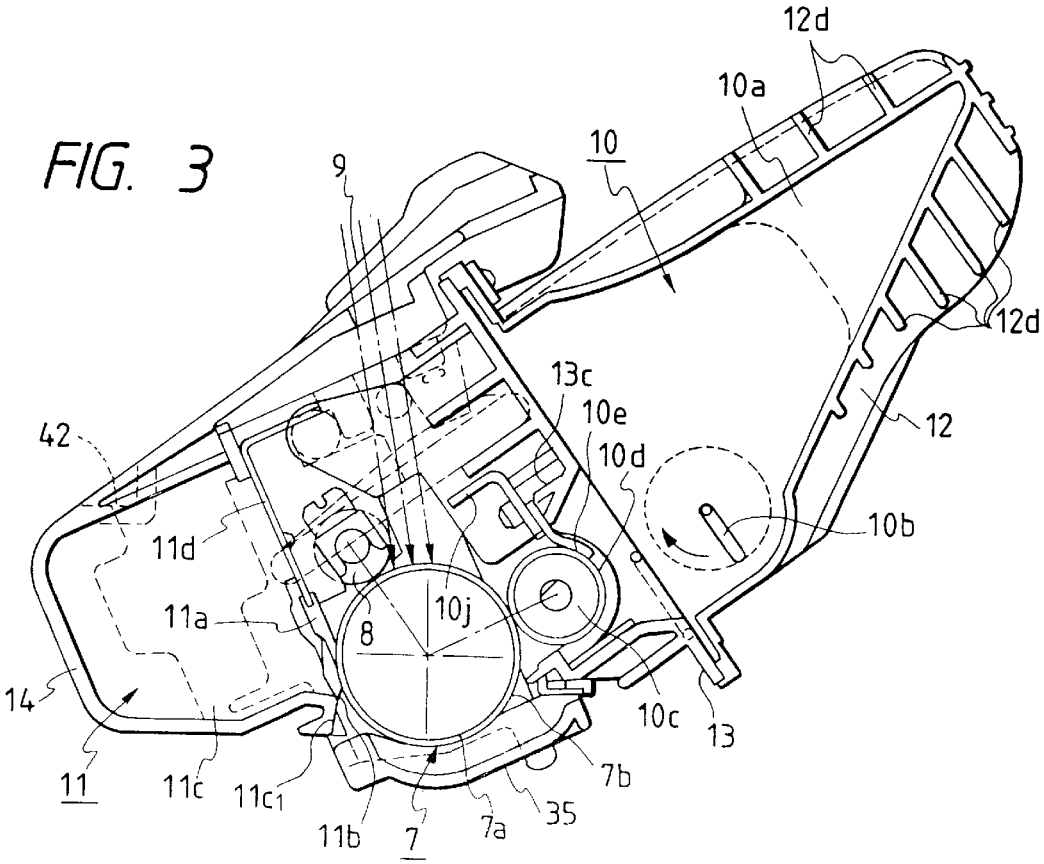
FIG. 3 is a cross-sectional view of the process cartridge.
Figure 4:
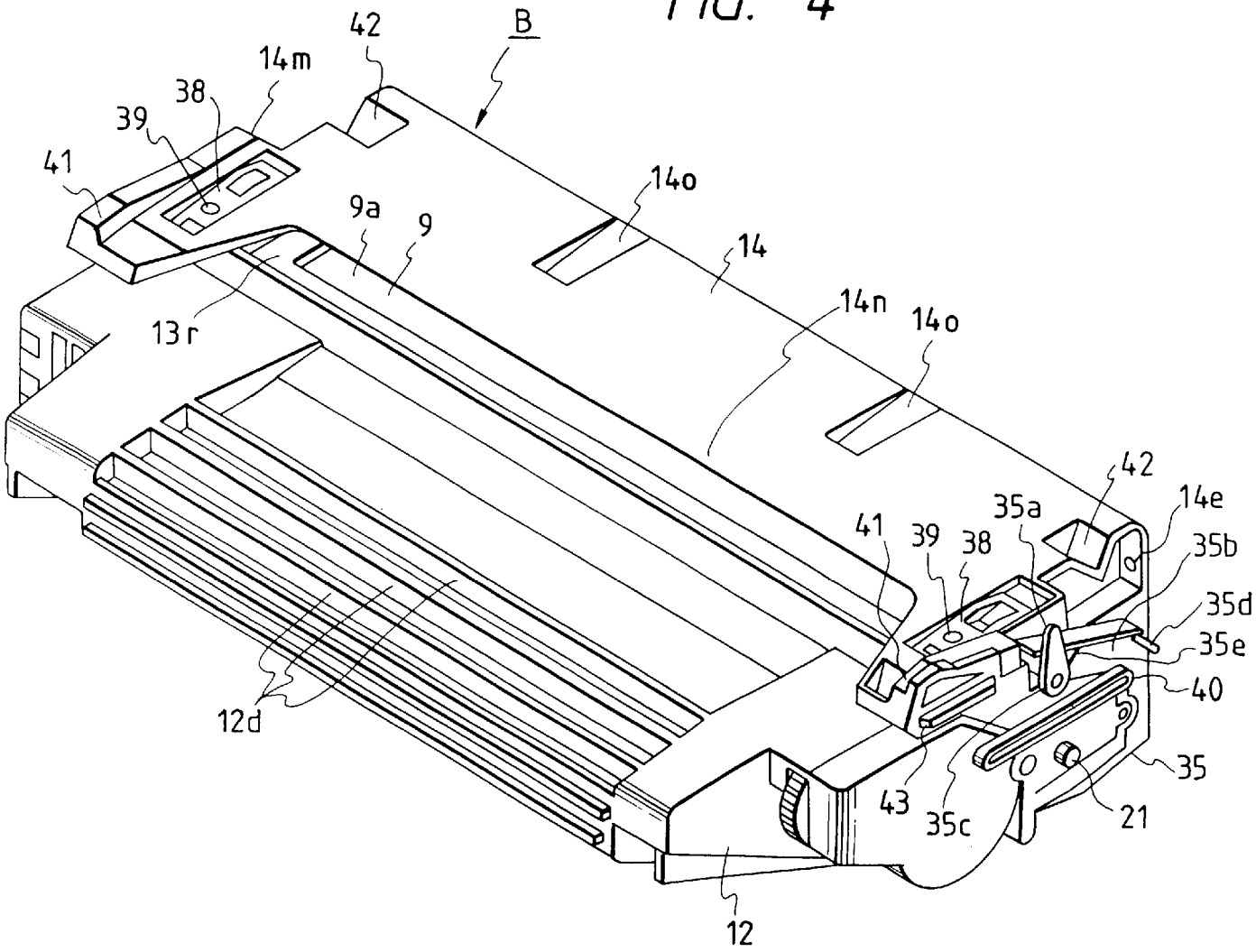
FIG. 4 is a perspective view of the process cartridge.

As shown in FIG. 3, in the process cartridge B providing the image forming station, the rotating photosensitive drum (an example of an image bearing member) 7 is uniformly charged by a charger means 8. The latent image is formed on the photosensitive drum 7 by illuminating the light image from the optical system 1 through an exposure portion 9, and then the latent image is developed by a developing means 10 to visualize the image as a toner image. The toner image is then transferred onto the recording medium 2. On the other hand, after the transferring operation, the residual toner remaining on the photosensitive drum 7 is removed by a cleaning means 11.

Incidentally, the process cartridge B comprises a toner frame 12 as a first frame having a toner reservoir, a developing frame 13 as a second frame having a developing sleeve, and a cleaning frame 14 as a third frame having the photosensitive drum 7 and the cleaning means 11 and the like. In FIG. 2, the reference numeral 15*a* denotes an operation portion on which a recording copy number setting button, a density setting button, a test print button, a lamp for informing of the exchange of the cartridge which will be described later, and the like are provided.

Next, vaious parts of the image forming apparatus A and the process cartridge B mounted thereto will be fully explained.

{Image Forming Apparatus}:

First of all, regarding the various parts of the image forming apparatus A, the optical system, convey means, transfer means, fixing means and cartridge mounting means will be described in order.

(Optical System):

The optical system 1 serves to illuminate the light image onto the photosensitive drum 7 in response to the image information sent from an external device and the like. As shown in FIG. 1, the optical system comprises an optical unit 1*a* in which a polygon mirror 1*b*, a scanner motor 1*c*, a focusing lens 1*d*, a reflection mirror 1*e* and a laser diode 1*f* are accommodated and which is disposed within a frame of the apparatus A.

When an image signal is given from an external device such as a computer, a word processor and the like (refer to host 62 (FIG. 59)), the laser diode 1*f* emits the light in response to the image signal, which light is sent to the polygon mirror 1*b* as image light. The polygon mirror 1*b* is rotated at a high speed by the scanner motor 1*c*, and the image light reflected by the polygon mirror 1*b* is illuminated onto the photosensitive drum 7 via the focusing lens id and the reflection mirror 1*e*, thereby selectively exposing the surface of the photosensitive drum 7 to form a latent image corresponding to the image information on the photosensitive drum 7.

(Recording Medium Convey Means):

Next, the convey means 3 for conveying or feeding the recording medium (for example, an OHP sheet, thin film or the like) 2 will be explained. The convey means 3 according to the illustrated embodiment permits both the manual sheet supply and the cassette sheet supply. As shown in FIG. 1, in the manual sheet supply, one or more recording medium 2 is set on a sheet supply tray 3*a* and then the image forming operation is started. As a result, the recording medium 2 on the sheet supply tray 3*a* is sent into the image forming apparatus by the rotation of a pick-up roller 3*b*. Incidentally, a plurality of recording media 2 are set on the sheet supply tray, the recording media are separated one by one by a pair of separation rollers 3*c*1, 3*c*2, and the separated recording medium is conveyed until a leading end of the recording medium is abutted against a nip between a pair of regist rollers 3*d*1, 3*d*2. The paired regist rollers 3*d*1, 3*d*2 are rotated in response to the image forming operation to feed the recording medium 2 to an image forming station. Further, after the image formation, the recording medium 2 is conveyed to the fixing means 5, and then is discharged onto the discharge portion 6 by a pair of intermediate discharge rollers 3*e* and a pair of discharge rollers 3*f*1, 3*f*2. Incidentally, guide members 3*g* for guiding the recording medium 2 are arranged between the fixing means and the intermediate discharge rollers and between the intermediate discharge rollers and the paired discharge rollers.

Further, the sheet supply tray 3*a* comprises an inner member 3*a*1 and an outer member 3*a*2. In an inoperative condition, the inner member 3*a*1 is contained in the outer member 3*a*2, and, as shown in FIG. 2, the outer member 3*a*2 constitutes a portion of the frame 15 of the apparatus.

On the other hand, for the cassette sheet supply, as shown in FIG. 1, a mounting portion for a cassette 3*h* is provided at a lower portion within the frame 15. When the manual sheet supply is not effected, the recording media 2 in the cassette 3h mounted in the mounting portion are sent to the paired regist rollers 3*d*1, 3*d*2 one by one from the uppermost one by the rotation of a pick-up roller 3*i* and a feed roller 3*j*. At a downstream side of the paired regist rollers 3*d*1, 3*d*2, the recording medium is conveyed in the same manner as the manual sheet supply. Incidentally, a sensor 3*k* serves to detect the presence/absence of the recording medium 2 in the cassette 3*h*.

(Transfer Means):

The transfer means 4 serves to transfer the toner image formed on the photosensitive drum 7 onto the recording medium 2, and, as shown in FIG. 1, comprises a transfer roller 4. More particularly, the recording medium 2 is urged against the photosensitive drum 7 of the process cartridge B mounted on a mounting means (described later) by the transfer roller 4, and, by applying a voltage having the polarity opposite to that of the toner image formed on the photosensitive drum 7 to the transfer roller 4 (in the illustrated embodiment, by effecting the constant current control with DC voltage of about 1000 V), the toner image on the photosensitive drum 7 is transferred onto the recording medium 2.

(Fixing Means):

The fixing means 5 serves to fix the toner image transferred to the recording medium 2 by the application of the voltage to the transfer roller 4 onto the recording medium 2. As shown in FIG. 1, the fixing means comprises a rotating drive roller 5*a*, and a driven fixing roller 5*b* having a heater 5*c* therein and urged against the drive roller 5*a*. More particularly, while the recording medium 2 to which the toner image was transferred at the image forming station is being passed between the drive roller 5*a* and the fixing roller 5*b*, the recording medium is subjected to pressure due to the abutment between the rollers 5*a*, 5*b* and heat due to the heating of the fixing roller 5*b*, thereby fixing the transferred toner image to the recording medium 2.

Figure 5:
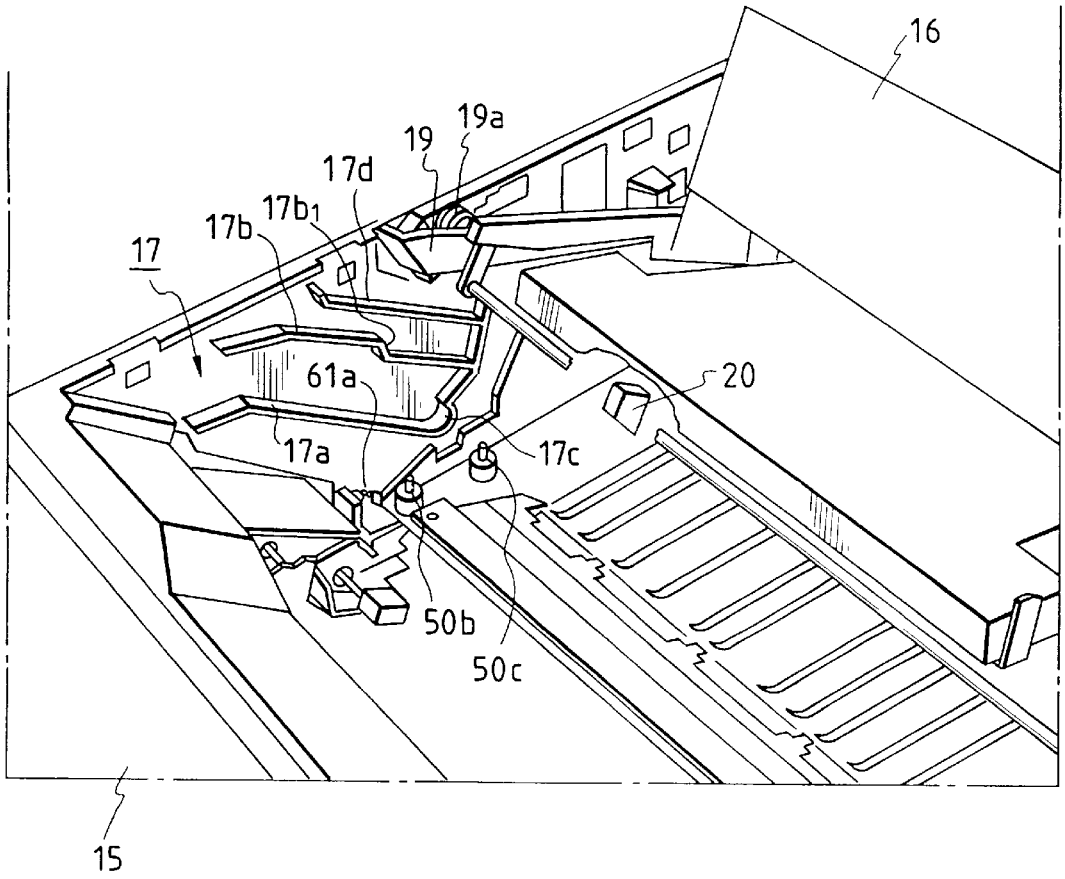
FIG. 5 is a partial view showing a left guide member.
Figure 6:
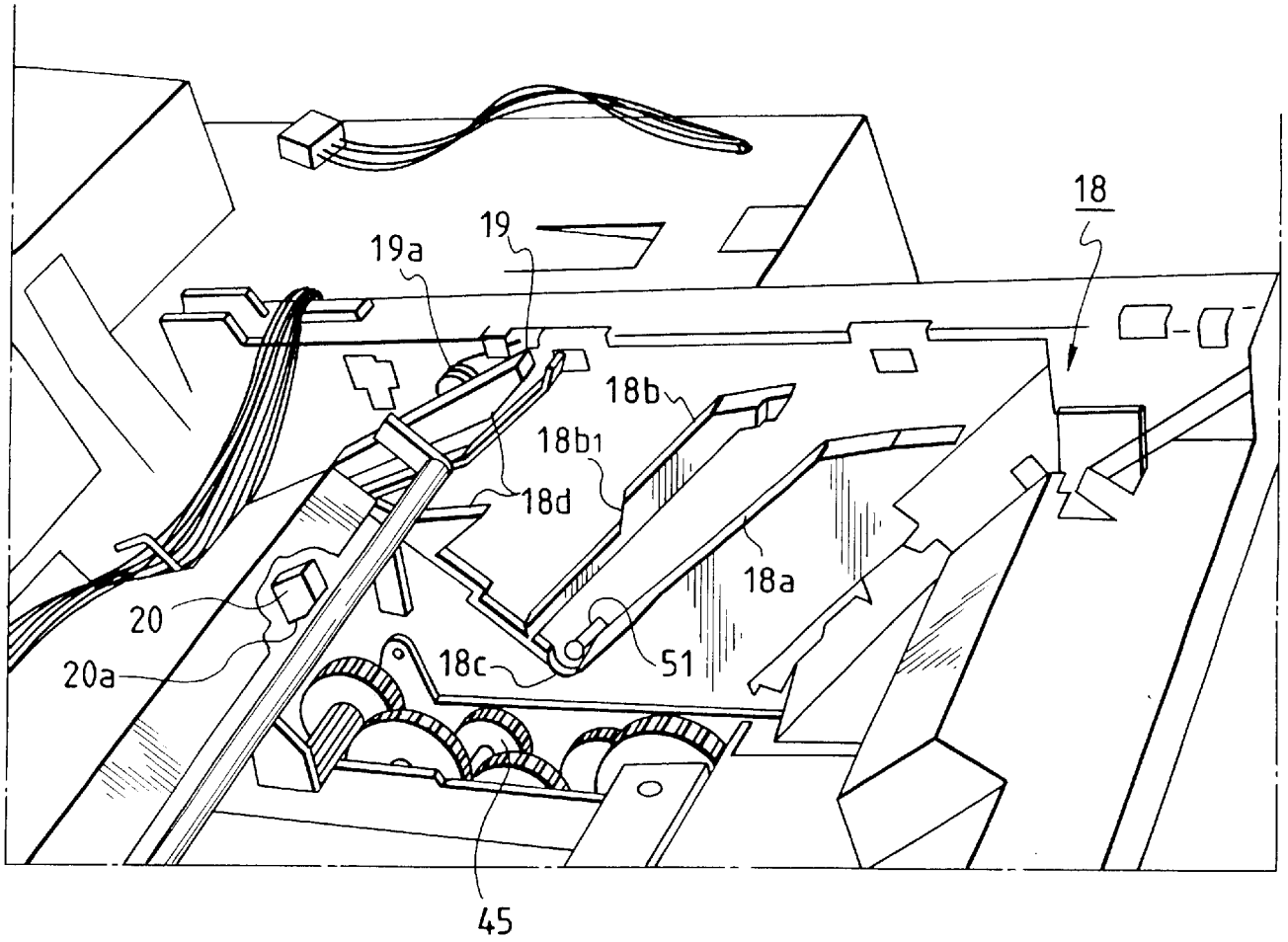
FIG. 6 is a partial view showing a right guide member.

(Cartridge Mounting Means):

The cartridge mounting means for mounting the process cartridge B is provided in the image forming apparatus A. After an opening/closing cover 16 is opened, the mounting or dismounting of the process cartridge B is effected. More particularly, the opening/closing cover 16 is pivotally mounted on an upper part of the frame 15 via hinges 16*a*. On the other hand, as shown in FIGS. 5 and 6, a left guide member 17 and a right guide member 18 are attached to inner side walls. The guide members 17, 18 have first guide portions 17*a*, 18*a* which are inclined forwardly and downwardly, and second guide portions 17*b*, 18*b* which are disposed above the first guide portions. The guide portions 17*a*, 17*b* and 18*a*, 18*b* are arranged with left/right symmetry. Bearing portions 17*c*, 18*c* (described later) for supporting drum bearings of the process cartridge B are formed on ends of the first guide portions 17*a*, 18*a*, respectively, and intermediate stepped portions 17*b*1, 18*b*1 are formed on the second guide portions 17*b*, 18*b*, respectively.

Further, the left guide member 17 has a cartridge rocking movement regulating guide portion 17*d* which is disposed above the second guide portion 17*b*. The right guide member 18 has a shutter cam portion 18*d* for opening and closing a drum shutter 35 of the process cartridge B, which cam portion is disposed above the second guide portion 18*b*.

Further, pressure members 19 are disposed above the rocking movement regulating guide portion 17*d* and the shutter cam portion 18*d*, which pressure members serve to bias the mounted process cartridge B downwardly via torsion coil springs 19*a*. Further, abutment members 20 for positioning the process cartridge B are arranged at front sides of the left and right guide members 17, 18 (front sides in a cartridge inserting direction).

After the opening/closing cover 16 is opened, the process cartridge B can be mounted within the image forming apparatus while being guided by the first and second guide portions 17*a*, 18*a* and 17*b*, 18*b* of the left and right guide members 17, 18. The mounting operation for the process cartridge will be explained after the construction of the process cartridge is described.

{Process Cartridge}:

Next, various parts of the process cartridge B which is to be mounted to the image forming apparatus A will now be described.

The process cartridge B includes an image bearing member, and at least one process means. The process means may be, for example, a charger means for charging a surface of the image bearing member, a developing means for developing a latent image formed on the image bearing member to form a toner image, a cleaning means for removing residual toner remaining on the image bearing member, and the like. As shown in FIG. 3, the process cartridge B according to the illustrated embodiment comprises a charger means 8, exposure portion 9, developing means 10 for performing a developing operation with toner and cleaning means 11 which are arranged around an electrophotographic photosensitive drum 7 as an image bearing member and which are enclosed by a housing comprising a toner frame 12, developing frame 13 and cleaning frame 14 to form a unit which can removably be mounted to the frame 15 of the image forming apparatus as a process cartridge B.

Next, regarding the various parts of the process cartridge B, the photosensitive drum 7, charger means 8, exposure portion 9, developing means 10 and cleaning means 11 will be fully explained in order.

Figure 7:
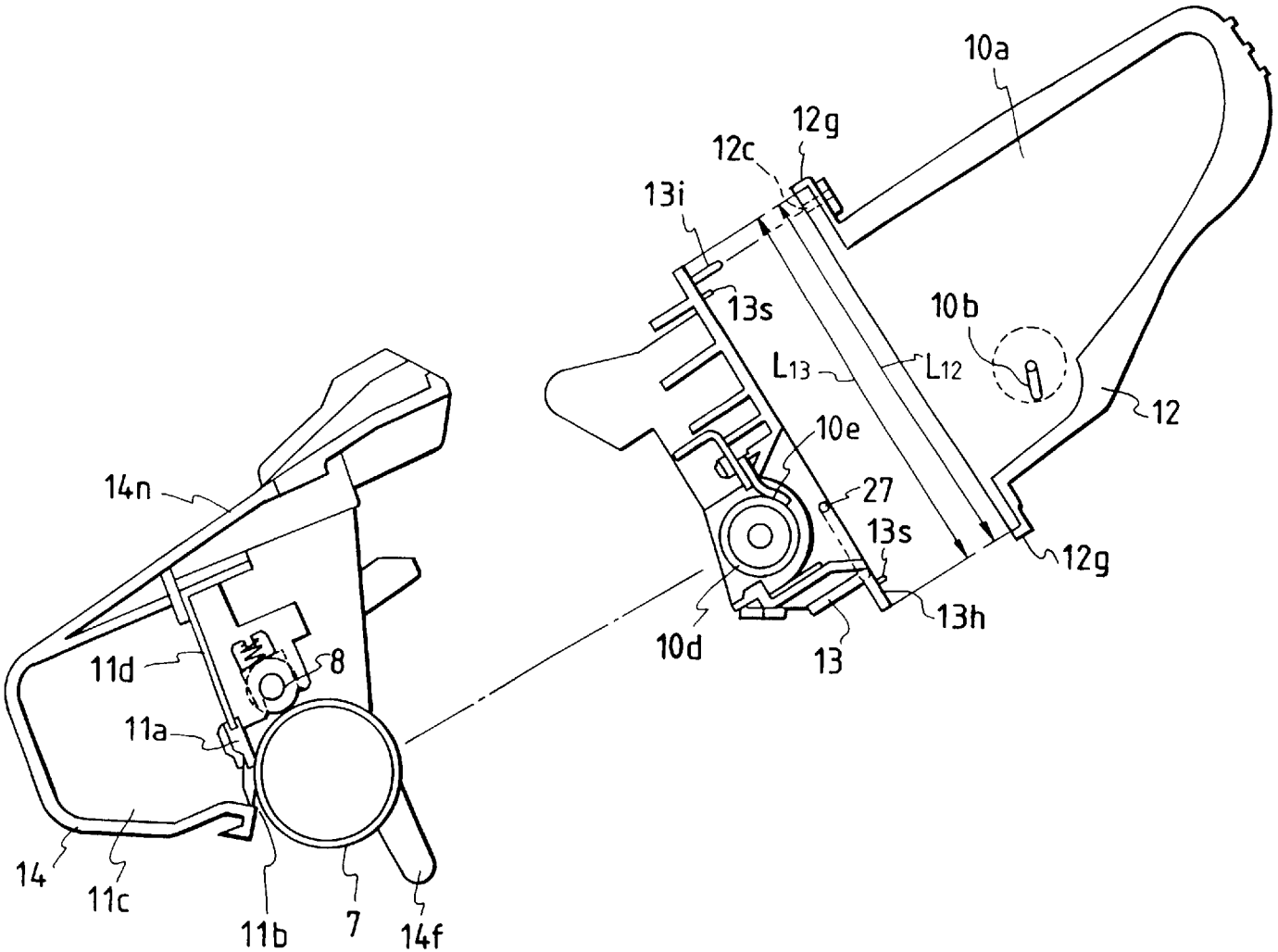
FIG. 7 is an exploded view of the process cartridge showing frames thereof.

(Photosensitive Drum):

The photosensitive drum 7 according to the illustrated embodiment comprises a cylindrical drum base 17*a* made of aluminium, and an organic photosensitive layer 7*b* coated on an outer peripheral surface of the drum base. As shown in FIG. 7, when the photosensitive drum 7 is attached to the cleaning frame 14 and a driving force of a drive motor 71 (refer to FIG. 59) of the image forming apparatus is transmitted to a helical gear 7*c* (refer to FIG. 8A) secured to one longitudinal end of the photosensitive drum 7, the drum 7 is rotated in a direction shown by the arrow in FIG. 1 in response to the image forming operation.

Figure 8A:
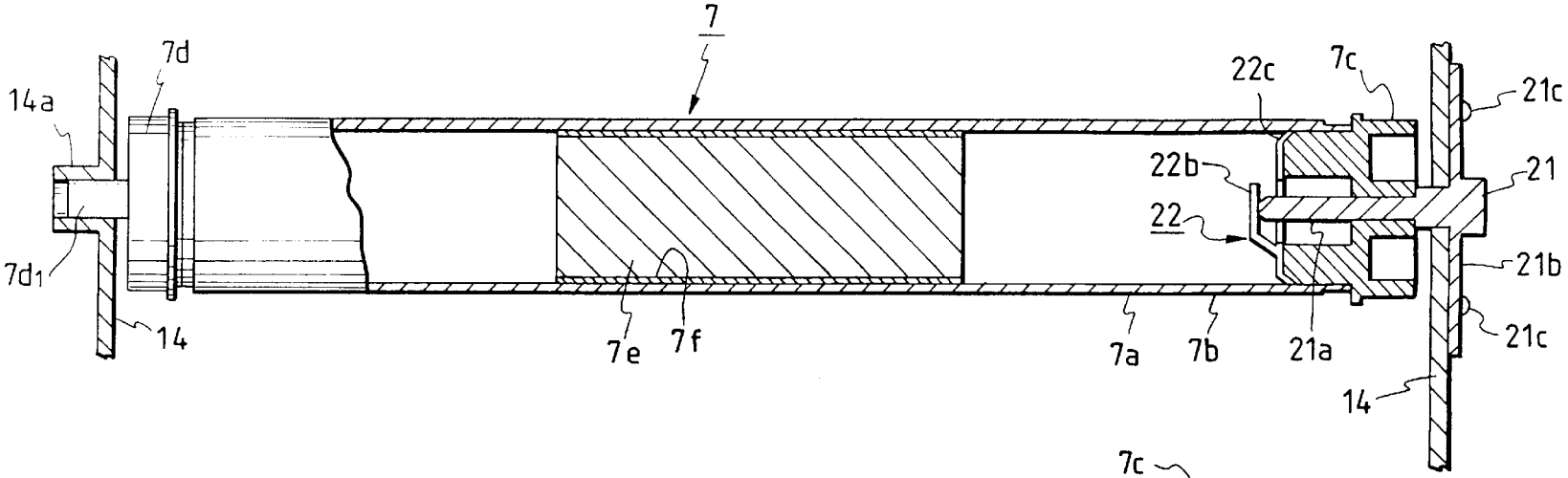
FIG. 8A is a longitudinal sectional view of a photosensitive drum.

Incidentally, as shown by the longitudinal sectional view in FIG. 8A, the photosensitive drum 7 is rotatably attached to the cleaning frame 14 by fitting a boss 7*d*1 of a gear flange 7*d* attached to one longitudinal end of the photosensitive drum into a bearing portion 14*a* of the frame 14 and by inserting a metal (iron in the illustrated embodiment) shaft 21 into a hole formed in a resin helical gear 7*c* attached to the other end of the drum and by securing the shaft 21 to the frame 14. Further, the shaft 21 has an integral shaft portion 21*a* and flange 21*b* and is secured to the frame 14 by securing the flange 21*b* to the frame 14 by screws. Further, the gear flange 7*d* comprises a spur wheel and serves to transmit the rotational force of the photosensitive drum 7 rotated via the helical gear 7*c* receiving the driving force from the image forming apparatus to the transfer roller 4, thereby rotating the latter.

Figure 9:
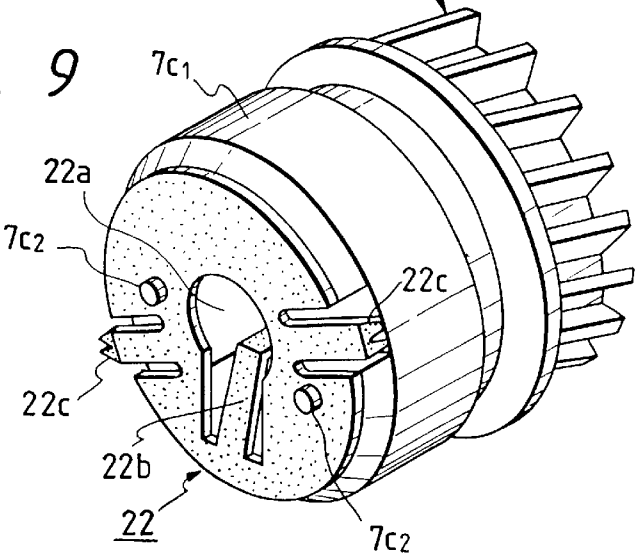
FIG. 9 is a perspective view of a conductive member contacting with a metal shaft.

Further, the metal shaft 21 is a conductive member, and another conductive member 22 (made of bronze phosphide in the illustrated embodiment) is arranged to contact with an inner surface of the aluminium drum base 7*a* of the photosensitive drum at the end thereof into which the metal shaft 21 is inserted, so that, when the metal shaft 21 is inserted, it is contacted with the conductive member 22. Consequently, the photosensitive drum 7 is earthed to the image forming apparatus through the conductive member 22 and the metal shaft 21 as will be described later. That is to say, as shown in FIG. 9, the conductive member 22 is fitted on and secured by bosses 7*c*2 formed on a side surface of the flange portion 7*c*1 of the helical gear 7*c*, and has a hole or opening 22*a* into which the metal shaft 21 is to be inserted. Further, a contact portion 22*b* having a spring feature is also provided to extend into the opening 22*a*. When the metal shaft 21 is inserted into the opening, it is contacted with the contact member 22*b* while urging the latter. Further, the conductive member 22 is provided with bifurcated pawl portions 22*c* protruding in the left and right direction, so that, when the flange portion 7*c*1 is inserted into the photosensitive drum 7, the pawl portions 22*c* are contacted with the inner surface of the photosensitive drum 7.

In the image forming operation, the photosensitive drum 7 is rotated, and the surface of the photosensitive drum 7 is uniformly charged by applying the DC voltage and AC voltage in an overlapped fashion to the charger roller 8. Incidentally, in this case, in order to charge the surface of the photosensitive drum 7 uniformly, it is preferable that the DC voltage and AC voltage are applied to the charger roller 8 in the overlapped fashion and the frequency of the AC voltage is increased. However, if the frequency of the AC voltage exceeds about 200 Hz, it is feared that a so-called "charging noise" due to the vibration of the photosensitive drum 7 and the charger roller 8 is increased.

More particularly, when the AC voltage is applied to the charger roller 8, an electrostatic attraction force is generated between the photosensitive drum 7 and the charger roller 8, and the attraction force is strong at the maximum and minimum values of the AC voltage, whereby the charger roller 8 is attracted toward the photosensitive drum 7 while deforming elastically. On the other hand, the attraction force is relatively weak at the intermediate value of the AC voltage, with the result that the charger roller 8 tends to separate from the photosensitive drum 7 by the restoring force due to the elastic deformation. Consequently, the photosensitive drum 7 and the charger roller 8 are vibrated at the frequency greater than the frequency of the applied AC voltage by twice. Further, when the charger roller 8 is attracted to the photosensitive drum 7, the rotations of the roller and the drum are braked, thereby generating the vibration due to the stick slip (generated as if a wet glass is rubbed by a finger); this vibration causes the charging noise.

Figure 8B:
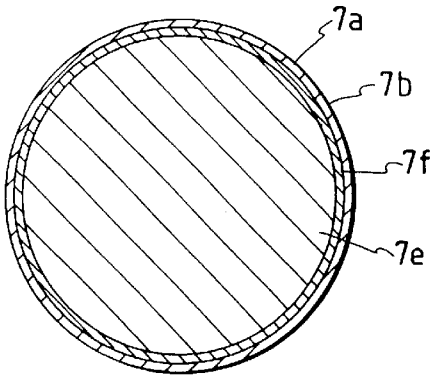
FIG. 8B is a cross-sectional view of the photosensitive drum.

Thus, according to the illustrated embodiment, in order to reduce the vibration of the photosensitive drum 7, as shown by the sectional views in FIGS. 8A and 8B, a filler 7*e* formed from a rigid body or elastic body is arranged in the photosensitive drum 7 at a central portion in the longitudinal direction thereof. The material of the filler 7*e* may be metal such as aluminium or brass, or ceramics such as cement or gypsum, or rubber such as natural rubber or the like. In consideration of the productivity, workability, and effect of weight and cost, the material of the filler may be appropriately selected among them. Incidentally, in the illustrated embodiment, the filler 7*e* is made of aluminium having a weight of about 120 grams.

The shape or configuration of the filler 7*e* may be solid cylindrical or hollow cylindrical (in the illustrated embodiment, as shown in FIG. 8B, the filler is formed as the solid cylinder). For example, the filler 7*e* having an outer diameter smaller than an inner diameter of the photosensitive drum 7 by about 100 $\mu$m is inserted into the hollow drum base 7*a*, thus attaching the filler to the photosensitive drum. That is to say, the gap between the drum base 7*a* and the filler 7*e* is kept to 100 $\mu$m at the maximum, and an adhesive (for example, cyanoacrylate group, epoxy resin group or the like) is applied to an outer surface of the filler or the inner surface of the drum base 7*a*, thereby adhering the filler 7*e* to the inner surface of the drum base 7*a*.

As mentioned above, by providing the filler 7*e* in the photosensitive drum 7, the photosensitive drum 7 is rotated stably, thereby suppressing the vibration due to the rotation of the photosensitive drum 7 during the image forming operation. As a result, even when the frequency of the AC voltage applied to the charger roller 8 is increased, it is possible to suppress the charging noise.

Figure 10:
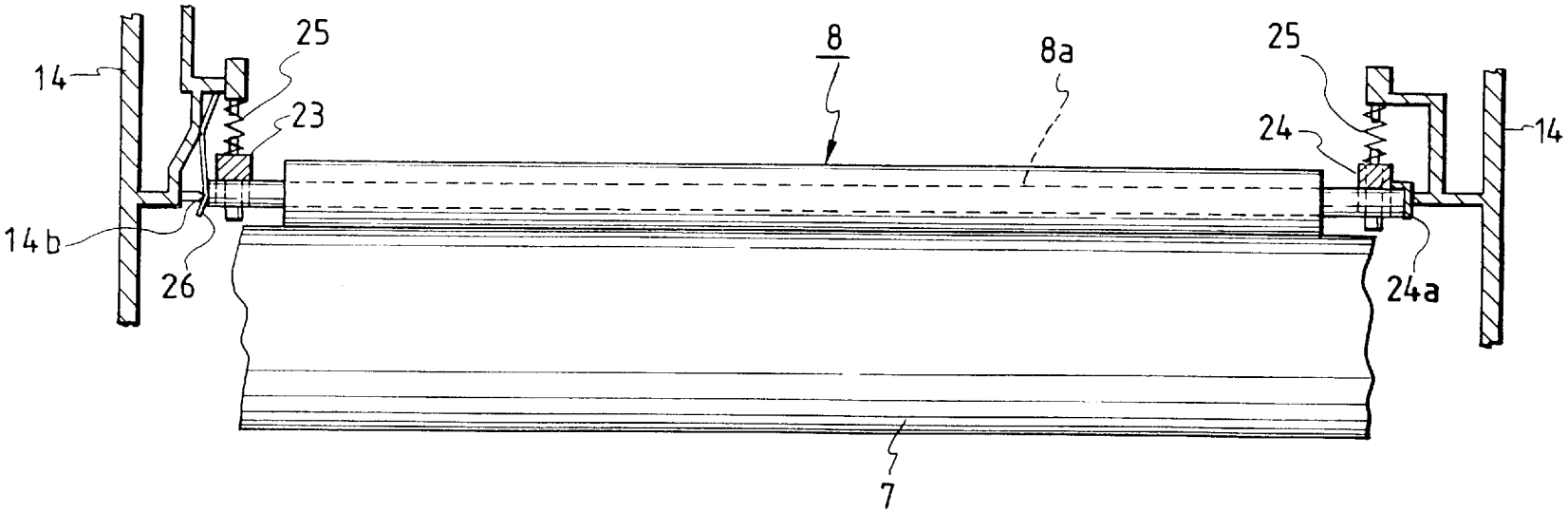
FIG. 10 is a view showing a charger roller and bearings therefor.

(Charger Means):

The charger means serves to charge the surface of the photosensitive drum 7. In the illustrated embodiment, a charging method of a so-called contact type as disclosed in the Japanese Patent Laid-open No. 63-149669 is used. More particularly, as shown in FIG. 10, the charger roller 8 is rotatably mounted on the cleaning frame 14. The charger roller 8 comprises a metal roller shaft 8*a*, an elastic conductive layer around the roller shaft, a high resistive elastic layer around the conductive layer, and a protection film around the high resistive layer. The elastic conductive layer is formed from an elastic rubber layer made of EPDM or NBR dispersing carbon powder therein, and acts to direct the bias voltage to the roller shaft 8*a*. Further, the high resistive elastic layer is made of urethane rubber dispersing a small amount of conductive fine powder (for example, carbon powder), and acts to prevent the abrupt reduction of the bias voltage by limiting the leak current to the photosensitive drum 7 even when the charger roller having high conductivity such as a pin hole is opposed to the photosensitive drum 7. Further, the protection film is made of N-methyl methoxyl nylon and acts to prevent the deterioration of the surface of the photosensitive drum 7 if the plastic material of the conductive elastic layer and/or the high resistive elastic layer is contacted with the photosensitive layer.

The roller shaft 8*a* is attached to the frame 14 via bearings 23, 24 slidable slightly toward the photosensitive drum 7, which bearings are biased toward the photosensitive drum 7 by springs 25, thereby contacting the charger roller 8 with the photosensitive drum 7, In the image forming operation, the charger roller 8 is rotatingly driven by the rotation of the photosensitive drum 7 while applying the DC voltage and AC voltage in the overlapped fashion to the charger roller 8 as mentioned above, thereby uniformly charging the surface of the photosensitive drum 7. To this end, a metal contact member 26 having a spring feature is contacted with one end of the metal roller shaft 8*a*, thereby permitting the application of the voltage from the image forming apparatus to the charger roller 8.

Further, a regulating member 14*b* for suppressing the deformation of the contact member 26 is formed on the cleaning frame 14 so that, even if any force directing toward the left in FIG. 10 is applied to the roller shaft 8*a* resulting from the dropping of the process cartridge B or the like, the contact member 26 is prevented from being deformed plastically by contacting the contact member 26 against the regulating member 14*b*. Further, since the regulating member 14*b* limits the axial movement (toward the left in FIG. 10) of the charger roller 8, the charger roller 8 is always maintained on the photosensitive drum 7.

On the other hand, the positioning of the other end of the charger roller 8 is effected by the bearing 24. That is to say, as shown in FIG. 10, the bearing 24 has a hooked abutment portion 24*a* integrally formed therewith. By abutting the other end of the roller shaft 8*a* of the charger roller 8 against the abutment portion 24*a*, the right (FIG. 10) axial movement of the charger roller 8 is limited. The bearing 24 is made of polyacetal (POM) which has the good anti-wear feature and provides the good slidability with respect to the metal roller shaft 8a.

As mentioned above, the both ends of the roller shaft 8*a* are abutted against the anti-wear bearing 24 and the contact member 26 to limit the axial movement of the charger roller 8, thereby preventing the roller shaft 8*a* from contacting with the frame 14. If the axial movement of the charger roller 8 is limited by abutting the ends of the roller shaft 8*a* against the frame 14 directly, the frame 14 must be made from material such as polyphenylene oxide resin (PPO) having the good anti-wear feature with respect to the metal roller shaft 8*a*. To the contrary, as in the illustrated embodiment, when the roller shaft 8*a* is not directly contacted with the frame 14, it is not required to increase the anti-wear ability of the frame 14. Thus, in the illustrated embodiment, the frame 14 can be made of polystyrene resin (PS) which is more cheap, rather than PPO, thereby reducing the manufacturing cost of the process cartridge B.

Incidentally, the material of the bearing 24 is not limited to polyacetal, but may be other material such as nylon, so long as the material has the high anti-wear ability with respect to the metal roller shaft 8*a*.

According to the illustrated embodiment, the voltage applied to the charger roller 8 to charge the photosensitive drum 7 has an AC component Vpp of about 1800 V and DC component VDC1 of about −670 V, and the constant current control is effected.

(Exposure Portion):

The exposure portion 9 serves to form an electrostatic latent image on the photosensitive drum 7 uniformly charged by the charger roller 8, by exposing the light image from the optical system 1 onto the photosensitive drum. As shown by the perspective view in FIG. 4, the exposure portion is constituted by an opening portion 9 which is formed in an upper surface between the developing frame 13 and the cleaning frame 14 and through which the image light passes. That is to say, by providing a rectangular notch 9*a* in an upper surface 13*r* of the developing frame 13 and by arranging an upper wall portion 14*n* of the cleaning frame 14 to cover a portion of the notch 9*a*, the exposure portion 9 is formed.

(Developing Means):

Next, the developing means will be explained. The developing means serves to visualize the electrostatic latent image formed on the photosensitive drum 7 by the aforementioned exposure with toner to form a toner image. Incidentally, although the image forming apparatus A can utilize both magnetic toner and non-magnetic toner, in the illustrated embodiment, an example that a process cartridge B containing magnetic toner as one-component magnetic developer is mounted to the image forming apparatus is shown.

The magnetic toner used in the developing operation utilizes polystyrene resin as the binding resin, and preferably utilizes styrene acrylic resin. Coloring material which can be added to the magnetic toner may be conventional carbon black, copper phthalocyanine, iron black or the like.

Further, magnetic fine particles included in the magnetic toner are made from material which can be magnetized in the magnetic field and which may be ferromagnetic metal powder such as iron, cobalt, nickel, or alloy or compound such as magnetite or ferrite.

As shown by the sectional view in FIG. 3, the developing means 10 for forming the toner image with the magnetic toner has a toner reservoir 10*a* for containing toner, and a toner feed member 10*b* for feeding out the toner is disposed in the toner reservoir 10*a*, which feed member is rotated in a direction shown by the arrow. Further, by using the fed out toner and by rotating a developing sleeve 10*d* having a magnet 10*c* therein, a thin toner layer is formed on the developing sleeve. When the toner layer is formed on the developing sleeve 10*d*, the friction charging charge sufficient to develop the electrostatic latent image on the photosensitive drum 7 can be obtained due to the friction between the toner and the developing sleeve 10*d*. Further, a developing blade 10*e* for regulating a thickness of the toner layer is provided to abut against the surface of the developing sleeve 10*d*.

In the illustrated embodiment, as the developing bias, the AC component Vpp of about 1600 V and the DC component VDC2 of about −500 V are applied. Incidentally, in a relation between the DC component VDC2 of this developing bias and the DC component VDC1 of the aforementioned charging bias, if a value (VDC1−VDC2) becomes greater than 31 50 V (becomes greater toward the plus side), it is feared that the fog occurs.

Incidentally, the toner reservoir 10*a* and the toner feed member 10*b* are formed in the toner frame 12; whereas, the developing sleeve 10*d* and the developing blade 10*e* are attached to the developing frame 13. Longitudinal abutment portions of the frames 12, 13 are bonded to each other by ultrasonic welding, thereby integrally connecting these frames.

The developing sleeve 10*d* on which the toner layer is formed and the photosensitive drum 7 are positioned to be spaced apart from each other with a small gap (about 250 μm). To this end, in the illustrated embodiment, as shown by the exploded perspective view in FIG. 11, abutment rings 10*f* each having an outer diameter greater than an outer diameter of the developing sleeve 10*d* by a value corresponding to the above-mentioned gap are arranged in the vicinity of both axial ends of the developing sleeve 10*d* and out of a toner forming area on the developing sleeve, which abutment rings are abutted against the photosensitive drum 7 out of a latent image forming area thereon.

Further, a gear (helical gear) 10*g* is attached to one axial end of the developing sleeve 10*d* so that the gear 10*g* can be rotated together with the developing sleeve 10*d*. When the developing frame 13 is bonded to the cleaning frame 14, the gear 10*g* is meshed with the helical gear 7*c* of the photosensitive drum 7 so that the developing sleeve 10*d* can be rotated by the rotation of the photosensitive drum 7. Further, the gear 10*g* is meshed with a gear (not shown) connected to the toner feed member 10*b*, thereby transmitting the rotational force of the photosensitive drum 7 to the toner feed member 10*b*.

With this arrangement, in the image forming operation, by the rotation of the toner feed member 10*b*, the toner in the toner reservoir 10*a* is sent to the developing sleeve 10*d*, where the toner layer having a constant thickness is formed on the developing sleeve 10*d* by the developing blade 10*e*, and then the toner on the developing sleeve is transferred onto the electrostatic latent image formed on the photosensitive drum 7. Incidentally, the formation of the toner layer on the developing sleeve 10*d* is effected by supplying the toner to only a carbon coating area of the developing sleeve 10*d*, and a relation between (a) the photosensitive layer area on the photosensitive drum 7 along its longitudinal (axial) direction and (b) the charging area affected by the charger roller 8 and (c) the toner layer forming area (developing area) on the developing sleeve 10*d* is so selected to become (a)>(b)>(c).

Figure 11:
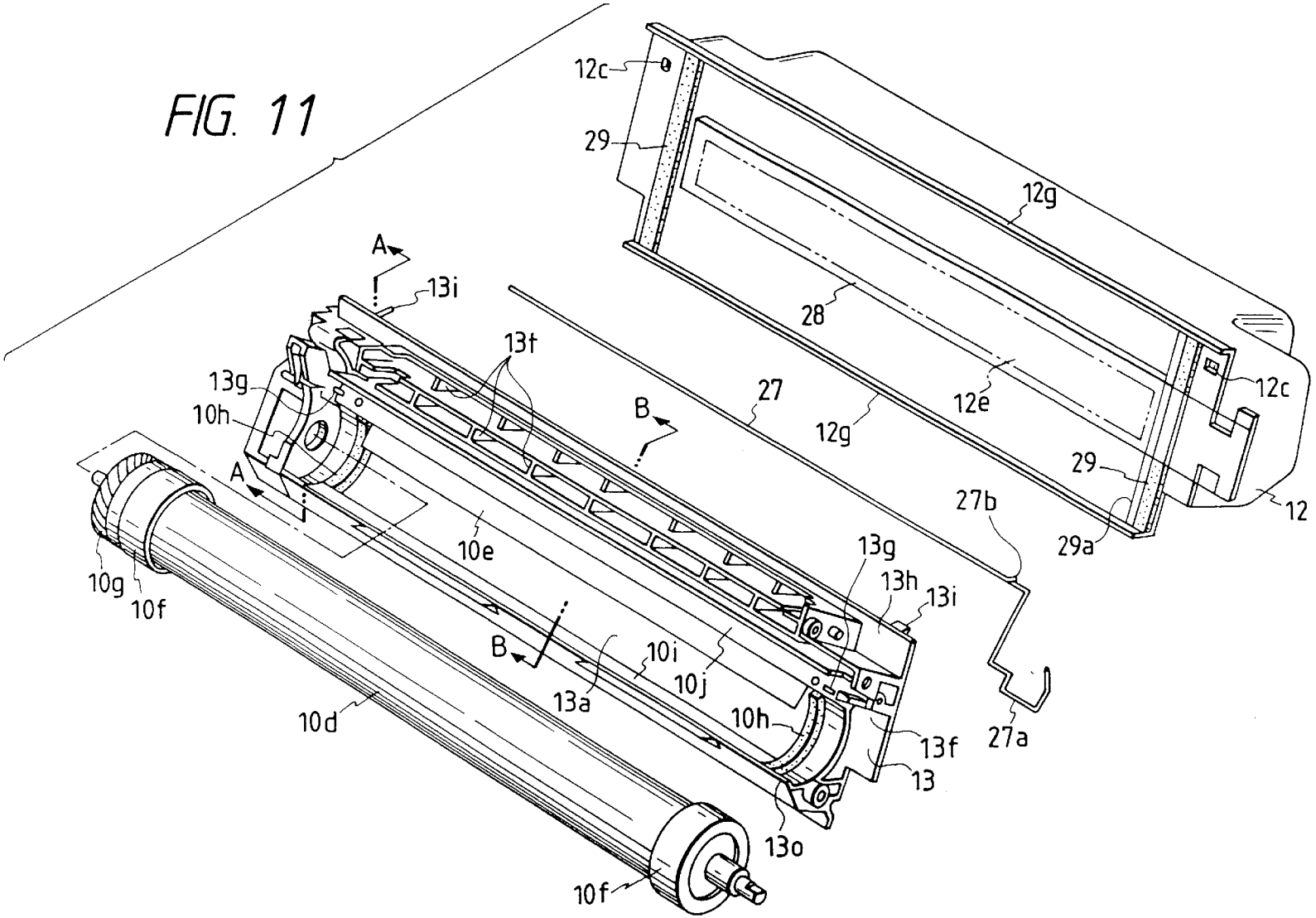
FIG. 11 is an exploded perspective view showing an overlapping relation between a blow sheet and toner leak preventing seals.

Incidentally, the toner in the toner reservoir 10*a* must be prevented from leaking between the developing sleeve 10*d* and the developing frame 13. To this end, in the illustrated embodiment, as shown in FIG. 11, toner leak preventing elastic seals 10*h* are arranged on both longitudinal end portions of an opening 13*a* which is formed in the developing frame 13 and through which the toner is fed toward the developing sleeve 10*d*, and an elastic blow sheet 10*i* is arranged along a lower edge of the opening 13*a* to contact with the whole length of the developing sleeve 10*d*.

Now, a thickness of each toner leak preventing seal 10*h* is equal to a thickness of a stepped portion formed on a lower edge 13*o* of the developing frame 13 so that, when the toner leak preventing seals 10*h* are adhered to the developing frame 13, upper surfaces of the seals 10*h* become flush with the lower edge 13*o*. The blow sheet 10*i* is adhered to an upper surface of the lower edge portion 13*o* by a both-sided adhesive tape (not shown). A (longitudinal) length of the blow sheet 10*i* is longer than a (longitudinal) length of the opening 13*a*, and both longitudinal end portions of the blow sheet are overlapped with the toner leak preventing seals 10*h*, and a (widthwise) free edge of the blow sheet is urged against the peripheral surface of the developing sleeve 10*d* along its length with an appropriate urging force.

Figure 12:
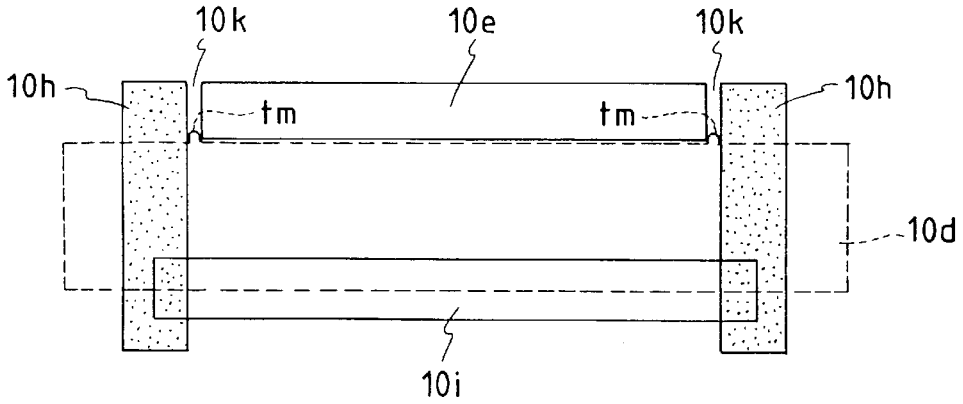
FIG. 12 is a view showing a positional relation between a developing blade and the toner leak preventing seals and the blow sheet.

The overlapped relation between the blow sheet and the toner leak preventing seals will now be fully described. Since the thickness of the developing blade 10*e* is about 13 mm, as shown in FIG. 12, both longitudinal end portions of the developing blade l0*e* and the toner leak preventing seals 10*h* cannot be overlapped, with the result that a small gap 10*k* is created between the end of the developing blade and each toner leak preventing seal. And, the toner leak preventing seals 10*h* are overlapped with the blow sheet 10*i* at areas axially outward of the gaps 10*k*.

Thus, when the toner layer is formed on the developing sleeve 10*d*, the toner tm passing through the gaps 10*k* is adhered to the developing sleeve 10*d* in a swelled condition. However, since there is no toner leak preventing seals 10*h* in the rotating areas of the toner tm, the toner tm is collected to the toner reservoir 10*a* through the blow sheet 10*i*, thereby preventing the toner from leaking out of the cartridge.

Figure 13A:
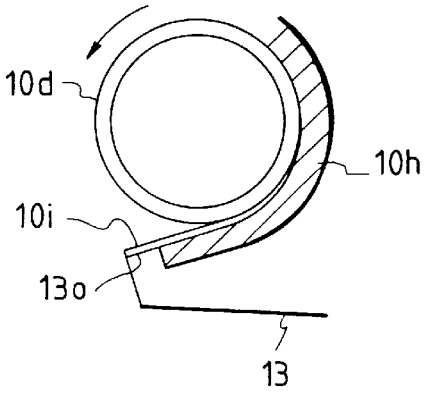
FIG. 13A is a sectional view taken along the line A—A in FIG. 11.
Figure 13B:
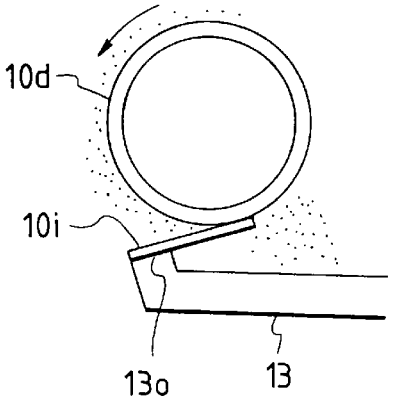
FIG. 13B is a sectional view taken along the line B—B in FIG. 11.
Figure 14A:
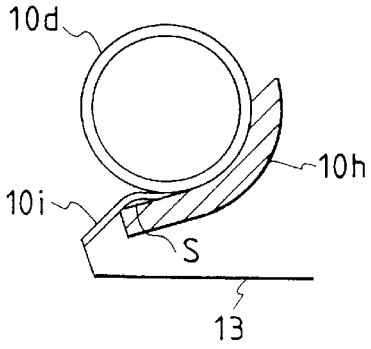
FIGS. 14A and 14B are views showing a case where a blow sheet is bent.
Figure 14B:
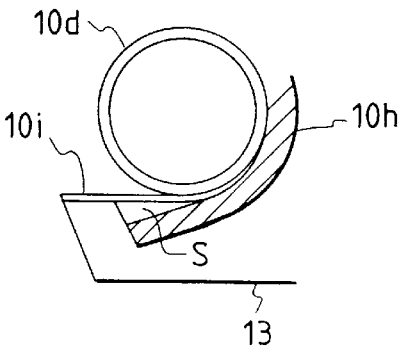

Further, FIG. 13A shows a section taken along the line A—A in FIG. 11, and FIG. 13B shows a section taken along the line B—B in FIG. 11. As shown in FIG. 13A, the toner leak preventing seals 10*h* and the blow sheet 10*i* are closely contacted with each other without bending at the overlapped areas, and they become in parallel with each other. If the blow sheet 10*i* is bent not to closely contacted with the toner leak preventing seals 10*h* as shown in FIGS. 14A and 14B, it is feared that the toner may leak between a gap between the seals and the sheet. However, in the illustrated embodiment, since the blow sheet 10*i* is not bent and is closely contacted with the toner leak preventing seals 10*h*, the risk of the leakage of toner can be avoided.

Further, in the illustrated embodiment, an abutment angle between the free edge portion of the blow sheet 10*i* and the peripheral surface of the developing sleeve 10*d* is defined by the upper surfaces of the toner leak preventing seals 10*h*, and there is no dispersion in the accuracy of the upper surfaces of the toner leak preventing seals. Thus, there is substantially no dispersion in the initial setting accuracy of the abutment angle. Further, since the blow sheet 10*i* is used in the straight condition, the abutment angle of the blow sheet 10*i* is difficult to change for a long time. Thus, the toner contained in the toner reservoir 10*a* is hard to leak between the blow sheet 10*i* and the developing sleeve 10*d*.

Incidentally, regarding the leakage of toner, it is feared that the toner is leaked between the developing blade 10*e* and the developing frame 13. To avoid this, in the illustrated embodiment, as shown by the sectional views in FIGS. 3 and 14, three longitudinal ribs 13*b*, 13*c*, 13*d* are formed on a portion of the developing frame 13 against which the developing blade 10*e* is abutted, so that the first and second ribs 13*b*, 13*c* are abutted against the developing blade 10*e* and the third rib 13*d* is abutted against a blade attachment member 10*j* such as a metal plate for attaching the developing blade 10*e*. Further, a free edge of the second rib 13*c* abutted against the developing blade 10*e* is sharpened so that, when the first rib 13*b* is abutted against the developing blade 10*e* and the third rib 13*d* is abutted against the blade attachment member 10*j*, the sharpened edge of the second rib 13*c* is penetrated into the developing blade made of rubber having a thickness of about 1.3 mm.

Further, the sharpened edge of the second rib 13*c* is curved so that a central portion of the edge in the longitudinal direction is convexly protruded slightly more than both end portions of the edge. Now, when the developing blade 10*e* is attached to the developing frame 13, since portions of the blade attachment member 10*j* near both longitudinal edges are secured by screws, the longitudinal central portion of the developing blade attached to the blade attachment member may be deflected. However, according to the above arrangement, even if the central portion of the blade is deflected, since the edge of the second rib 13*c* is curved so that the central portion is protruded more than both end portions (in a process cartridge capable of recording an image on A4 size sheet, it is preferable to protrude by 0.1–0.5 mm), the rib 13*c* can be surely penetrated into the developing blade 10*e* along its whole longitudinal edge. Accordingly, there is no gap between the developing frame 13 and the blade 10*e*, thus preventing the toner from leaking between the blade and the developing frame.

If a gap is created between the second rib 13*c* and the developing blade 10*e* and the toner is leaked therebetween, since the third rib 13*d* is abutted against the blade attachment member 10*j*, the leakage of toner is prevented by the third rib. Particularly, since the abutment area between the second rib 13*c* and the developing blade 10*e* is offset (i.e. not aligned) with respect to the abutment area between the third rib 13*d* and the blade attachment member 10*j* by an amount corresponding to the thickness of the developing blade 10*e*, the toner is hard to leak out of the cartridge through both the abutment area between the second rib 13*c* and the developing blade 10*e* and the abutment area between the third rib 13*d* and the blade attachment member 10*j*.

Figure 15:
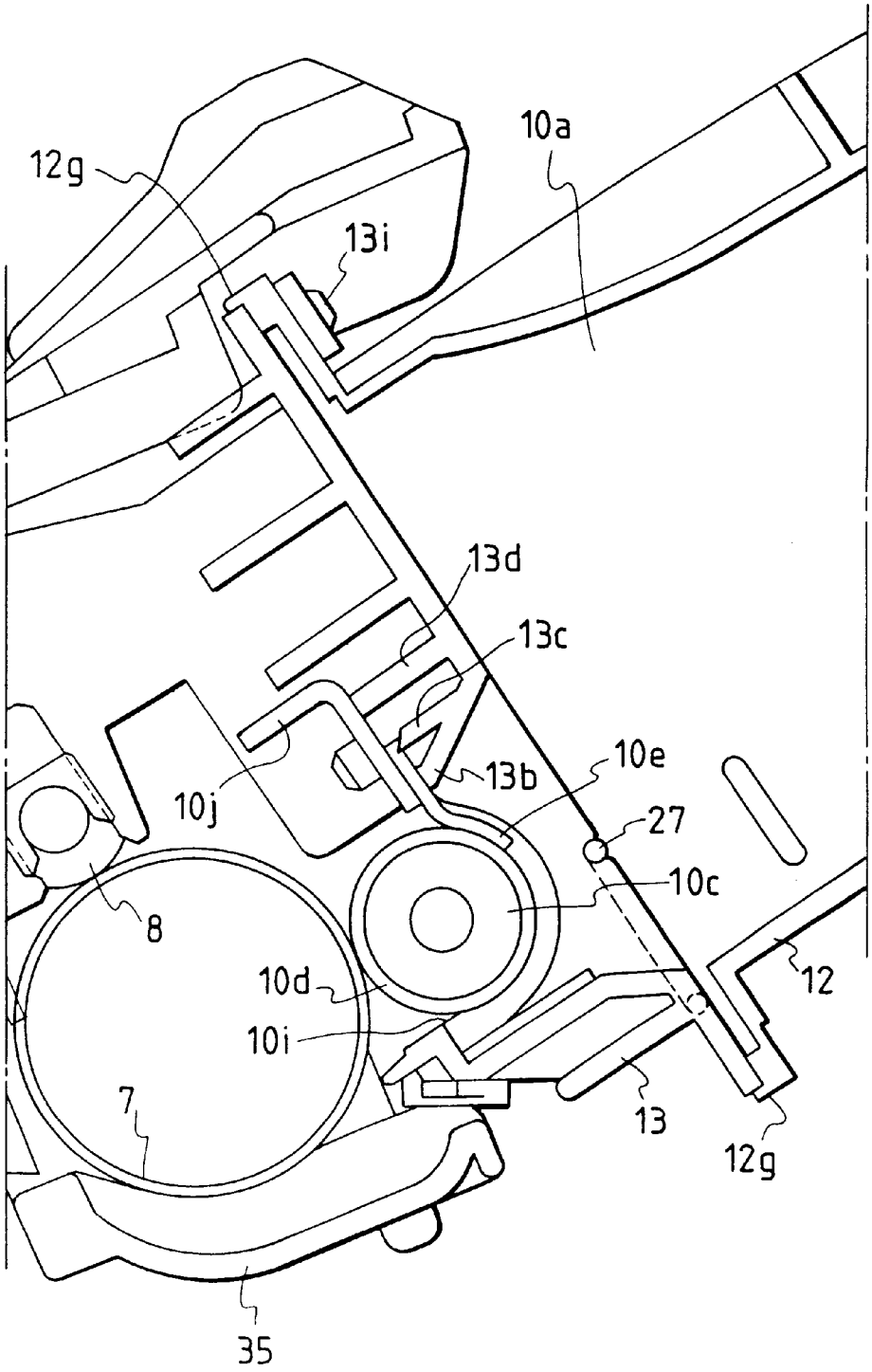
FIG. 15 is an enlarged sectional view showing a condition that a sharp rib is penetrated into a developing blade.

Further, in the developing means 10 according to the illustrated embodiment, there is provided a toner remaining amount detection mechanism for detecting the toner remaining in the toner reservoir 10*a*. As shown in FIGS. 11 and 15, this mechanism comprises a metallic antenna wire 27 arranged at a jointed zone between the toner frame 12 and the developing frame 13 and in a toner passage from the toner reservoir 10*a* to the developing sleeve 10*d*. By acting the antenna wire 27 as a first electrode and the developing sleeve 10*d* as a second electrode, the voltage is applied between the first and second electrodes. In this case, if there is any toner between the electrodes, the electrostatic capacity therebetween will be increased; whereas, if there is no toner between the electrodes, the electrostatic capacity will be decreased. Accordingly, by detecting the change in the electrostatic capacity by a control portion 60 (refer to FIG. 59), it is possible to detect the toner remaining amount. By comparing an electric signal representative of the electrostatic capacity with a predetermined reference value, it is possible to detect a "no toner" condition. When the "no toner" condition is detected by the control portion 60, for example, a lamp (alarm for process cartridge exchange) is lightened to inform an operator of the need for exchanging the process cartridge B. Incidentally, a concrete circuit for detecting the toner remaining amount will be described later.

Regarding the jointed zone between the toner frame 12 and the developing frame 13, since the longitudinal jointed area is welded, the toner cannot leak through this jointed area. However, the widthwise jointed areas cannot be welded, because, as shown in FIG. 11, an opening 12*e* formed in the toner frame 12 is sealingly covered by a cover film 28 to prevent the leakage of the toner in the toner reservoir 10*a* of the process cartridge B and a free end of the cover film 28 is exposed outwardly through the width-wise jointed area (between the frames 12, 13) so that in use the operator can pull the free end of the cover film 28 to open the opening 12*e*. Therefore, in order to prevent the toner from leaking through the widthwise jointed areas between the toner frame 12 and the developing frame 13, toner leak preventing seals 29 are disposed at the widthwise jointed areas.

Figure 16:
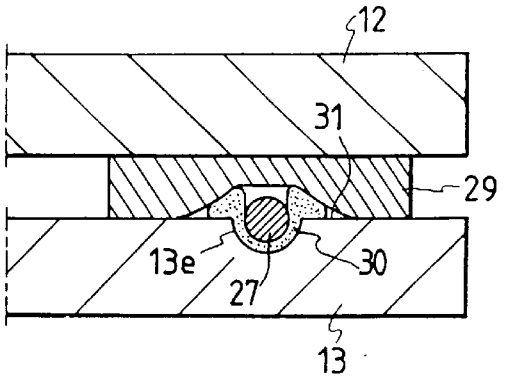
FIG. 16 is a sectional view showing a condition that an adhesive for an antenna wire is swollen.

However, as mentioned above, since the voltage is applied to the antenna wire or line 27, one end of the antenna line 27 must be protruded outwardly through the jointed zone between the frames 12, 13 and a contact portion 27*a* is formed on the end of the antenna line. To this end, the antenna line 27 must be protruded outwardly through the widthwise jointed area (between the toner frame 12 and the developing frame 13) where the toner leak preventing seal 29 is adhered. In order to attach the antenna line 27 in this way, as shown in FIG. 16, a recess 13*e* is formed in the developing frame 13 at its jointed zone, and an adhesive 30 such as silicone is coated on the surface of the recess 13*e*, and then the antenna line 27 is adhered to the developing frame 13 by inserting the antenna line into the recess. When the antenna line 27 is inserted into the recess 13*e*, as shown in FIG. 16, the adhesive 30 coated on the surface of the recess 13*e* is projected from the recess and swollen. If the adhesive 30 is cured in the swelled condition, even when the toner leak preventing seal 29 is adhered to the frame 13, the seal 29 cannot be closely contacted with the developing frame 13 completely, thereby often creating a clearance 31. Although such clearance 31 is small, since the toner comprises fine particles, it is feared that the toner is leaked through the clearance 31.

Figure 17A:
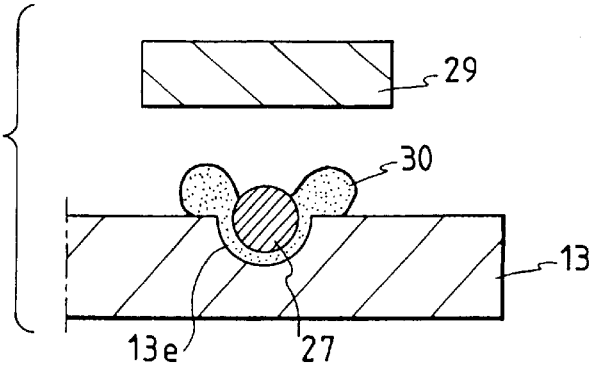
FIG. 17A is a view showing a condition that the adhesive is swollen by fitting the antenna wire.
Figure 17B:
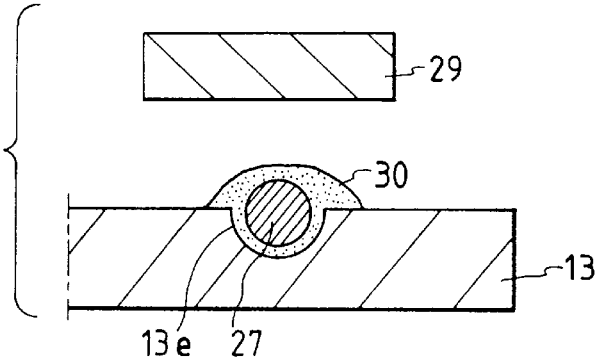
FIG. 17B is a view showing a condition that the swelled adhesive is averaged.
Figure 17C:
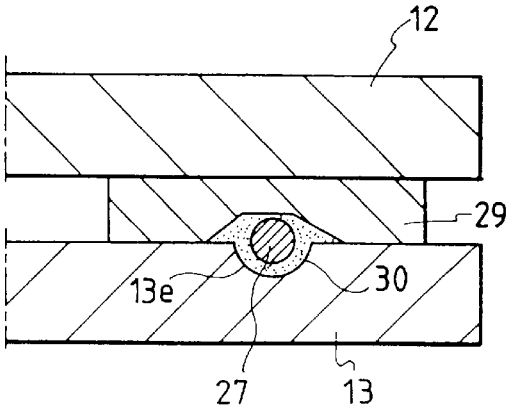
FIG. 17C is a view showing a condition that a seal is attached.

To avoid this, in the illustrated embodiment, as shown in FIG. 17A, after the antenna line 27 is inserted into the recess 13*e* having the adhesive 30 therein, the adhesive swollen from the recess 13*e* is flattened or averaged along and on the antenna line 27 (as completely covering the antenna line 27) by a rod member or the like as shown in FIG. 17B. Thereafter, as shown in FIG. 17C, when the toner leak preventing seal 29 is adhered to the frame 13, the seal 29 can be closely contacted with the surface (to be jointed) of the developing frame 13 without any clearance, thereby preventing the leakage of toner completely. Incidentally, when the swelled adhesive 30 is averaged as shown in FIG. 17B, new adhesive may be added to average the adhesive and completely cover the antenna line 27.

Figure 18A:
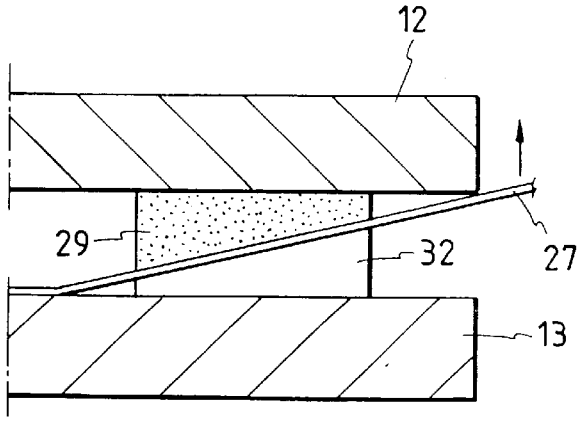
FIG. 18A is a view showing the antenna wire which is not bent.
Figure 18B:
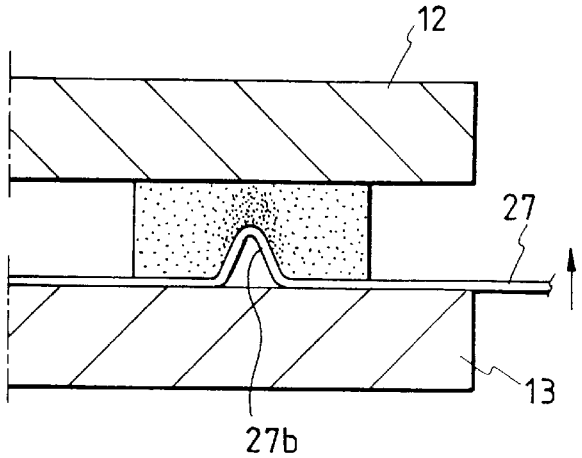
FIG. 18B is a view showing the antenna wire which is bent.

Further, the contact portion 27*a* of the antenna line 27 is exposed outwardly. Therefore, it is feared that the exposed portion of the antenna line 27 is erroneously struck against any body by the operator during the handling of the process cartridge B. Since the toner leak preventing seal 29 is made of foam urethane having a thickness of about 4 mm and is elastic, if the exposed portion of the antenna line 27 is struck against any body, as shown in FIG. 18A, it is feared that the antenna line 27 is floated from the developing frame 13. Also in this case, a small clearance 32 is created between the frame 13 and the antenna line 27, resulting in the leakage of toner. To avoid this, in the illustrated embodiment, as shown in FIG. 18B, a bent portion 27*b* bent in an L-shape directing from the developing frame 13 to the toner frame 12 is formed on the antenna line 27 disposed in the jointed zone between the toner frame 12 and the developing frame 13. At this bent portion 27*b*, since the seal 29 having the thickness of about 4 mm is compressed up to about 1 mm, the elastic deformation does not occur. Accordingly, if the shock acts on the exposed portion of the antenna line 27 as mentioned above, the antenna line 27 does not float from the recess 13*e* of the developing frame 13. Thus, since the clearance as shown in FIG. 18A is not created, the risk of the leakage of the toner can be avoided.

(Toner Leak Preventing Seal):

Next, the toner leak preventing seal 29 will be explained. The toner leak preventing seals 29 are adhered to both longitudinal end portions of the opening 12*e* of the toner frame 12 by both-sided tapes. As shown in FIG. 11, on the upper surface of the toner leak preventing seal 29 disposed at a side that the operator draws out the cover film 28, a tear preventing sheet 29*a* having a width narrower than a width of the seal 29 and a thickness of about 0.01–1 mm is adhered.

Figure 19:
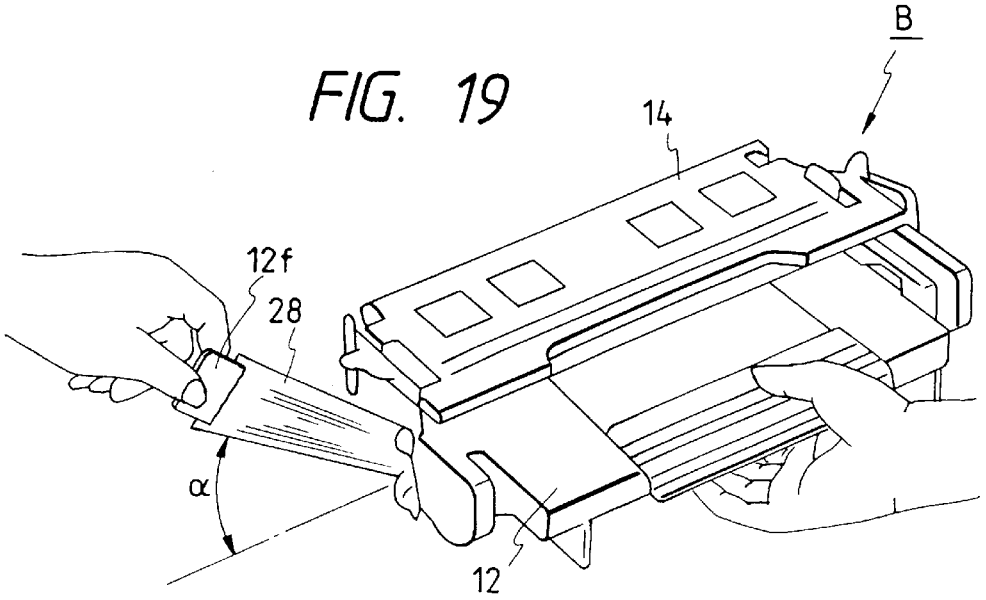
FIG. 19 is a perspective view of a cartridge showing a condition that a cover film is drawn obliquely.
Figure 20:
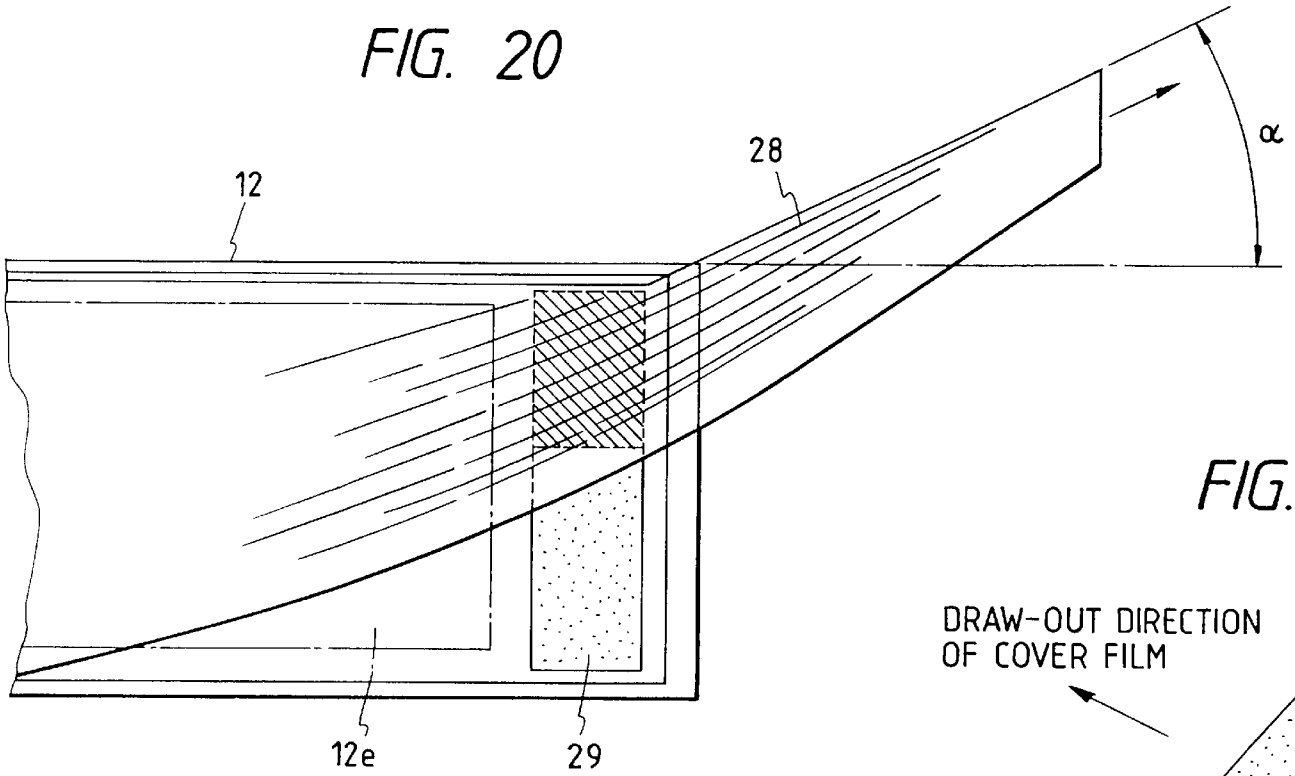
FIG. 20 is a view showing a relation between the cover film and the toner leak preventing seal when the cover film is drawn obliquely.

The reason why the tear preventing sheet 29*a* is provided is as follows. That is to say, in use, the operator must draw out the cover film 28 by hand to open the opening 12*e* of the process cartridge B. In this case, there is no problem when the operator pulls the cover film 28 in a film draw-out direction (corresponding to the longitudinal direction of the opening 12*e*). However, as shown in FIG. 19, when the cover film is pulled in a direction inclined with respect to the film draw-out direction by an angle $\alpha$, as shown in FIG. 20, the width of the cover film 28 is shortened or wrinkled by gathering the sheet in one direction (upward direction in FIG. 20), with the result that the creases of the sheet are rubbed against the toner leak preventing seal 29, thereby often tearing a portion (hatched area) of the seal 29. If the toner leak preventing seal 29 is torn or broken, the toner is leaked through the broken portion of the seal, thus smudging the operator's hand or often dropping into the image forming apparatus to smudge the recorded recording medium.

However, as in the illustrated embodiment, when the tear preventing sheet 29*a* is adhered to the toner leak preventing seal 29 through which the cover film 28 is drawn out, if the creases are created during the pulling of the cover film 28, since the tear preventing sheet 29*a* protects the seal 29, the seal 29 is prevented from tearing. Accordingly, regardless of the direction along which the operator draws out the cover film 28, the leakage of the toner can be prevented.

Further, by providing the tear preventing sheet 29*a* along the width of the seal 29 at a side of the opening 12*e*, while the cover film 28 is being drawn out, the toner adhered to the film 28 is scraped by the tear preventing sheet 29*a*, thereby eliminating the possibility that the operator's hand is smudged by the drawn-out film 28.

Incidentally, when the toner frame 12 and the developing frame 13 are welded to each other, since the toner leak preventing seal 29 and the tear preventing sheet 29*a* are firmly pinched between and secured by the frames 12, 13 at both longitudinal end thereof (upper and lower ends in FIG. 11), the sheet 29*a* is not deviated from the seal 29. The tear preventing sheet 29*a* is preferably made from material which is strong against the rubbing to the cover film 28, for example, such as polyethylene terephthalate or high dense polyethylene.

Figure 21:
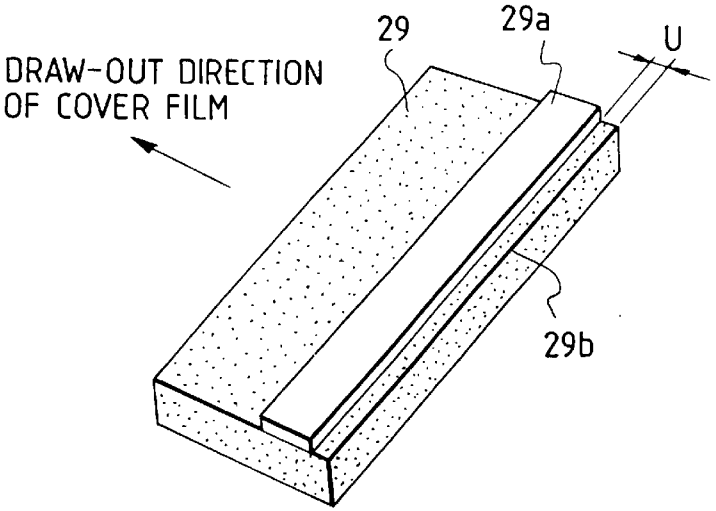
FIG. 21 is a perspective view showing a condition that a tear preventing sheet is secured to the toner leak preventing seal in spaced relation to an edge of the toner leak preventing seal.

Further, when the tear preventing sheet 29*a* having the width smaller than the width of the toner leak preventing seal 29 is adhered to the seal 29, as shown in FIG. 21, the adhering position of the sheet 29*a* is spaced apart from an edge 29*b* of the toner leak preventing seal 29 in the film draw-out direction by a distance U. By doing so, while the cover film 28 is being drawn out, the toner adhered to the film 28 is scraped by the edge 29*b* more effectively. And, when the distance is selected to be about 5 mm or less, the tear preventing effect regarding the toner leak preventing seal 29 is not worsened during the draw-out of the cover film 28.

Incidentally, as mentioned above, the tear preventing sheet 29*a* may have a width not smaller than the width of the toner preventing seal 29 so that the sheet is adhered to the whole surface of the seal 29.

Figure 22:
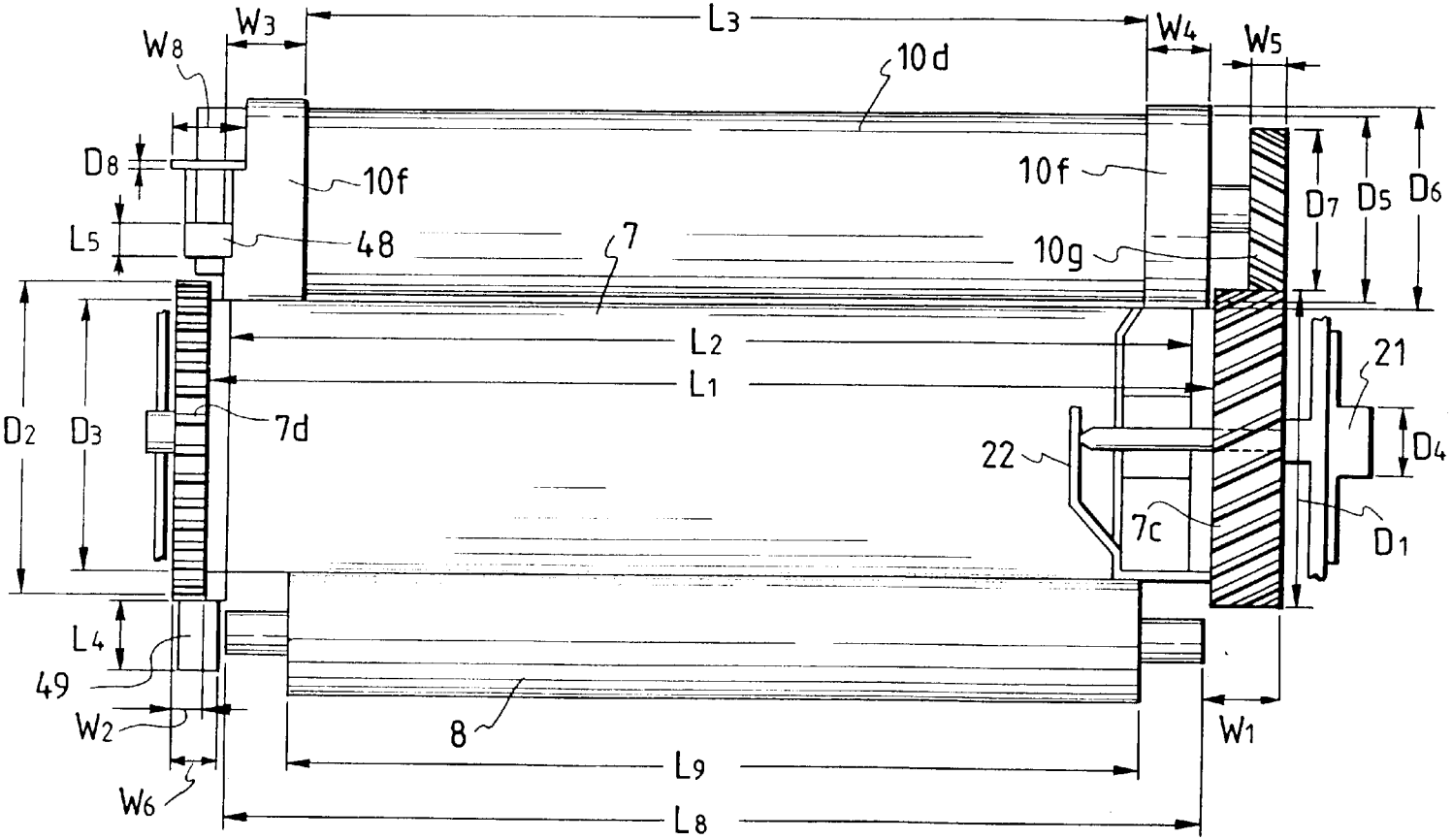
FIG. 22 is a view showing various dimensions of a photosensitive drum, a developing sleeve and a charger roller.
Figure 23:
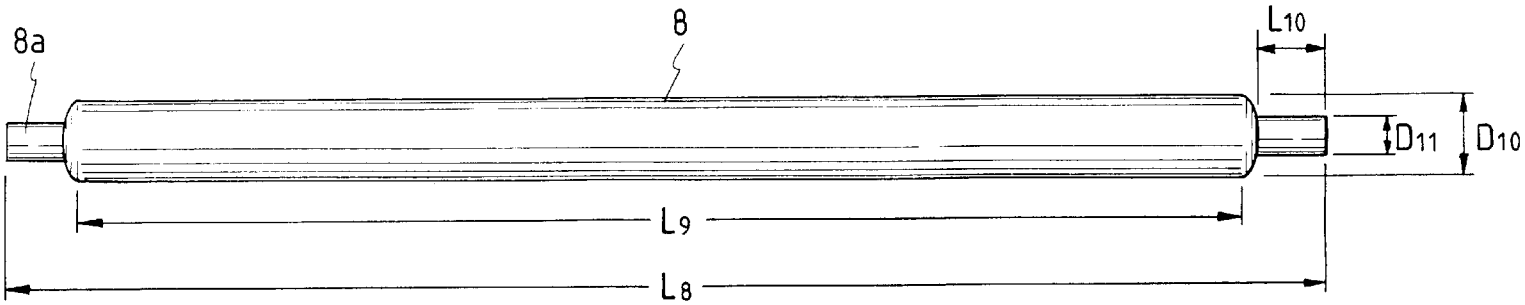
FIG. 23 is a view showing various dimensions of the charger roller.

(Various Sizes of Photosensitive Drum and the like):

Next, various sizes of the photosensitive drum 7, charger roller 8 and developing sleeve 10*d* according to the illustrated embodiment, and the positional relation between these elements will be explained with reference to FIGS. 22 and 23. However, the present invention is not limited to such example, but other sizes and positional relation may be adopted appropriately.

| | | |
|---|---|---|
| (1) | Number of teeth of helical gear 7c | 32; |
| (2) | Diameter (D1) of helical gear 7c | about 31.85 mm; |
| (3) | Width (W1) of helical gear 7c | about 9.8 mm; |
| (4) | Number of teeth of gear flange 7d | 43; |
| (5) | Diameter (D2) of gear flange 7d | about 32 mm; |
| (6) | Width (W2) of gear flange 7d | about 5.6 mm; |
| (7) | Length (L1) of photosensitive drum 7 | about 254 mm; |
| (8) | Length (L2) of photosensitive body coating area on photosensitive drum 7 | about 250 mm |
| (9) | Diameter (D3) of photosensitive drum 7 | about 30 mm; |
| (10) | Diameter (D4) of metal shaft 21 of photosensitive drum 7 | about 10 mm; |
| (11) | Length (L3) of developing sleeve 10d | about 246 mm; |
| (12) | Length (L4) of carbon coating area on developing sleeve 10d | about 216 mm; |
| (13) | Diameter (D5) of developing sleeve 10d | about 16 mm; |
| (14) | Outer diameter (D6) of ring member 10f | about 16.5 mm; |
| (15) | Length (L5) of ring member 10f | about 12 mm; |
| (16) | Length (L6) of ring member 10f | about 9 mm; |
| (17) | Outer diameter (D7) of drum abutment portion of ring member 10f | about 16.7 mm; |
| (18) | Thickness (E1) of drum abutment portion of ring member 10f | about 0.3 mm; |
| (19) | Width (W3) of drum abutment portion of ring member 10f | about 4 mm; |
| (20) | Number of teeth of developing gear 10g | 17; |
| (21) | Diameter (D8) of developing gear 10g | about 18.1 mm; |
| (22) | Width (W4) of developing gear 10g | about 8.3 mm; |
| (23) | Length (L7) of charging bias contact 49 | about 7 mm; |
| (24) | Width (W5) of charging bias contact 49 | about 7.8 mm; |
| (25) | Length (L8) of charging bias contact 48 | about 6 mm; |
| (26) | Width (W6) of charging bias contact 48 | about 9.4 mm; |
| (27) | Diameter (D9) of contact portion 27a of antenna line 27 | about 2 mm; |
| (28) | Width (W7) of contact portion 27a of antenna line 27 | about 15.5 mm; |
| (29) | Length (L8) of charger roller 8 | about 251 mm; |
| (30) | Length (L9) of charging portion (rubber portion) of charger roller 8 | about 225 mm; |
| (31) | Diameter (D10) of charger roller 8 | about 12 mm; |
| (32) | Length (L10) of roller shaft 8a | about 12 mm; and |
| (33) | Diameter (D11) of roller shaft 8a | about 6 mm. |

Incidentally, here, the helical gear 7*c* and the developing gear 10*g* are so-called helical gears, so that, when the gear 7*c* is subjected to the driving force from the image forming apparatus, the photosensitive drum 7 mounted with play is subjected to the thrust force directed to the gear 7*c*. Thus, the photosensitive drum 7 is shifted in the thrust direction by the thrust force, with the result that the photosensitive drum is abutted against the cleaning frame 14, thus positioning the photosensitive drum in the thrust direction.

(Cleaning Means):

The cleaning means 11 serves to remove the toner remaining on the photosensitive drum 7 after the toner image on the photosensitive drum 7 is transferred onto the recording medium 2 by the transfer means 4. As shown in FIG. 3, the cleaning means 11 comprises a cleaning blade 11a contacted with the surface of the photosensitive drum 7 and adapted to scrape off the toner remaining on the drum 7, a dip sheet 11*b* disposed below the blade 11*a* to receive and scraped toner and contacted with the surface of the photosensitive drum 7, and a waste toner reservoir 11*c* for collecting the received waste toner. Incidentally, the dip sheet 11*b* is lightly contacted with the surface of the photosensitive drum 7 so that it permits the passage of the waste toner on the photosensitive drum 7 and directs the toner removed from the photosensitive drum 7 by the blade 11*a* toward a direction away from the surface of the photosensitive drum 7 (i.e., toward the waste toner reservoir 11*c*).

Similar to the developing blade 10*e*, the cleaning blade 11*a* is made of rubber and the like and is adhered to a blade attachment member 11*d* by a both-sided adhesive tape, which blade attachment member is attached to the cleaning frame 14 by screws. Further, the dip sheet 11*b* is adhered to a dip sheet adhesion surface (edge portion) 11*c*1 of the waste toner reservoir 11*c* by a both-sided adhesive tape.

Now, it is necessary to prevent the waste toner collected in the waste toner reservoir 11*c* from leaking between both longitudinal ends of the cleaning blade 11a and the opposed cleaning frame 14. To this end, toner leak preventing seals are adhered to both longitudinal end portions of the blade 11*a*. However, if the toner leak preventing seals are not closely contacted with the cleaning blade 11*a* completely, it is feared that the toner is leaked through a gap between the seal and blade. Similarly, if the toner leak preventing seals are not closely contacted with the dip sheet adhesion surface 11*c*1 of the waste toner reservoir 11*c*, it is feared that the toner is leaked through a gap between the seal and the adhesion surface.

Figure 24:
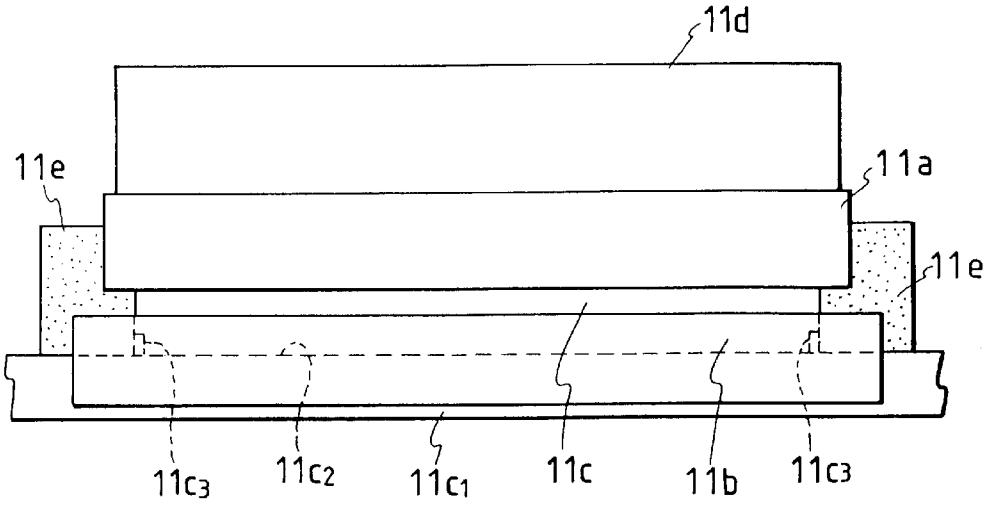
FIG. 24 is a plan view showing toner leak preventing seals and screens disposed on both ends of a cleaning blade.
Figure 25:
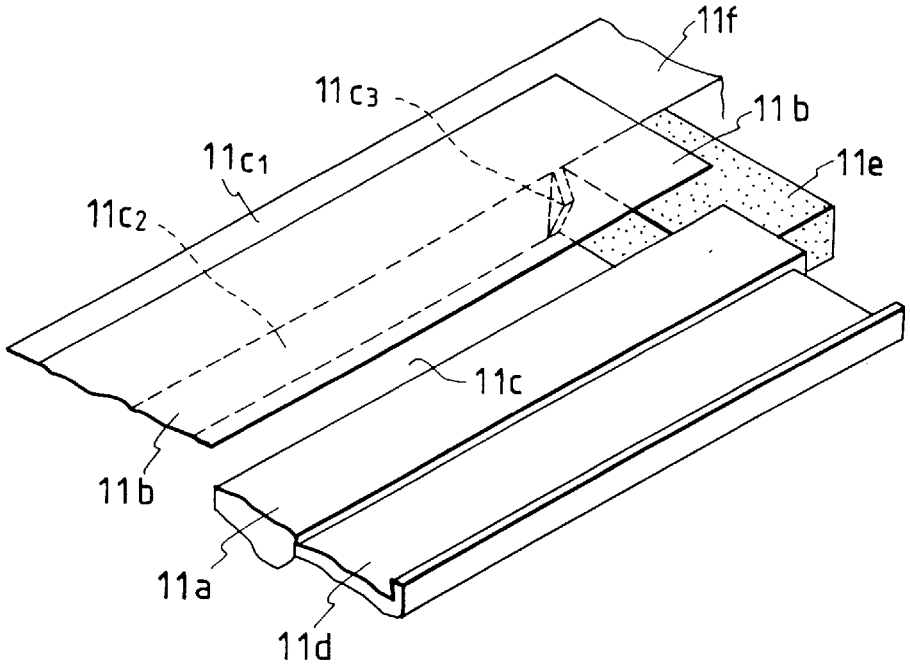
FIG. 25 is a perspective view showing the toner leak preventing seal and the screens disposed on the end of the cleaning blade.

To avoid this, in the illustrated embodiment, as shown in FIG. 24, toner leak preventing seals 11*e* are provided on both longitudinal ends of the cleaning blade 11*a*. The portions where the seals 11*e* are provided will be further fully described. As shown in FIGS. 24 and 25, the seals 11*e* are adhered to both end portions of the waste toner reservoir 11*c*, and the both longitudinal end portions of the cleaning blade 11*a* are adhered to the seals 11*e*. Further, screen members 11*c*3 are formed on an upper surface 11*c*2 of the waste toner reservoir 11*c* to contact with inner surfaces of the corresponding seals 11*e*.

Figure 26:
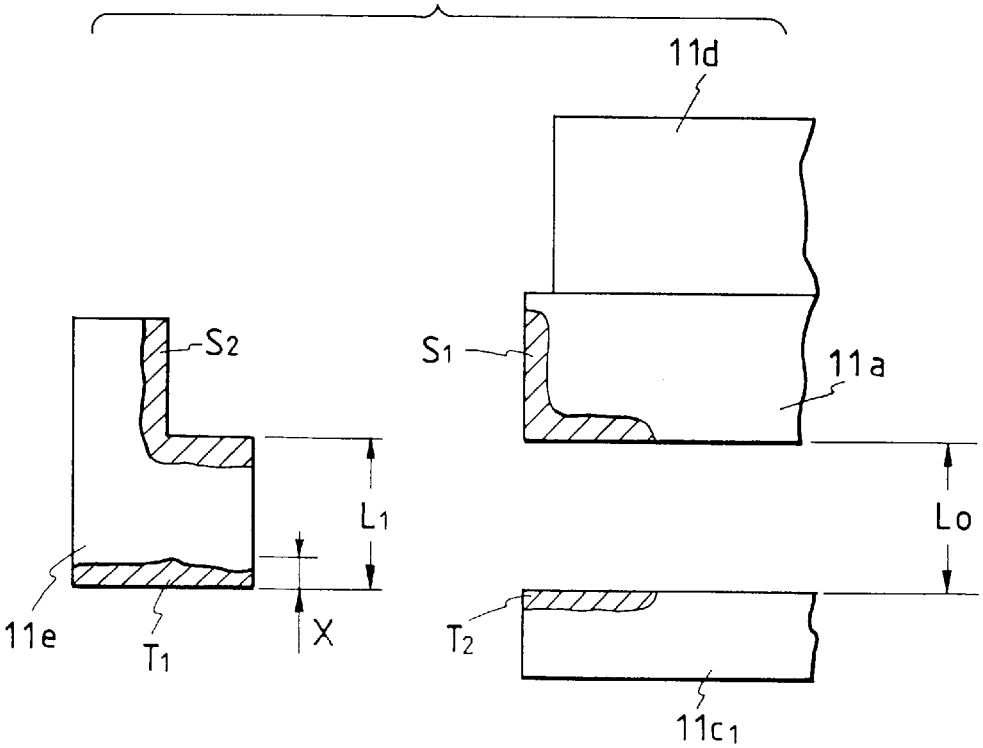
FIG. 26 is an explanatory view for explaining a method for attaching the toner preventing seal on the end of the cleaning blade.

Now, a method for attaching the toner leak preventing seals 11*e* will be explained. First of all, the cleaning blade 11*a* is attached to the cleaning frame 14, and then the seals 11*e* are attached in such a manner that edges S2 of the seals are closely contacted with both longitudinal edges S1 of the cleaning blade 11*a* shown in FIG. 26. In this case, if the width W1 of the seal 11*e* is longer than a distance L0 between the dip sheet adhesion surface 11*c*1 and the cleaning blade 11*a*, a clearance is created between a lower edge T1 of the seal 11*e* and the dip sheet adhesion surface 11*c*, thus causing the leakage of toner. In order to prevent this, in the illustrated embodiment, the distance L0 is selected to be greater than the width L1 (L0>L1) in tolerance and a compression amount X is given to the seal 11*e*. In this case, the seal 11*e* must be adhered to the dip sheet adhesion surface 11*c*1 while urging the lower edge T1 of the seal against a hatched portion T2 of the adhesion surface; however, in the illustrated embodiment, since the screen members 11*c*3 are provided, the waste toner is prevented from leaking while sliding laterally along the dip sheet adhesion surface. Thus, it is possible to make the compression amount X of the seal lie substantially zero in tolerance.

(Frames):

Next, the frames constituting the housing of the process cartridge B will be explained. As shown in FIG. 7, the housing of the process cartridge B is constituted by the toner frame 12, developing frame 13 and cleaning frame 14. The toner frame 12 and the developing frame 13 are integrally welded to each other to form a toner developing frame C. The toner developing frame C is connected to the cleaning frame 14 in a manner as described later to form the housing of the process cartridge B. Incidentally, the frames 12, 13, 14 according to the illustrated embodiment are formed from polystyrene resin by injection molding. When the frames 12, 13, 14 are made of material having the charging feature near that of the toner component, even if the toner is rubbed against the frames during the image forming operation, the abnormal charge is not generated due to the frictional charging, thereby preventing the deterioration of the image quality.

In this respect, in the illustrated embodiment, as shown in the following Table 1 (literature "Surface Polymer and Electrostatics" Surface Film Molecule Design Series 5, published from Japan Surface Science Associates, written by Yuji Murata), since the polystyrene which is material for the frames and the styrene acryl which is toner component are both same styrene group and have the similar charging feature, even if the toner is rubbed against the frames, the abnormal charge is not generated. Incidentally, "styrene group" means a base material including styrene of 60% or more.

TABLE 1

| (Charging System) |
|---|
| (positive end) |
| Silicone elastomer with silica filler |
| \| |
| Cellulose sponge |
| Cotton, woven |
| Polyurethane elastomer |
| Styrene acrylonitrile copolymer (Material of toner binding agent in the embodiment) |
| Styrene butadiene copolymer |
| Polystyrene (Material of frames in the embodiment) |
| Polyisobutylene |
| Polyurethane flexible sponge |
| Borosilicate glass, ground surface |
| \| |
| Polytetrafluoroethylene |
| (negative end) |

By the way, as shown in FIG. 7, the toner reservoir 12*a* and the toner feed member 10*b* is provided in the toner frame 12. Further, as shown in FIGS. 3 and 4, a plurality of longitudinal ribs 12*d* are formed on an outer surface of the toner frame 12, which ribs constitute a gripper portion. The widths of the ribs 12*d* formed on the outer surface of the toner frame 12 are gradually changed to form the R configuration wholly. Thus, when the process cartridge B is mounted or dismounted with respect to the image forming apparatus A, since the operator can easily grip the toner frame 12 without slipping, the mounting and dismounting operability is improved.

Further, as shown in FIG. 7, the developing sleeve 10*d* and the developing blade 10*e* are provided on the developing frame 13. As shown in FIG. 11, although the developing blade 10*e* is mounted by attaching both longitudinal end portions of the blade attachment member 10*j* to which the blade is adhered to the frame 13 by screws, in the illustrated embodiment, prior to the attachment by the screws, the blade attachment member 10*j* is positioned with respect to the developing frame 13. To this end, positioning bosses 13*g* are uprightly formed on a blade attachment surface 13*f* of the developing frame 13, and holes formed in the blade attachment member 10*j* are fitted onto the positioning bosses 13*g*, thereby positioning the attachment member with respect the frame 13. Further, as shown in FIGS. 7 and 11, positioning bosses 13*i* are uprightly formed on an interface 13*h* of the developing frame 13 which is to be joined to the toner frame 12 (these positioning bosses are disposed on both longitudinal end portions of the developing frame 13, as shown in FIG. 11), and these bosses 13*i* are fitted into fitting holes 12*c* formed in the toner frame 12, thereby positioning the joint position between the developing frame 13 and the toner frame 12.

Figure 27:
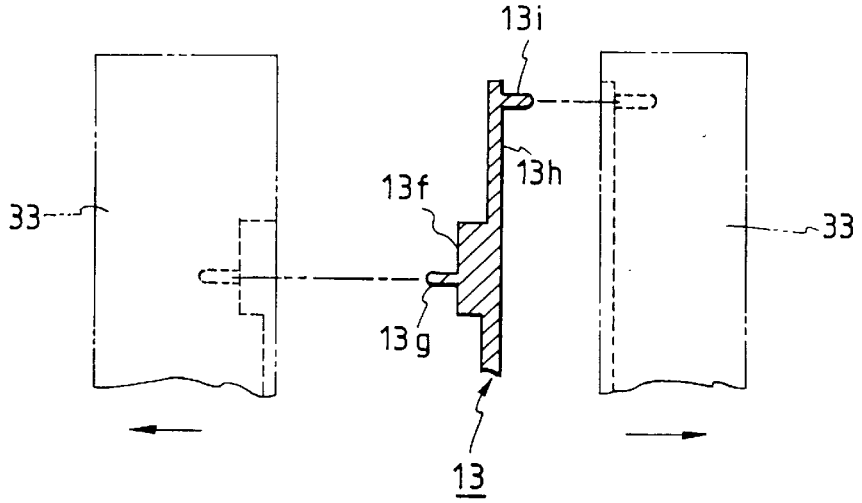
FIG. 27 is a view showing a method for demolding a developing frame.

In the illustrated embodiment, as shown in FIG. 27, it is so designed that the blade attachment surface 13*f* and the joint interface 13*h* of the developing frame 13 are in parallel with each other. Thus, when the developing frame 13 is formed by injection molding, since the bosses 13*g* for positioning the blade and the bosses 13*i* for positioning the toner frame are in parallel with each other, after the molding operation, only by separating molds 33 from each other in the left and right direction, the molded frame can easily be separated from the molds.

Figure 28:
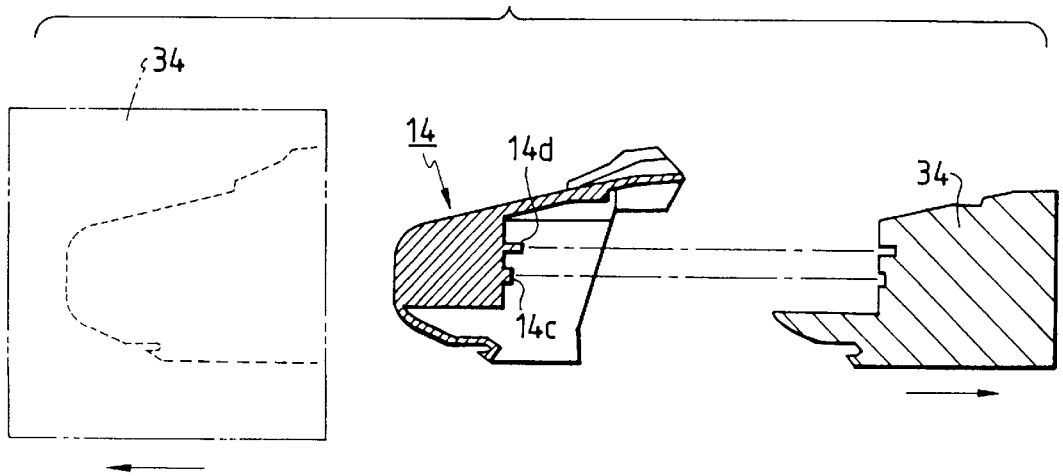
FIG. 28 is a view showing a method for demolding a cleaning frame.

Further, as shown in FIG. 7, the photosensitive drum 7, the charger roller 8, and the cleaning blade 11*a*, dip sheet 11*b* and waste toner reservoir 11*c* of the cleaning means 11 are provided on the cleaning frame 14. Incidentally, when the cleaning blade 11*a* is attached to the cleaning frame 14, similar to the attachment of the developing blade 10*e* as mentioned above, both longitudinal end portions of a blade attachment member 11*d* to which the cleaning blade is adhered are attached to the frame 14 by screws. However, prior to the attachment by the screws, the blade attachment member 11*d* is positioned with respect to the frame 14. To this end, as shown in FIG. 28, positioning bosses 14*d* are uprightly formed on a blade attachment surface 14*c* of the frame 14, and holes (not shown) formed in the blade attachment member 11*d* are fitted onto the bosses 14*d*, thereby positioning the attachment member with respect to the cleaning frame. In this case, it is so designed that the blade attachment surface 14*c* becomes perpendicular to a mold releasing direction (as shown by the arrow in FIG. 28) for molds 34. With this arrangement, since the protruded direction of the positioning bosses 14*d* formed on the blade attachment surface 14*c* is aligned with the mold releasing direction for the molds 34, the design of the molds 34 can be facilitated.

Incidentally, the drum shutter 35 shown in FIG. 3 is pivotably mounted on the cleaning frame 14. The drum shutter 35 serves to open and close an opening through which the photosensitive drum 7 faces the transfer roller 4. As will be described later, the drum shutter is automatically opened when the process cartridge B is mounted to the image forming apparatus A and is automatically closed when the process cartridge is dismounted from the image forming apparatus A.

Figure 29:
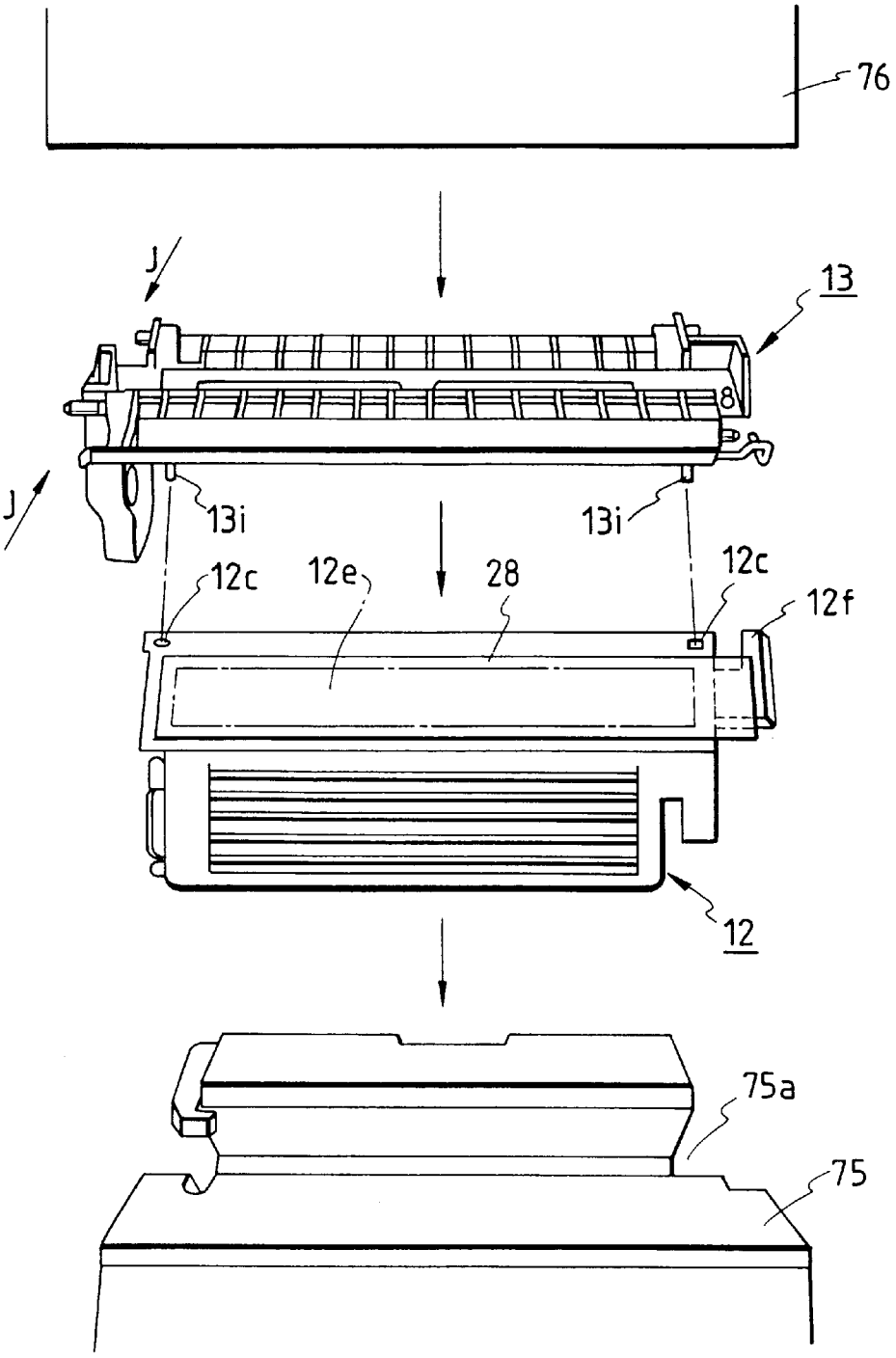
FIG. 29 is a view showing a process for bonding a toner frame and a developing frame by ultrasonic welding.
Figure 30:
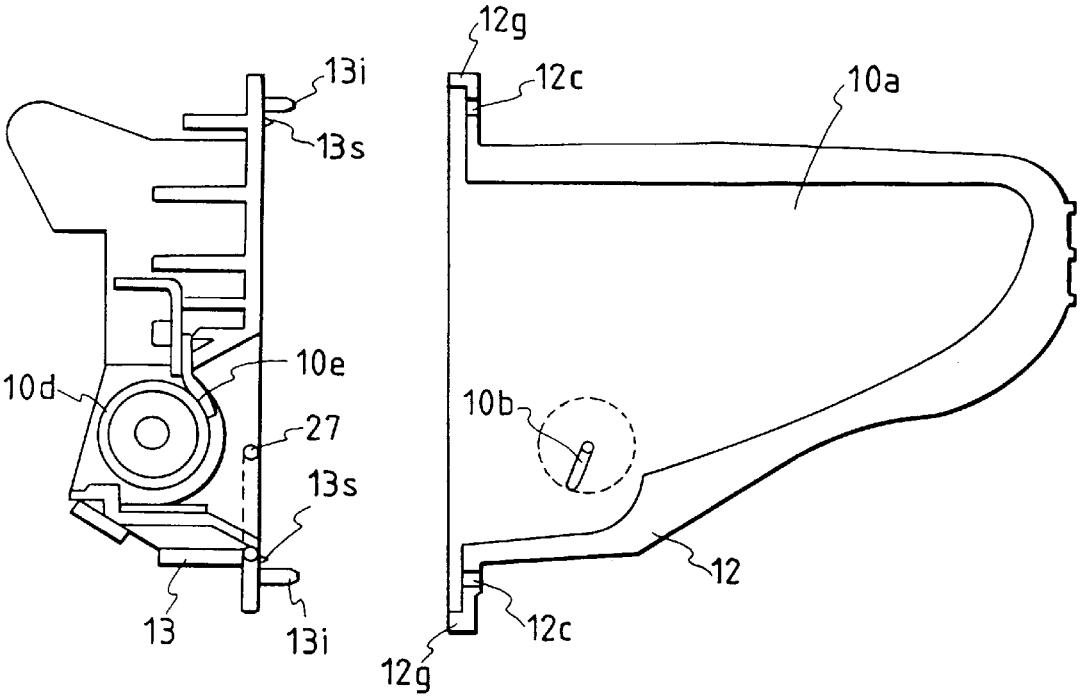
FIG. 30 is a view showing positioning bosses and fitting holes formed on and in the toner frame and the developing frame in a widthwise direction thereof.

(Welding between Toner Frame and Developing Frame):

Now, the welding between the toner frame 12 and the developing frame 13 will be explained. The frames 12, 13 are joined to each other by ultrasonic welding. That is to say, after the opening 12*e* of the toner frame 12 is closed by the cover film 28, as shown in FIG. 29, the toner frame 12 is set in a recessed portion 75*a* of a receiving tool 75, and then a separable cover film draw-out grip 12f formed integrally with the frame 12 is bent downwardly. Then, the developing frame 13 is overlapped with the toner frame 12, and the developing frame 13 is pressed from above by a press (hold-down) tool 76. In this condition, when the ultrasonic waves are applied to the toner frame 12 and the developing frame 13, ribs 13*s* (FIG. 7) formed on the joint interface of the toner frame 12 are welded, thereby interconnecting the frames 12, 13.

By the way, when the ultrasonic waves are applied to the frames, the frames 12, 13 are apt to deform in their widthwise directions (shown by the arrows J in FIG. 29). However, in the illustrated embodiment, since longitudinal ribs 13*t* are formed on the developing frame 13 as shown in FIG. 11 and the blade attachment member 10*j* made of a metal plate is attached to the developing frame, the developing frame has the sufficient strength to resist the deformation thereof. Furthermore, since the toner frame 12 has no reinforcement rib, the toner frame has poor strength and is generally apt to deform. However, in the illustrated embodiment, as shown in FIGS. 7 and 11, flanges 12*g* are formed on the toner frame 12 at both lengthwise edges (upper and lower ends along lengthwise direction of opening 12*e*) thereof. A distance between the flanges 12*g* is substantially equal to the widthwise length L13 of the interface 13*h* of the developing frame 13, so that the interface 13*h* of the developing frame 13 can be fitted between the flanges 12*g*.

Thus, when the frames 12, 13 are joined together by the ultrasonic welding, the interface 13*h* of the developing frame 13 is fitted between the flanges 12*g* of the toner frame 12 and the positioning bosses 13*i* of the developing frame 13 are fitted into the fitting holes 12*c* of the toner frame 12. Therefore, the toner frame 12 is hard to deform by the vibration generated during the ultrasonic welding operation, thereby preventing the deviation between the frames 12, 13. That is to say, since the interface 13*h* of the developing frame is fitted between the flanges 12*g* formed on the toner frame 12 along their upper and lower edges, even if the up-and-down vibration is applied to the widthwise direction of the toner frame 12, the movement of the toner frame 12 is regulated by the developing frame 13, thus preventing the formation of the toner frame and the deviation between the frames 12, 13.

Further, when the frames 12, 13 are welded together, in the illustrated embodiment, since all of the frames are formed from the same material (polystyrene resin), the welding and bonding strength between the frames 12, 13 is increased extremely. Incidentally, since the developing frame 13 is not welded to the cleaning frame 14, from the view point of the improvement of the welding and bonding strength, it is not necessary to make the cleaning frame 14 by the material same as the material of the toner frame 12 and the developing frame 13.

Further, in the illustrated embodiment, as mentioned above, while an example that the positioning bosses 13*i* of the developing frame 13 are disposed only at one lengthwise edge of the developing frame was explained, such positioning bosses 13*i* may be formed on both lengthwise edges of the developing frame 13. If done so, it is possible to prevent the deformation of the toner frame 12 and the developing frame 13 more positively during the welding operation and to prevent the deviation between the frames 12, 13 more positively.

Figure 31:
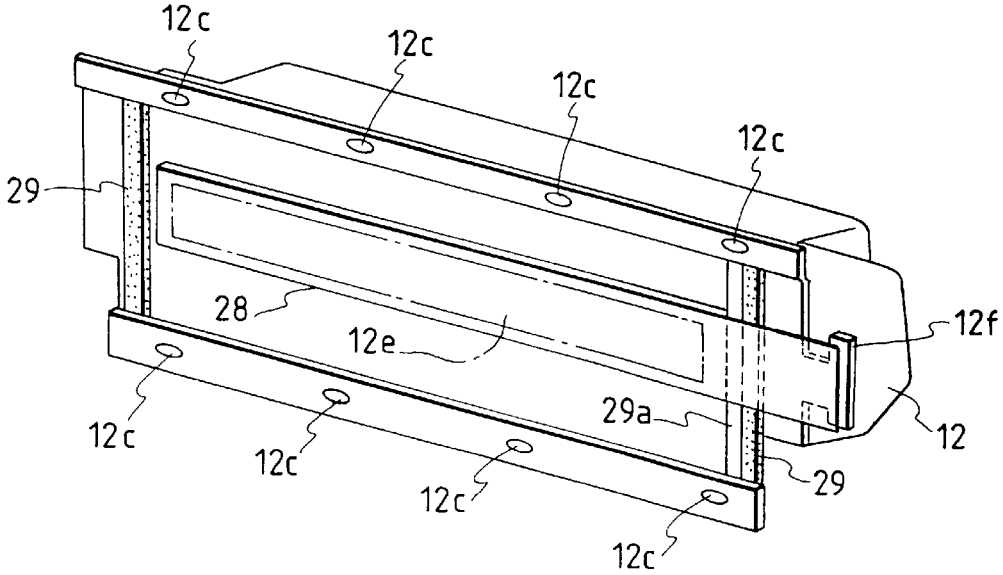
FIG. 31 is a perspective view showing a plurality of positioning bosses and fitting holes formed on and in the toner frame and the developing frame in a longitudinal direction thereof.

Further, as shown in FIG. 31, when a plurality of positioning bosses (not seen) of the developing frame and the fitting holes 12*c* (into which the bosses are fitted) of the toner frame 12 are arranged side by side in the longitudinal directions of the frames, the deformation of the frames and the deviation between the frames can be prevented more positively. If done so, the flanges 12*g* arranged on both widthwise edges of the toner frame 12 as mentioned above can be omitted.

Figure 32A:
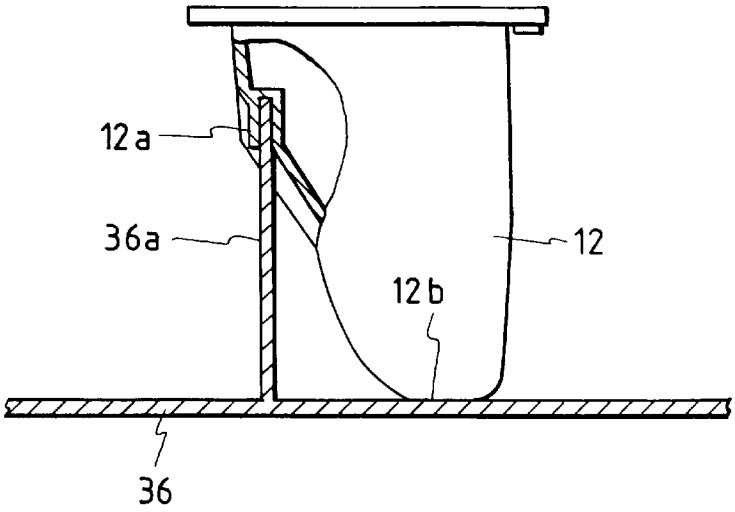
FIG. 32A is a view showing a condition that the toner developing frame is rested on an assembling tray.

(Construction for Facilitating Assembling of Process Cartridge):

In assembling the process cartridge B, the toner feed member 10*b* is mounted on the toner frame 12, and the opening 12*e* of the toner reservoir 10*a* containing the toner is closed by the cover film 28, and the antenna line 27 is attached. Thereafter, the developing frame 13 is welded to the toner frame. Then, the developing sleeve 10*d* and the like are assembled to the developing frame 13. In this case, the toner developing frame C comprising the integral developing frame 13 and toner frame 12 is securely rested on the assembling tray, and the various parts are assembled to the frame C (refer to FIG. 33). In the illustrated embodiment, as shown in FIG. 32A, a fitting hole 12*a* is formed in the toner frame 12 at a predetermined position, and a bottom 12*b* of the toner frame 12 is made flat. Thus, by inserting a member 36*a* formed on the assembling tray 36 into the fitting hole 12*a*, the toner frame 12 can easily be fixed, thereby facilitating the assembling of the parts such as the developing sleeve 10*d*, developing blade 10*e* and the like, which results in the improvement of the assembling operability.

Figure 32B:
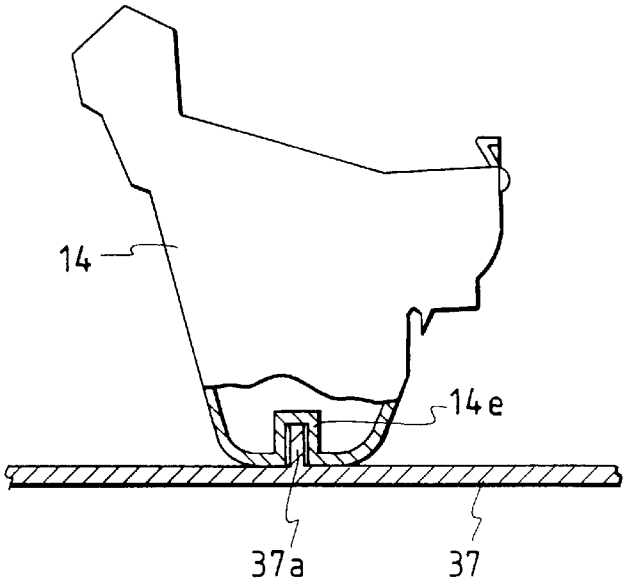
FIG. 32B is a view showing a condition that the cleaning frame is rested on an assembling tray.

Similarly, the parts such as the cleaning blade 11*a* and the like are assembled to the cleaning frame 14. In the illustrated embodiment, as shown in FIG. 32B, a bottom of the cleaning frame 14 is made flat, and a fitting hole 14*e* is formed in the bottom of the cleaning frame. Accordingly, when the parts such as the blade 11*a* and the like are assembled to the cleaning frame 14, by inserting a fitting projection 37*a* formed on the assembling tray 37 into the fitting hole 14*e*, the cleaning frame 14 can easily be fixed, thereby facilitating the assembling of the parts such as the cleaning blade 11*a* and the like, which results in the improvement of the assembling operability.

Figure 33:
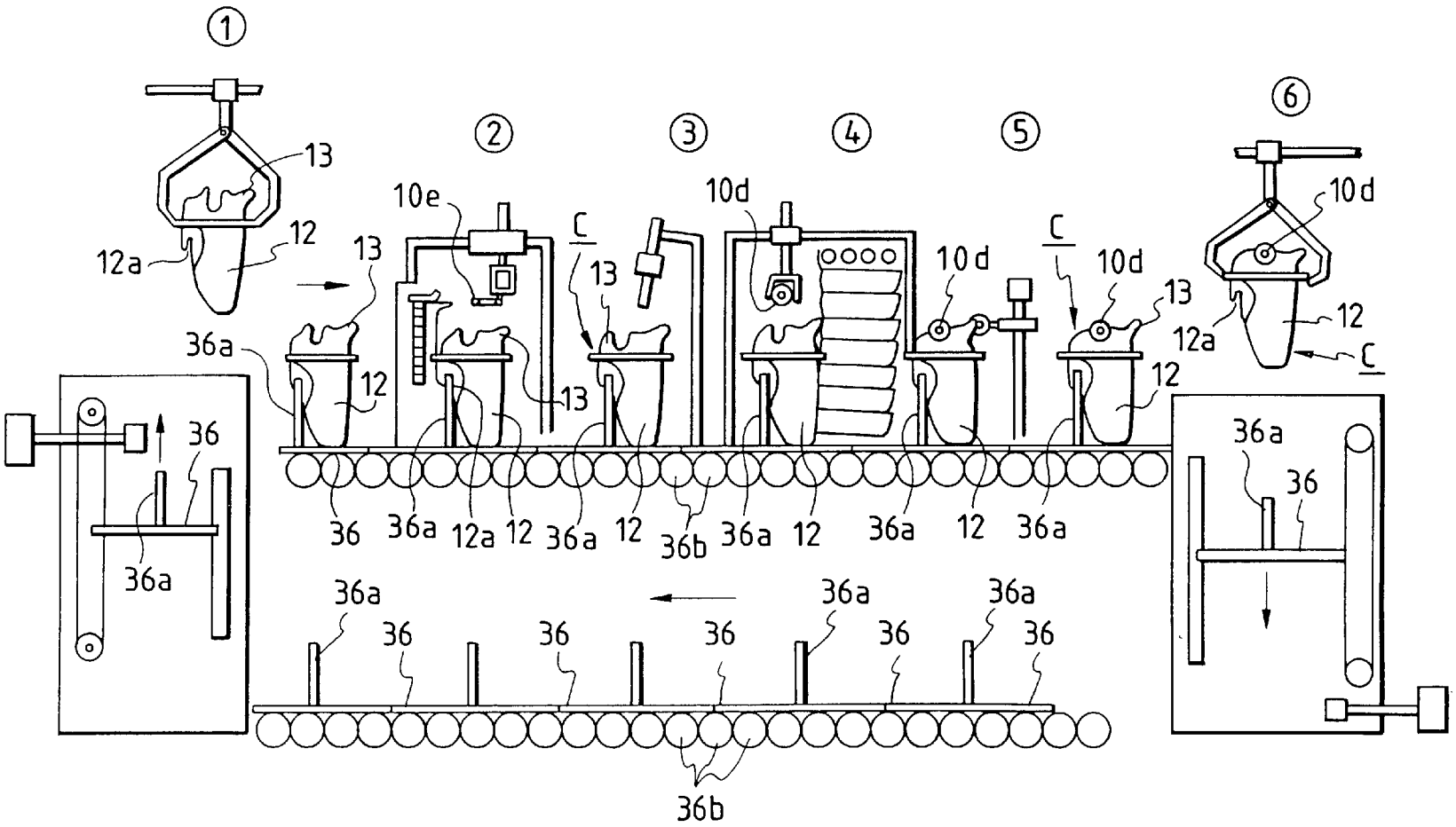
FIG. 33 is a view showing assembling steps through which the toner developing frame is assembled by an automatic machine.

Now, the automatic assembling will be explained with reference to the accompanying drawings. First of all, regarding the assembling of the toner developing frame C, as shown in FIG. 33, with respect to the assembling tray 36 shifting in a direction shown by the arrow via conveyor rollers 36*b*, at a step ① the fitting hole 12*a* of the toner frame 12 is fitted onto the projection 36*a* of the assembling tray 36, at a step ② the developing blade 10*e* is mounted, and at a step ③ the developing blade 10*e* is secured by screws. Then, at a step ④ the developing sleeve 10*d* is assembled, at a step ⑤ the developing sleeve is fixed, and at a step ⑥ the toner developing frame C is picked up to bring it to a next step. Further, after the toner developing frame C is picked up, the assembling tray 36 is returned through a lower auxiliary line, and the step ① is repeated again.

As mentioned above, by providing the fitting portion (for fitting into the assembling tray 36) in the toner frame 12, it is possible to omit a clamping step for clamping the toner frame, thereby facilitating the assembling of the toner frame 12.

Figure 34:
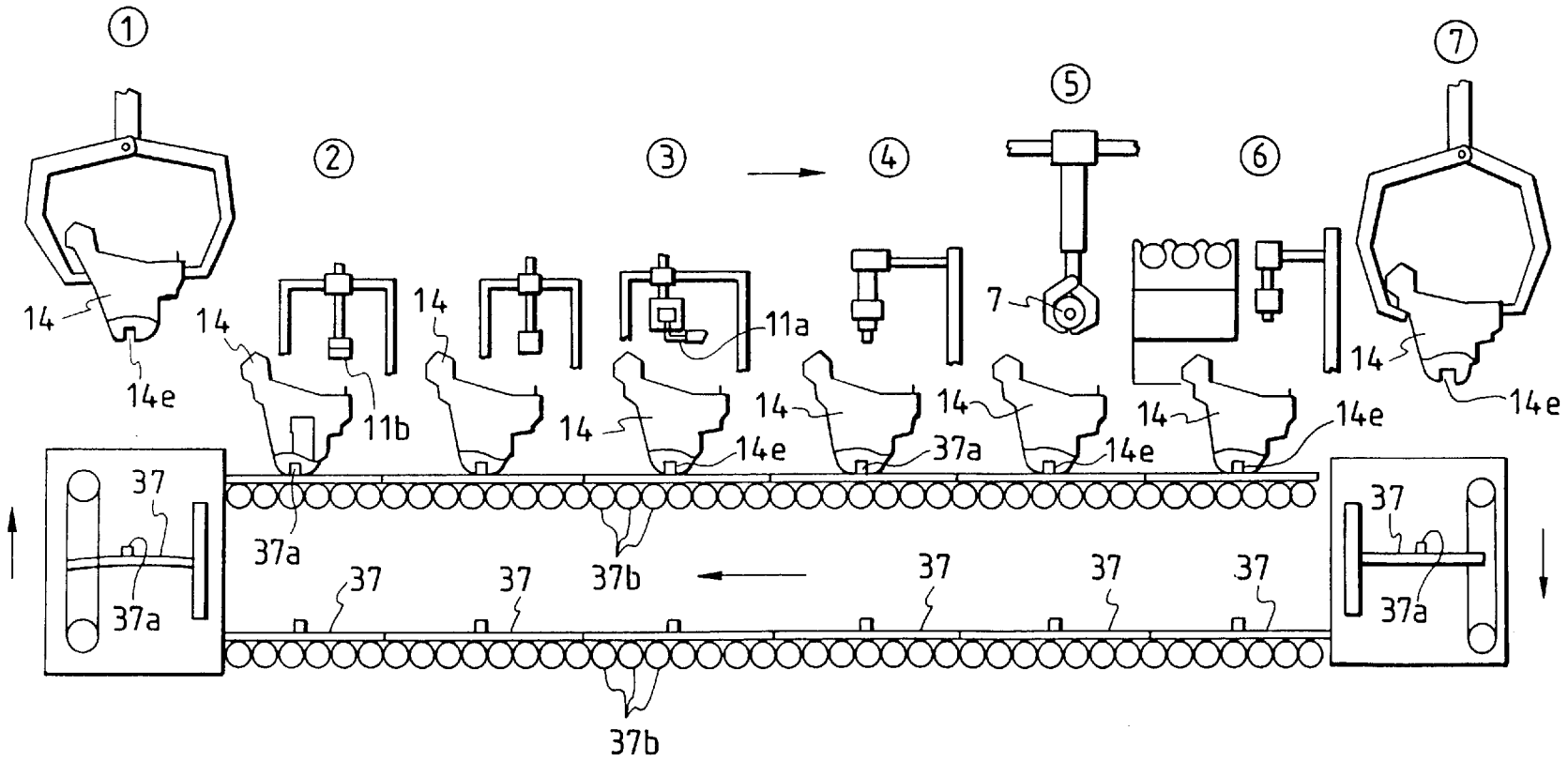
FIG. 34 is a view showing assembling steps through which the cleaning frame is assembled by an automatic machine.

Next, regarding the assembling of the cleaning frame 14, as shown in FIG. 34, with respect to the assembling tray 37 shifting in a direction shown by the arrow via conveyor rollers 37*b*, at a step ① the fitting hole 14*e* of the cleaning frame 14 is fitted onto the projection 37*a* of the assembling tray 37, at a step ② the dip sheet 11*a* is adhered, at a step ③ cleaning blade 11*a* is mounted, and at a step ④ cleaning blade 11*a* is secured by screws. Further, at a step ⑤ the photosensitive drum 7 is mounted, and at a step ⑥ the photosensitive drum is fixed. And, at a step ⑦ the assembled cleaning frame 14 is picked up to bright it to a next step. Further, after the cleaning frame 14 is picked Up, the assembling tray 37 is returned through a lower auxiliary line, and the step ① is repeated again.

Accordingly, similar to the toner developing frame C, by providing the fitting portion (for fitting into the assembling tray 37) in the cleaning frame 14, it is possible to omit a clamping step for clamping the cleaning frame 14, thereby facilitating the assembling of the cleaning frame 14. Incidentally, as shown in FIG. 4, the cleaning frame 14 is provided with locking recessed portions 140 which are gripped by the assembling machine to shift the cleaning frame between the stations during the automatic assembling operation.

Incidentally, the assembling of the toner frame 12 and the cleaning frame 14 can be effected by any means other than the automatic assembling machines. For example, in simple assembling lines where the frames are assembled manually by using simple tools, by utilizing the assembling trays 36, 37, the working efficiency can be improved.

After the various parts are assembled to the toner developing frame C comprising the integral toner frame 12 and developing frame 13 and to the cleaning frame 14, the toner developing frame C is joined to the cleaning frame 14. In this regard, the frames are often rested on a table. In this case, before the toner developing frame C is joined to the cleaning frame 14, the photosensitive drum 7 assembled to the cleaning frame 14 and the developing sleeve 10*d* assembled to the developing frame 13 are exposed outwardly. Thus, it is feared that such elements are contacted with the table to damage such elements. Particularly, the photosensitive drum 7 is a most important element for performing the image forming operation, and, even if the surface of the drum is damaged more or less, the image will be distorted or deteriorated, thereby worsening the image quality. Therefore, in the assembling operation and the like, when the frame to which the photosensitive drum 7 is assembled or the frame to which the developing sleeve 10*d* is assembled is rested on the table, the operator must take care not to contact the photosensitive drum 7 or the developing sleeve 10*d* with the table.

Figure 35:
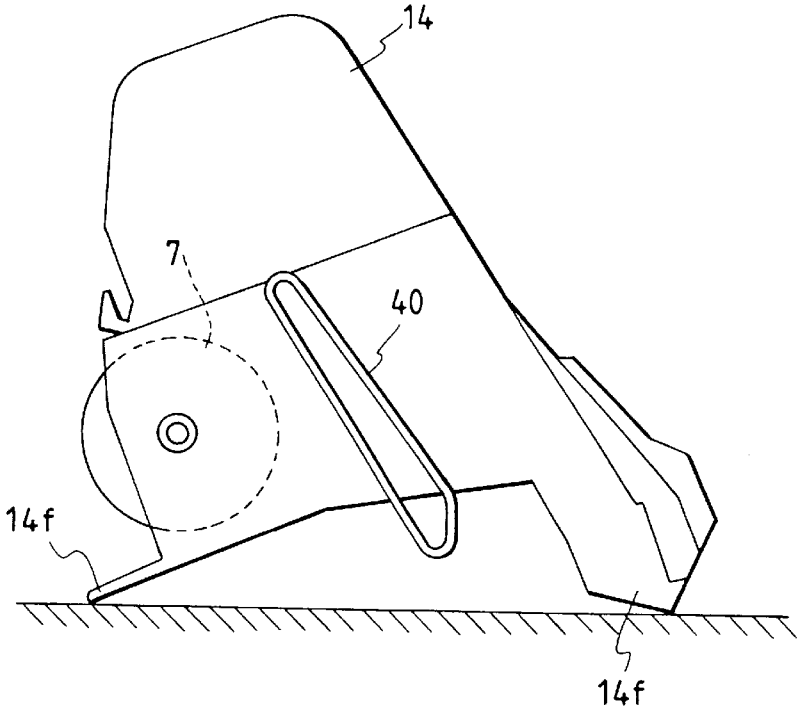
FIGS. 35 and 36 are views showing a construction or arrangement wherein the photosensitive drum is not contacted with a table when the cleaning frame is rested on the table.
Figure 36:
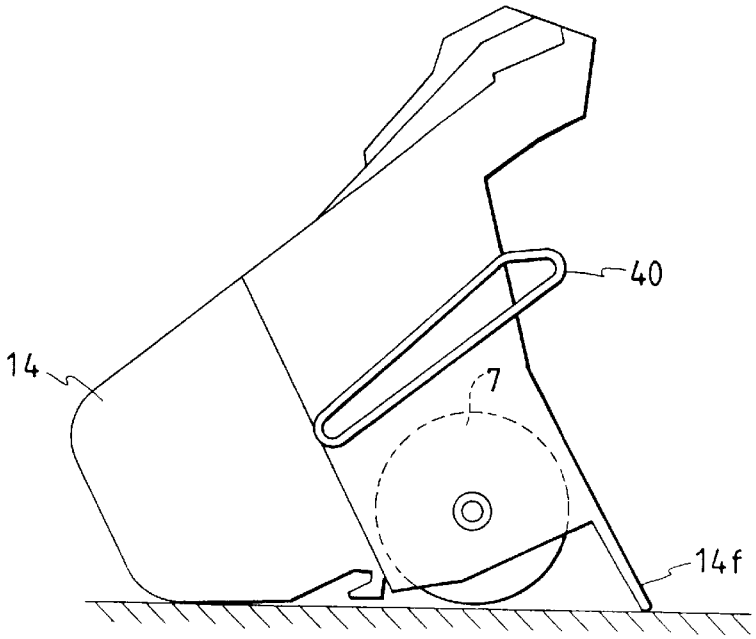

In the illustrated embodiment, as shown in FIG. 35, protruded portions 14*f* are formed on edges of an open end of the cleaning frame 14 to which the photosensitive drum 7 is assembled. The photosensitive drum 7 is arranged so that the photosensitive drum is positioned inwardly (toward the cleaning frame 14) from a line connecting between tip ends of the protruded portions 14*f*. With this arrangement, as shown in FIGS. 35 and 36, when the cleaning frame 14 is rested on the table, the protruded portions 14*f* are contacted with the table and the photosensitive drum 7 is not contacted with the table, thereby preventing the damage of the surface of the photosensitive drum 7.

Figure 37:
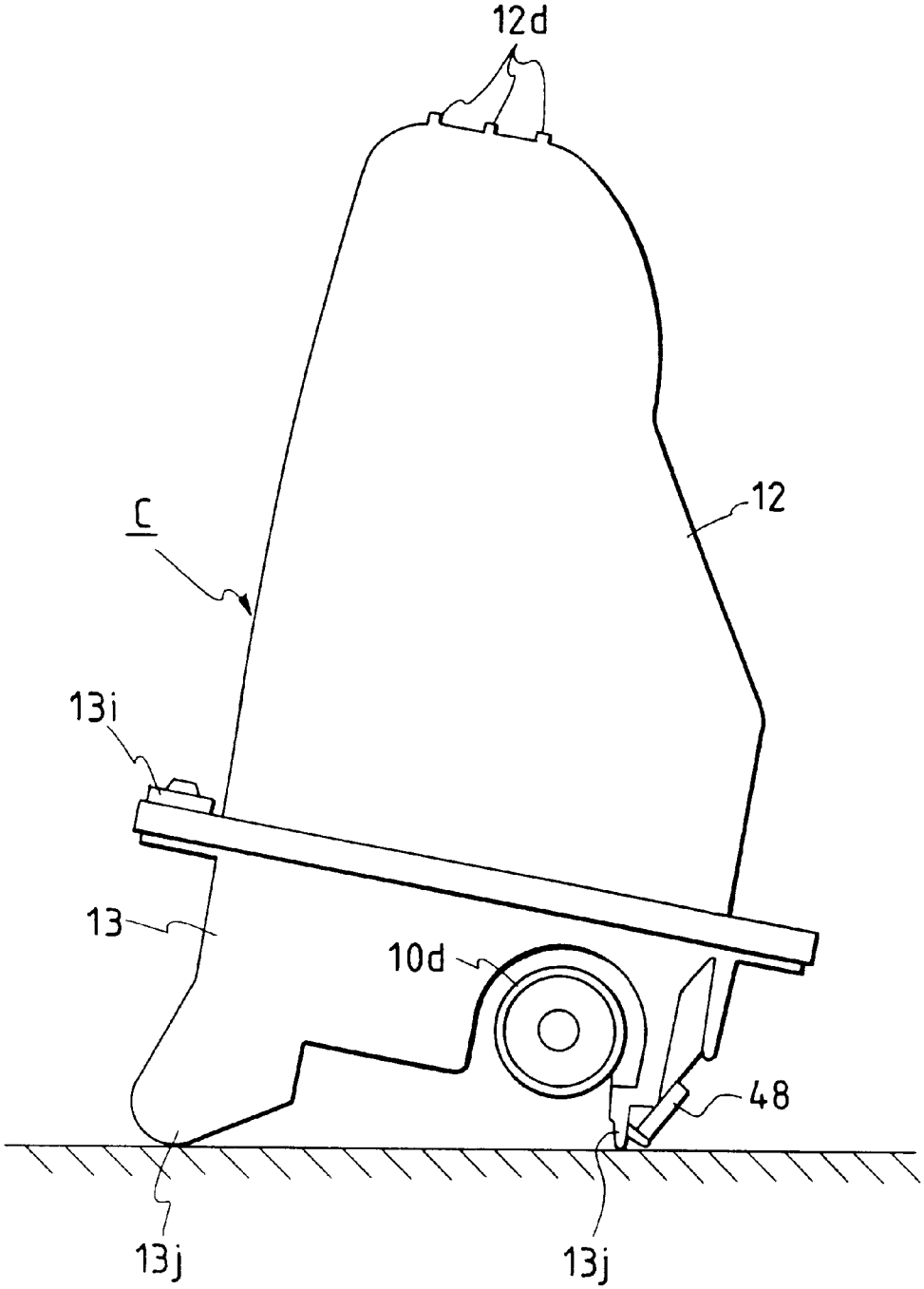
FIG. 37 is a view showing a construction wherein a developing sleeve is not contacted with a table when the toner developing frame is rested on a table.

Similarly, as shown in FIG. 37, protruded portions 13*j* are formed on edges of an open end of the toner developing frame C to which the developing sleeve 10*d* is assembled. And, the developing sleeve 10*d* is arranged so that the developing sleeve is positioned inwardly (toward the developing frame 13) from a line connecting between tip ends of the protruded portions 13*j*. With this arrangement, when the developing frame 13 integrally joined to the toner frame 12 is rested on the table, the protruded portions 13*j* are contacted with the table and the developing sleeve 10*d* is not contacted with the table.

In this way, since the developing sleeve 10*d* or the photosensitive drum 7 is not contacted with the table even when the developing frame 13 or the cleaning frame 14 is rested on the table, the inadvertent damage of the photosensitive drum 7 and the like can be prevented, thus improving the assembling operability. After the various parts are assembled to the toner frame 12, developing frame 13 and cleaning frame 14 in this way, the developing frame 13 is joined to the cleaning frame 14 to assemble the process cartridge B. The connection between the frames 13, 14 is effected by connection members 38 shown in FIG. 38. Next, the connection between the frames 13, 14 will be explained.

Figure 38:
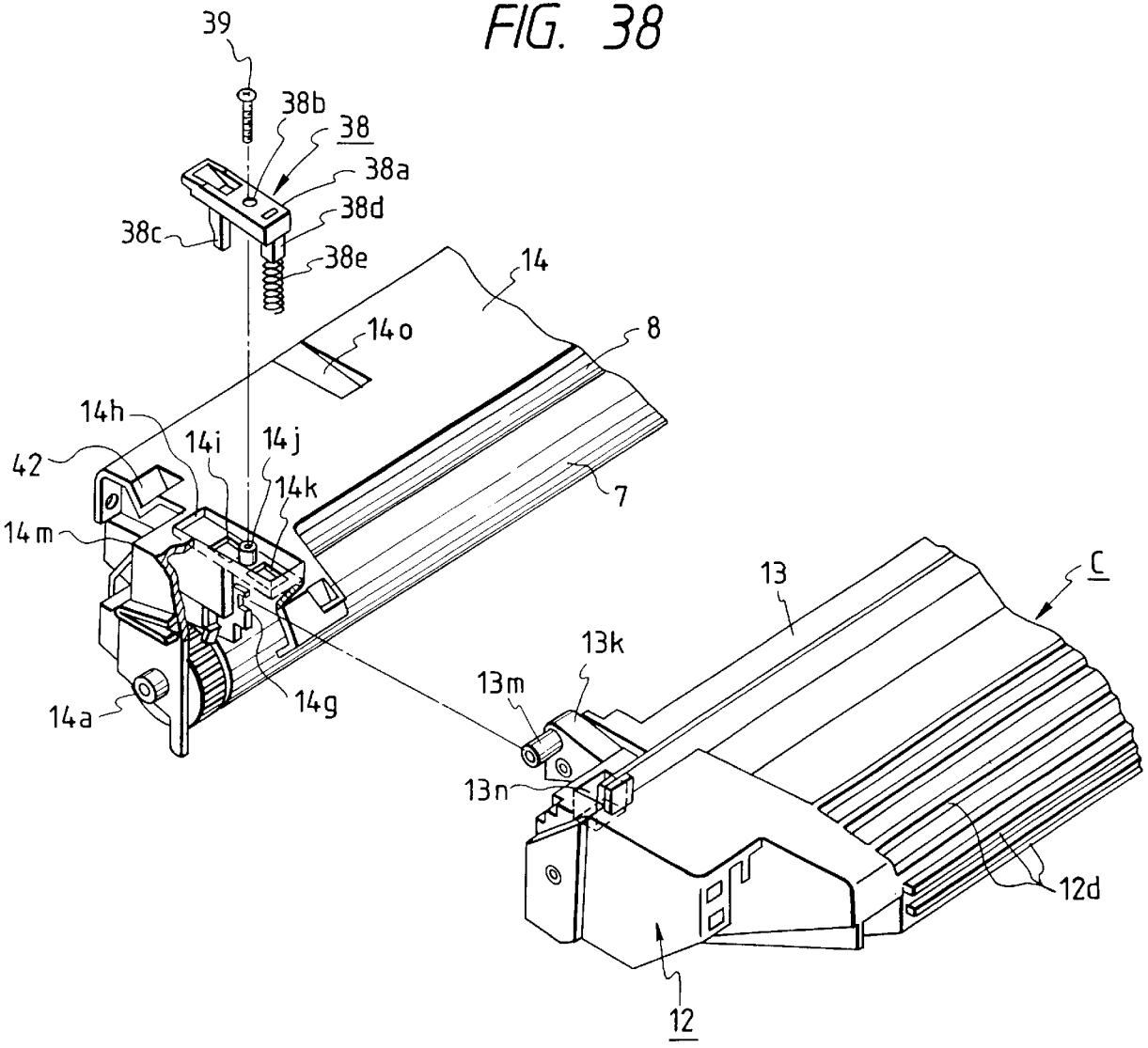
FIG. 38 is an exploded partial perspective view showing a method for connecting the toner developing frame and the cleaning frame by connecting members.

In FIG. 38, the connection member 38 comprises a base member 38*a* having a threaded hole 38*b* through which a screw 39 is threaded, a vertical portion 38*c*, and a spring attachment portion 38*d*, which portions 38*c*, 38*d* are disposed on both sides of the threaded hole 38*b*. The vertical portion 38*c* protrudes downwardly from the base member 38*a* to prevent a connection projection (described later) of the developing frame 13 from falling out. The spring attachment portion 38*d* is disposed in parallel with the vertical portion 38*c* and is provided at its free end portion with a spring 38*e* which is protruded downwardly more than the vertical portion 38*c*. Arm portions 13*k* are provided on both longitudinal ends of the developing frame 13, and a connection projection 13*m* is protruded laterally from each arm portion 13*k*. Further, a spring receiving recessed portion 13*n* is formed on an upper surface of each arm portion 13*k*.

On the other hand, connection recessed portions 14*g* into which the connection projections 13*m* are fitted are provided in the cleaning frame 14. And, a fastening portion 14*h* is formed on each recessed portion 14*g*. The fastening portion 14*h* has a fitting hole 14*i* into which the vertical portion 38*c* of the connection member 38 is fitted, a female threaded portion 14*j* into which the screw 39 is threaded, and a through hole 14*k* through which the spring 38*e* extends.

Figure 39A:
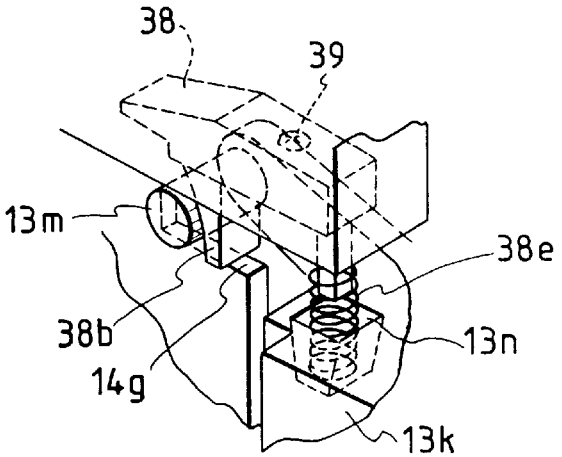
FIG. 39A is a perspective view showing a condition that the connecting members are attached.
Figure 39B:
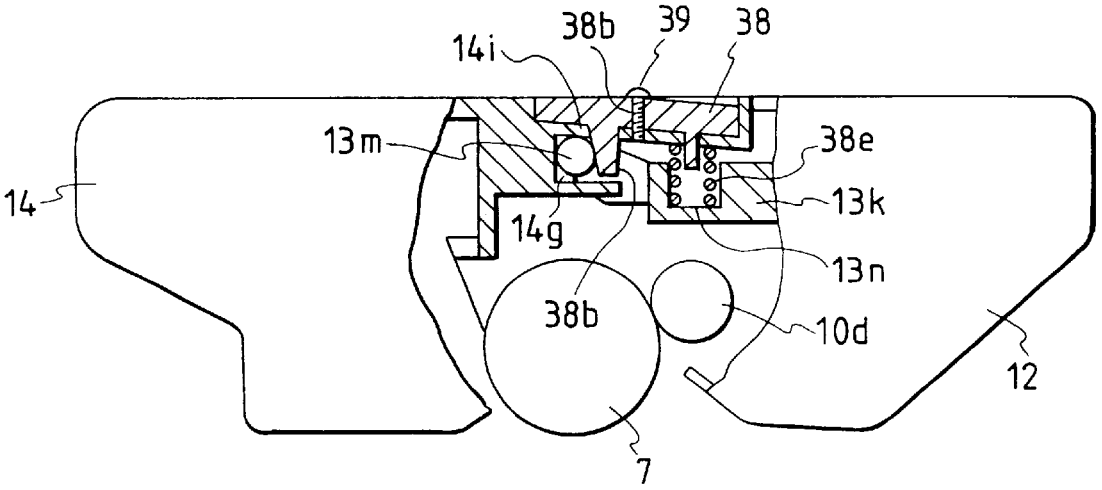
FIG. 39B is a sectional view showing a condition that the connecting members are attached.

To join the toner developing frame C and the cleaning frame 14, as shown in FIGS. 39A and 39B, the connection projections 13*m* of the developing frame 13 are deeply fitted into the corresponding connection recessed portions 14*g* of the cleaning frame 14, and then the connection members 38 are fastened to the fastening portions 14*h*. That is to say, each vertical portion 38*c* of the connection member 38 is fitted into the hole 14*i*, and the spring 38*e* is passed through the through hole 14*k* and is compressed against the spring receiving recessed portion 13*n* of the developing frame 13. In this condition, the screw 39 is threaded into the threaded hole 38*b* and is fastened to the female threaded portion 14*j*.

In this way, the toner developing frame C and the cleaning frame 14 are connected to each other for relative pivotal movement around the connection projections 13*m*, thereby completing the assembling of the process cartridge B. In a condition that the frames 13, 14 are interconnected, the ring members 10*f* are abutted against the peripheral surface of the photosensitive drum 7, thereby determining the positions of the photosensitive drum 7 and the developing sleeve 10*d*. Further, by spring forces of the compressed springs 38*e*, the developing sleeve 10*d* is biased toward the photosensitive drum 7 (Incidentally, in the illustrated embodiment, the spring force of the spring 38*e* is selected to about 2 kg to urge the developing sleeve 10*d* with a force of about 1 kg). Further, when the toner developing frame C is joined to the cleaning frame 14, the helical gear 7*c* provided at the end of the photosensitive drum 7 is meshed with the gear 10*g* provided at the end of the developing sleeve lad.

In the joint construction between the toner developing frame C and the cleaning frame 14 according to the illustrated embodiment, since the toner developing frame C can be mounted in a direction of the connection recessed portions 14*g*, the connection projections 13*m* can be extended outwardly (these may be extended inwardly). Thus, the frames 13, 14 can be positioned with respect to the longitudinal direction (thrust direction), thereby eliminating the need for providing thrust stoppers.

Further, since the connection members 38 are inserted from the above and are fastened, the toner developing frame C can be pressurized at the same time when the connection members 38 are fastened. In this respect, conventionally, after the toner developing frame was joined to the cleaning frame, it was required for hooking a tension spring to the frames to urge the frames against each other, with the result that a space for arranging the tension spring was required and the spring hooking operation was troublesome. However, according to the illustrated embodiment, it is possible to eliminate the provision of such tension spring and save the installation space for the tension spring. Further, when the frames are disconnected from each other, by loosening the screws 39, the compression forces of the compressed springs 38*e* are released, thereby permitting the very easy disassembling of the frames because of no thrust stopper.

(Cartridge Mounting Construction):

Next, the construction for mounting the process cartridge B to the image forming apparatus A will be explained.

Figure 40:
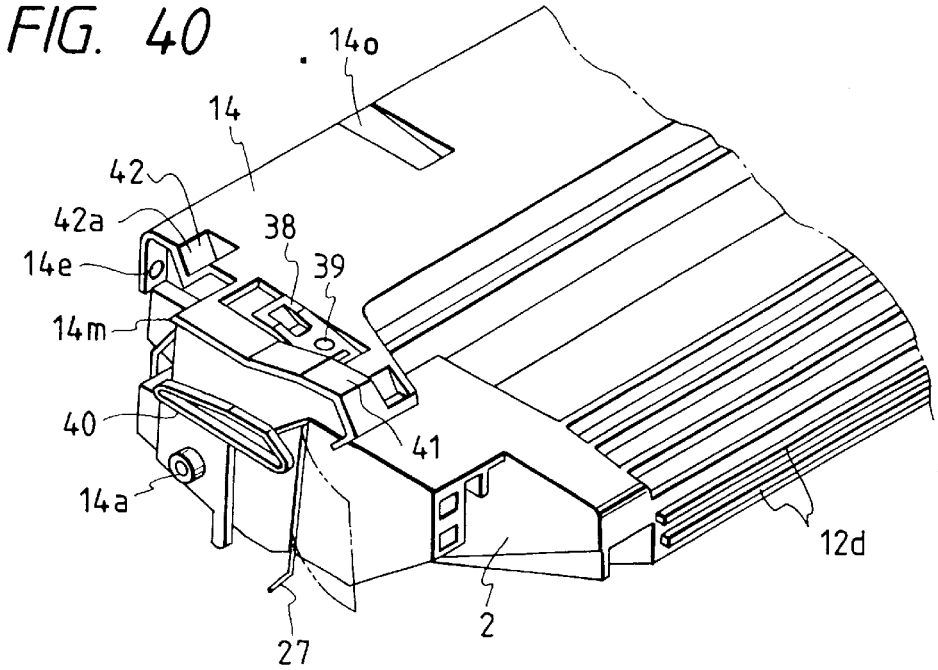
FIG. 40 is a partial perspective view showing a left end surface of a process cartridge.

As shown in FIGS. 5 and 6 and as mentioned above, the left guide member 17 having the first and second guide portions 17*a*, 17*b* and the right guide member 18 having the first and second guide-portions 18*a*, 18*b* are formed on the frame 15 of the image forming apparatus. In correspondence to these guide members, as shown in FIG. 4 (showing the right side surface of the process cartridge B) and FIG. 40 (showing the left side surface of the cartridge), the bearing portion 14*a* and the shaft 21 (which are guided along the first guide portions 17*a*, 18*a*) are protruded from the left and right side surfaces of the cleaning frame 14 of the process cartridge B substantially in left/right symmetry. Further, protruded ribs 40 which are to be guided along the second guide portions 17*b*, 18*b* are arranged above the bearing portion 14*a* and the shaft 21 in left/right symmetry.

Further, pressure surfaces 41 are formed on the upper surface of the cleaning frame 14 at both longitudinal ends thereof, which pressure surfaces are pressurized by pressure members 19 attached to the frame 15 of the image forming apparatus. Furthermore, there are provided positioning recesses 42 for receiving the abutment members 20 and for positioning the abutment members. In addition, an auxiliary rib 43 is protruded from the right side surface of the cleaning frame 14 above the protruded rib 40, as shown in FIG. 4. Further, there is provided a link portion 35*a* for opening and closing the drum shutter 35. The link portion 35*a* is pivoted in response to the mounting and dismounting movement of the process cartridge B, thereby opening and closing the drum shutter 35 connected to the link portion. Incidentally, the opening and closing of the drum shutter 35 will be described later fully.

Now, the mounting and dismounting of the process cartridge B with respect to the image forming apparatus A will be explained with reference to FIGS. 41 to 44. Incidentally, although the left and right sides of the process cartridge B are similarly guided by the left and right guide members 17, 18, to clarify and simplify the explanation, only the right guide member 18 will be explained.

Figure 41:
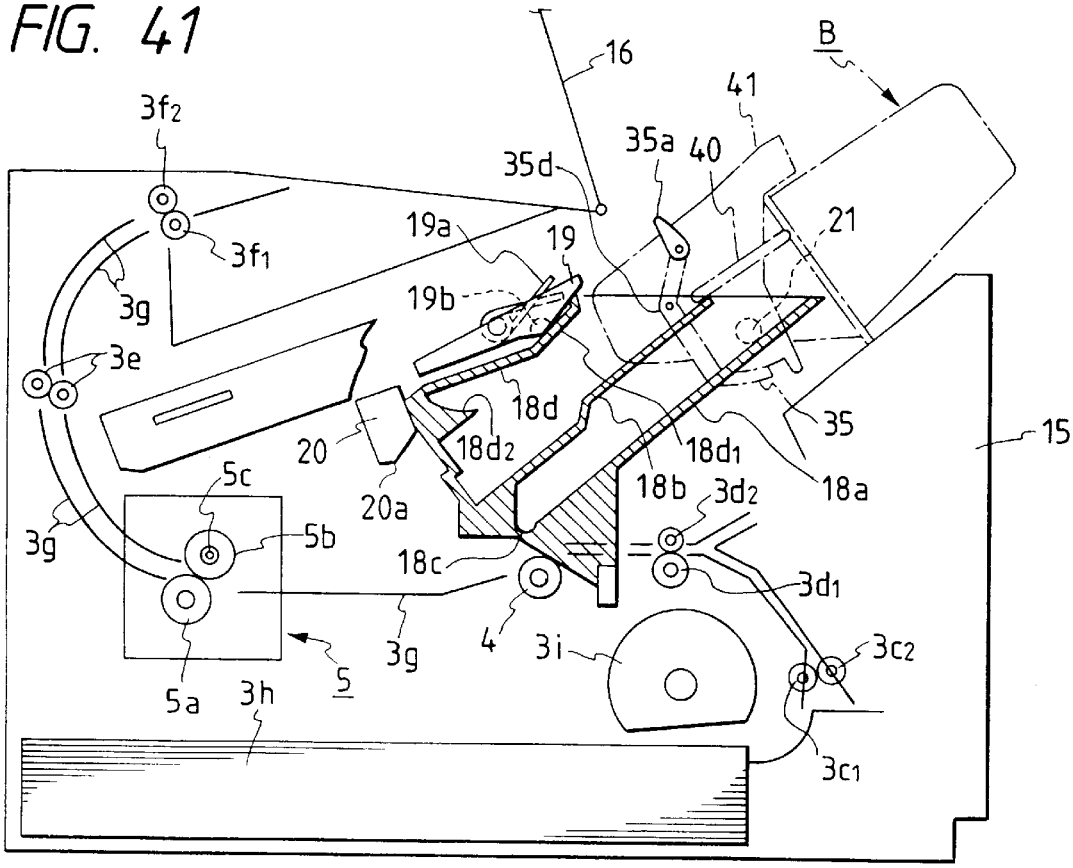
FIG. 41 is an elevational sectional view showing a condition that the process cartridge is mounted to an image forming apparatus.
Figure 42:
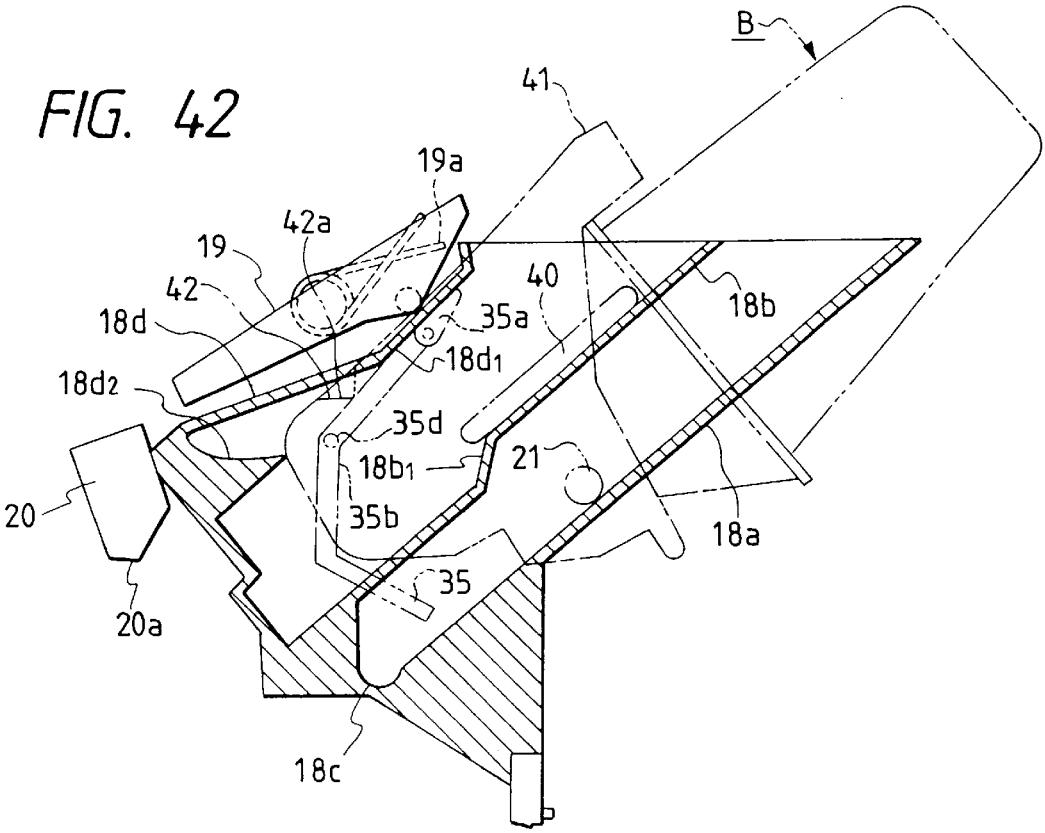
FIGS. 42 to 45 are enlarged partial sectional views showing a condition that the process cartridge is mounted to the image forming apparatus.

First of all, as shown in FIG. 41, after the opening/closing cover 16 of the frame 15 of the image forming apparatus is opened, the shaft 21 of the process cartridge B is rested on the first guide portion 18*a*, and the protruded rib 40 is rested on the second guide portion 18*b*. Then, as shown in FIG. 42, the shaft 21 and the protruded rib 40 are slid along the guide portions 18*b*, 18*a* to insert the process cartridge into the frame 15 of the apparatus. As a result, the pressure surfaces 41 of the process cartridge B are pressurized by the pressure members 10 of the frame 15, whereby the process cartridge B is inserted into the frame while being urged against the second guide portion 18*b*.

Figure 43:
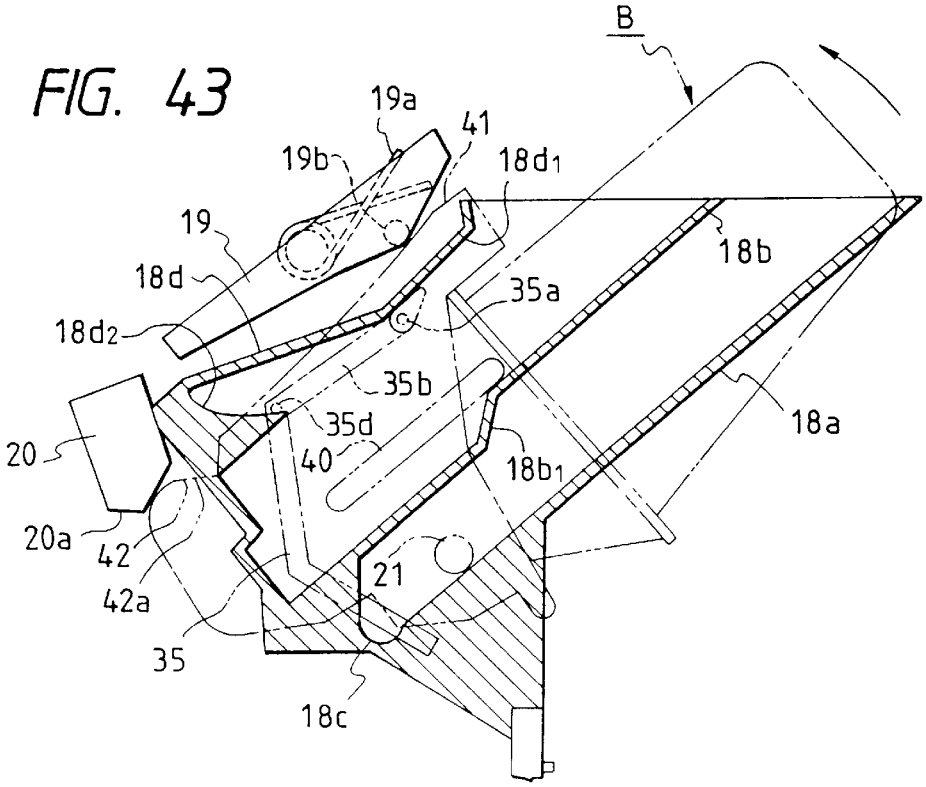
Figure 44:
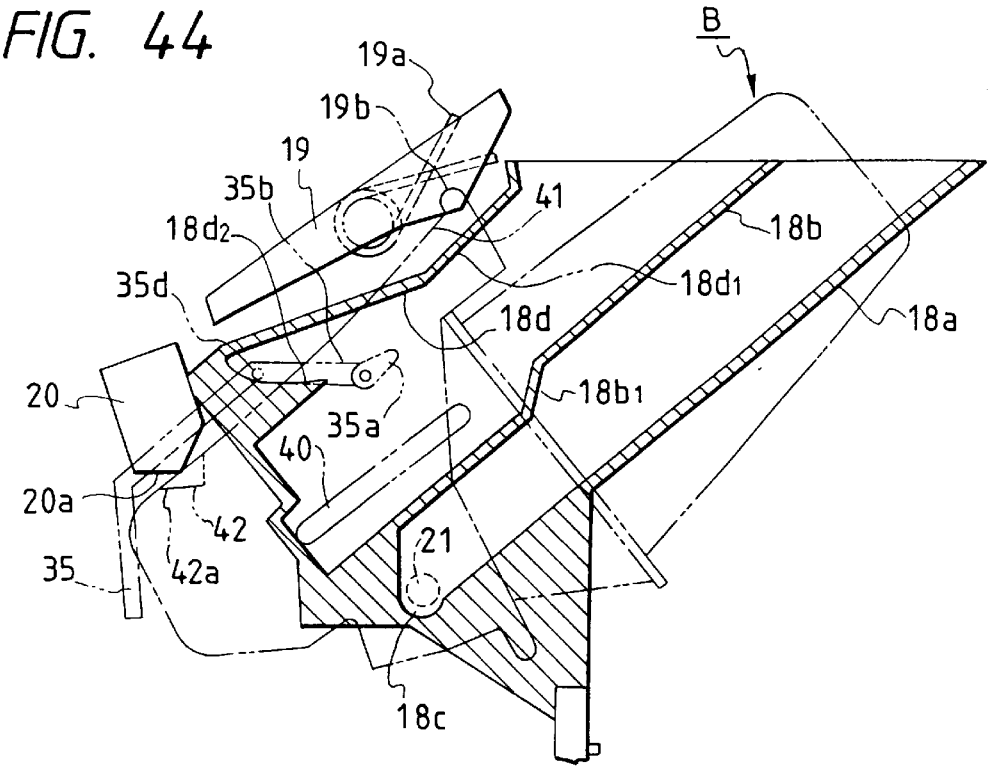
Figure 45:
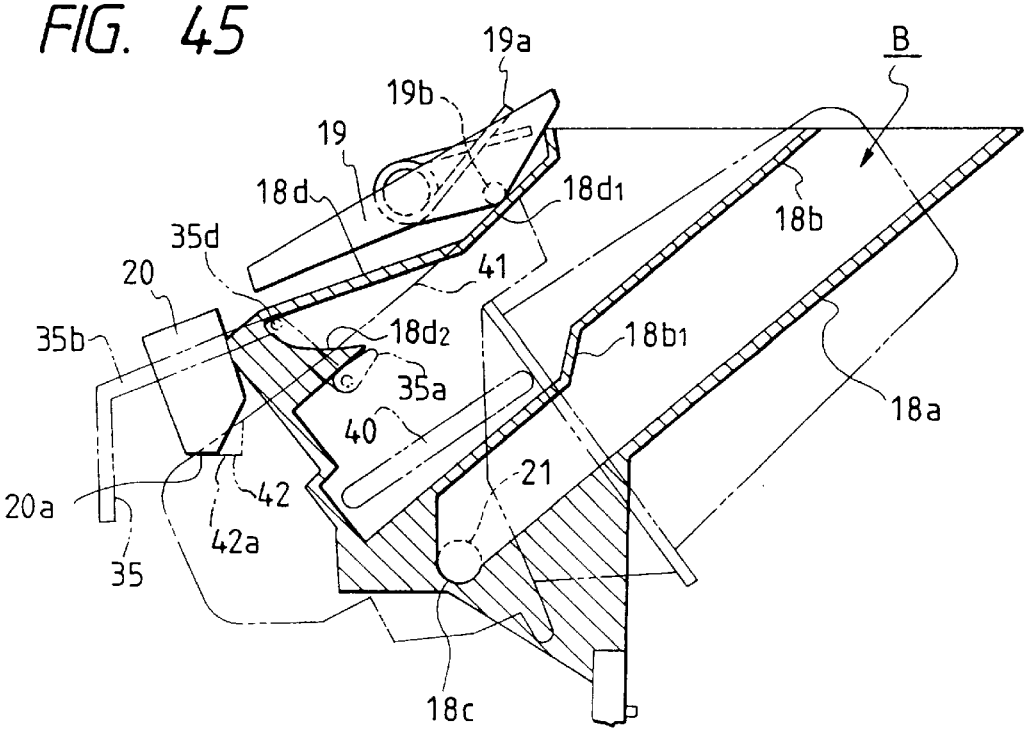

Then, as shown in FIG. 43, when the protruded rib 40 exceeds the second guide portion 18*b*, the process cartridge B is rotated slightly in an anti-clockwise direction by the urging forces of the pressure members 19, thereby supporting the shaft 21 on the first guide portion 18*a*. When the process cartridge B is further inserted, as shown in FIG. 44, the process cartridge B is further rotated in the anti-clockwise direction, with the result that the abutment members 20 of the frame 15 are engaged by the positioning recesses 42 of the process cartridge B. Thereafter, when the operator releases the process cartridge, as shown in FIG. 45, the shaft 21 of the process cartridge B is dropped into the bearing portion 18*c* by its own weight. In this case, the abutment members 20 are completely engaged by the positioning recesses 42, with the result that the process cartridge B is mounted to the frame 15 of the image forming apparatus while being pressurized by the pressure members 19. Further, in this case, the helical gear 7*c* of the photosensitive drum 7 is meshed with the drive gear (refer to FIG. 6) in the frame 15, thereby permitting the transmission of the driving force. Further, when the process cartridge B is mounted, the urging forces of the pressure members 19 against the process cartridge B are relieved by the lowering movement of the process cartridge B. Thus, the operator who has mounted the process cartridge B feels the "click" feeling to easily recognize the fact that the process cartridge B was positioned at the mounting position.

Incidentally, the abutment members 20 of the apparatus frame 15 and the positioning recesses 42 of the process cartridge B are so arranged that abutment surfaces 20*a*, 42*a* thereof are substantially in parallel with each other. Thus, the abutment members 20 may be assembled to the frame 15 in such a manner that the abutment surfaces 20*a* are disposed substantially horizontally. Therefore, the design of the abutment members 20 and the assembling of the abutment members to the frame 15 can be simplified or facilitated, with the result that the dimensional error is hard to occur. Accordingly, it is easy to mount the process cartridge B to the frame 15 of the image forming apparatus correctly.

Incidentally, a roller 19*b* is mounted on each pressure member 19, so that the sliding resistance is minimized by pressurizing the process cartridge by the rollers 19*b* when the process cartridge B is being shifted while pressurizing the pressure surfaces 41 by the pressure members 19. Further, in the illustrated embodiment, while the pressure surfaces 41 of the process cartridge B pressurized by the rollers 19*a* were formed as surface configuration, such process surfaces may be ribbed-shape to reduce the contacting area, thereby further reducing the sliding resistance.

Further, as apparent from the sectional view in FIG. 1 and the perspective view in FIG. 4, the upper portion of the process cartridge B is made substantially flat, and the flat upper surface of the process cartridge is substantially in parallel with the cartridge mounting direction. Thus, the cartridge mounting space in the frame 15 of the image forming apparatus can be minimized, and the space in the process cartridge B (for example, spaces for the toner reservoir and the waste toner reservoir) can be used efficiently.

Figure 46:
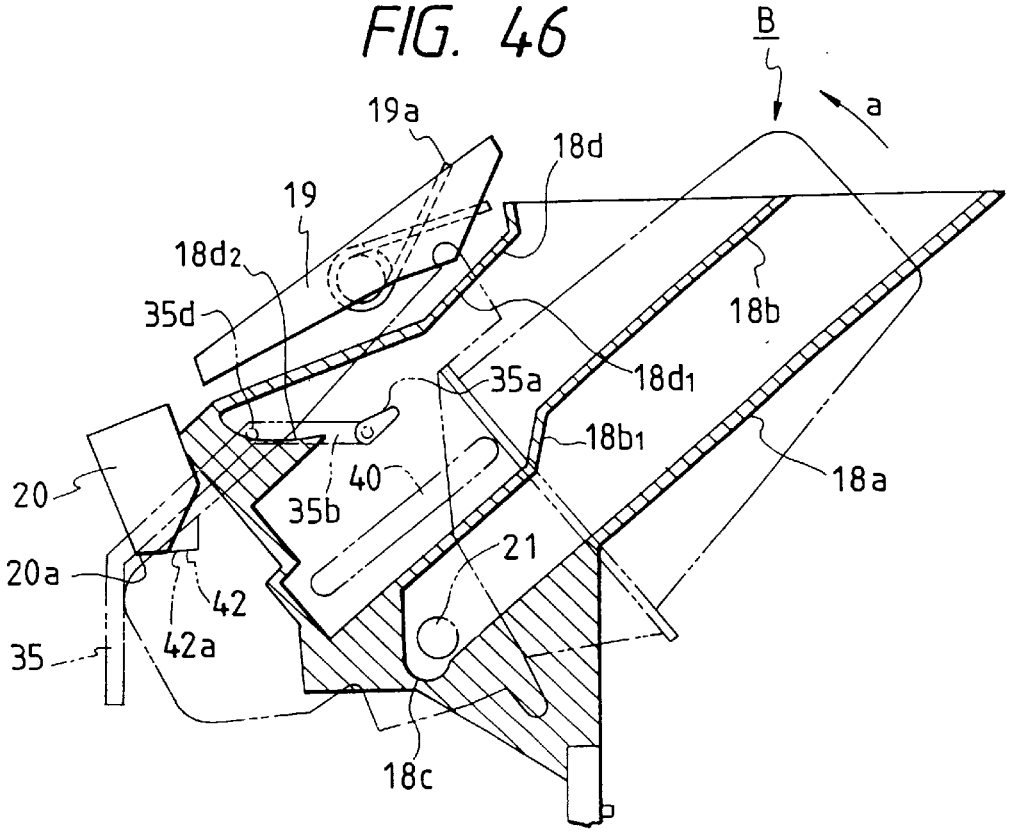
FIG. 46 is an enlarged partial sectional view showing a condition that the process cartridge is dismounted from the image forming apparatus.

On the other hand, when the process cartridge B is dismounted, as shown in FIG. 46, the process cartridge B is rotated in the anti-clockwise direction (shown by the arrow a) slightly, thereby permitting the riding of the protruded rib 40 over the stepped portion 18*b*1 of the second guide portion 18*b*, with the result that the process cartridge can be dismounted by drawing out the process cartridge as it is. Incidentally, when the process cartridge B is rotated in the anti-clockwise direction, if the cartridge is rotated excessively, the auxiliary rib 43 (refer to FIG. 4) is abutted against the shutter cam portion 18*d* (and, regarding the left guide member 17, the protruded rib 40 is abutted against the rocking movement regulating guide portion (refer to FIG. 5)), thereby regulating anti-clockwise rotation of the process cartridge. Further, when the process cartridge is mounted, the auxiliary rib 43 provided at the right side of the process cartridge is inserted between the second guide portion 18*b* and the shutter cam portion 18*d*, and the protruded rib 40 provided at the left side of the cartridge is inserted between the second guide portion 17*b* and the rocking movement regulating guide portion 17*d*. Thus, the moving paths when the process cartridge B is mounted and dismounted are further regulated, thereby mounting and dismounting the process cartridge B more smoothly.

(Drum Shutter opening/Closing Construction):

The drum shutter 35 is opened and closed in response to the mounting and dismounting movement of the process cartridge. Now, the opening/closing operation of the drum shutter will be explained.

As shown in FIG. 4, the drum shutter 35 has the arm portion 35*b* pivotally mounted around a shaft 35*c*, and the link portion 35*a* is pivotally mounted on the shaft 35*c* for movement together with the arm portion 35*b*. Thus, when the link portion 35*a* is pivoted, the arm portion 35*b* is also pivoted, thereby opening and closing the drum shutter 35. Further, a link boss 35*d* is protruded from the arm portion 35*b*. By engaging the link portion 35*a* and the link boss 35*d* by the shutter cam portion 18*d*, the drum shutter 35 is opened and closed. The opening and closing of the drum shutter will be explained in connection with the mounting of the process cartridge B to the image forming apparatus A with reference to FIGS. 41 to 45.

As shown in FIGS. 41 to 45, the shutter cam portion 18*d* provided on the right guide member 18 has a first cam portion 18*d*1 engaged by the link portion 35*a*, and a second cam portion 18*d*2 engaged by the link boss 35*d*. An inclined angle of the first cam portion 18*d*1 is substantially the same as that of the second guide portion 18*b* for guiding the protruded portion 40 of the process cartridge B, and an inclined angle of the second cam portion 18*d*2 is greater than that of the first cam portion 18*d*1.

As shown in FIG. 41, when the process cartridge B is inserted and is pushed, the link portion 35*a* is engaged by the first cam portion 18*d*1 of the shutter cam portion 18*d* as shown in FIG. 42, thereby rotating the link portion 35*a* around the shaft 35*c*. As a result, the arm portion 35*b* is rotated to open the drum shutter 35, however, in this case, the drum shutter is not completely opened but is in a so-called half open condition. When the cartridge B is further pushed, as shown in FIG. 43, the rotation of the arm portion 35*b* causes the disengagement between the link portion 35*a* and the first cam portion 18*d*1 and at the same time the engagement between link boss 35*d* and the second cam portion 18*d*2. And, when the mounting of the process cartridge B is completed as shown in FIG. 45, the drum shutter 35 is completely opened so that the recording medium 2 fed below the cartridge does not interfere with the drum shutter.

Incidentally, when the process cartridge B is drawn from the condition shown in FIG. 45 to dismount the process cartridge B from the image forming apparatus A, by a spring force of a torsion coil spring 35*e* locked to the arm portion 35*b*, the shutter cam portion 18*d* is engaged by the link boss 35*d* and then by the link portion 35*a* in an order opposite to the aforementioned order, thus closing the drum shutter 35.

The above-mentioned drum shutter 35 serves to protect the photosensitive drum 7. In the illustrated embodiment, other than the drum shutter 35, the laser shutter is provided in the image forming apparatus A. The laser shutter constitutes a laser light path blocking means to prevent the laser light emitted from the optical system 1 to the photosensitive drum 7 from leaking from the optical unit 1*a* (of the image forming apparatus) in an inoperative condition of the apparatus.

Figure 47:
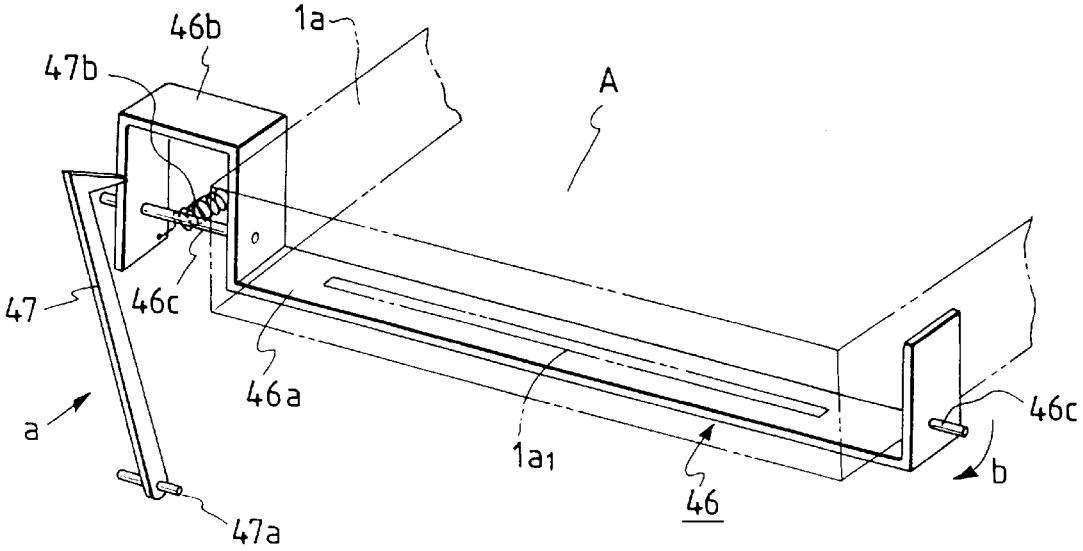
FIG. 47 is a perspective view showing a mechanism for opening and closing a laser shutter.

(Laser Light Path Blocking Means):

Next, the construction of the laser light path blocking means will be explained. As shown in FIG. 47, the optical unit 1*a* is provided with an opening 1*a*1 through which the laser light is illuminated onto the photosensitive drum 7, and the laser shutter 46 is formed from a metal plate bent to cover the opening 1*a*1. That is to say, the laser shutter 46 has a shutter portion 46*a* comprising the bent metal plate, and a link portion 46*b* disposed at the left of the shutter portion and integrally formed therewith. The laser shutter 46 is pivotally mounted on the frame 15 of the image forming apparatus via shafts 46*c*.

Further, in the vicinity of the left guide member 17 for guiding the process cartridge B, an arm member 47 is pivotally mounted around a shaft 47*a*. The arm member 47 has a free end engageable by the link portion 46*b* of the laser shutter 46 and is positioned to abut against the end of the process cartridge B when the cartridge B is mounted to the frame 15 of the apparatus.

With this arrangement, when the process cartridge B is inserted while being guided by the left and right guide members 17, 18, an opening/closing member of the cartridge B pushes the arm member 47 in a direction shown by the arrow a in FIG. 47. As a result the free end of the arm member 47 urges the link portion 46*b* of the laser shutter 46, thereby rotating the shutter portion 46*b* in a direction shown by the arrow b. Consequently, the opening 1*a*1 of the optical unit 1*a* is opened, thus permitting the illumination of the laser light onto the photosensitive drum 7.

Further, by a biasing force of a tension spring attached to the link portion 46*b* of the laser shutter 46, the laser shutter 46 is always biased toward a direction to close the opening 1*a*1. Thus, when the operator dismounts the process cartridge B from the image forming apparatus A, since the urging force of the arm member 47 is released, the laser shutter 46 automatically closes the opening 1*a*1 by the spring force of the spring 47*b*.

Accordingly, other than the case where the process cartridge B is mounted to the image forming apparatus to permit the image recording operation, the laser light is prevented from illuminating onto the photosensitive drum 7 and the like from the optical unit 1*a*. Further, since the link portion 46*b* and the arm member 47 for opening and closing the laser shutter 46 are positioned in the vicinity of the left guide member 17 and opposite to the right guide member 18, the space for installing these elements can be used effectively. Accordingly, the effective use of the space can be achieved, and, thus, the apparatus can be made small-sized. Incidentally, in the illustrated embodiment, as shown in FIG. 48, the position where the projection 14*m* is abutted against the arm member 47 is spaced apart from the longitudinal end of the cartridge by a distance Y1 of about 5–6 mm.

Figure 48:
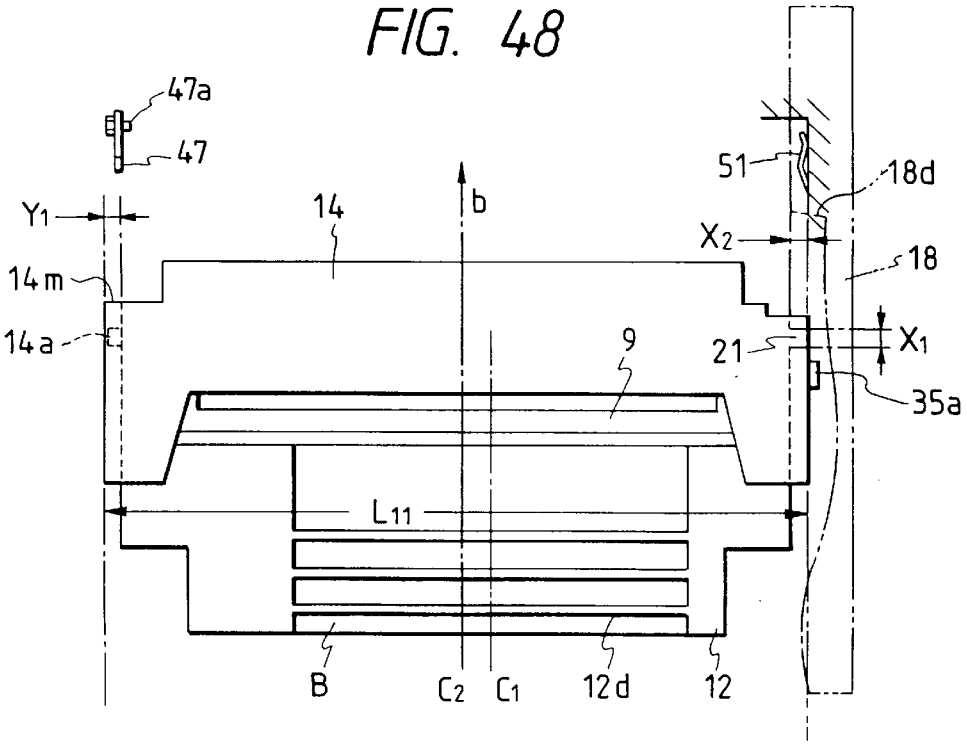
FIG. 48 is a view showing a gripper portion on which lateral ribs are formed.

(Offset of Gripper Portion):

As shown in FIG. 48, when the operator mounts the process cartridge B to the image forming apparatus A, the projection 14*m* (acting as an opening member) provided at the left (in longitudinal or thrust direction) shoulder portion of the process cartridge B urges the arm member 47 (for opening and closing the laser shutter 46) provided on the frame of the apparatus. Substantially at the same time, the metal shaft 21 (having a diameter X1 of about 10 mm and a protruding amount X2 of about 5 mm) protruded from the right side of the process cartridge B and acting as a drum earth is contacted with an earthing contact member (electric contact) 51 having a spring feature and provided on the frame of the apparatus. Further, the link portion provided on the right side of the cartridge B is abutted against the shutter cam portion 18*d* of the frame to open the drum shutter 35.

Accordingly, when the cartridge B is mounted, the left side of the cartridge B in the longitudinal direction is subjected to a load for resisting to the biasing force of the spring 47*b*, in order to open the laser shutter 46. On the other hand, the right side of the process cartridge B is subjected to a load for deforming the contact member 51 having the spring feature due to the contact between the metal shaft 21 and the earthing contact member 51, and a load for resisting to the biasing force of the torsion coil spring 35*e* in order to open the drum shutter 35. In the illustrated embodiment, among the above loads, the load for opening the drum shutter 35 is greatest. As a result, when the cartridge B is inserted, the cartridge is subjected to the load offset from a longitudinal center C2 of the cartridge.

Thus, in the illustrated embodiment, as shown in FIG. 48, the ribs 12*d* are arranged so that the longitudinal center C1 of the ribs (constituting the gripper portion of the cartridge B) is offset from the longitudinal center C2 of the process cartridge B toward a side where the link portion 35*a* of the drum shutter 35 and the metal shaft (conductive member) 21 are provided. That is to say, in the illustrated embodiment, the longitudinal center C1 of the ribs 12*d* is offset from the center C2 of the longitudinal length L11 (about 300 mm) of the process cartridge B by about 10 mm (The longitudinal center C1 of the ribs 12*d* is offset from a center of a recording medium convey path when the process cartridge B is mounted to the image forming apparatus A by about 10 mm or is offset from a longitudinal center of the photosensitive drum 7 of the process cartridge B by about 10 mm).

Figure 49:
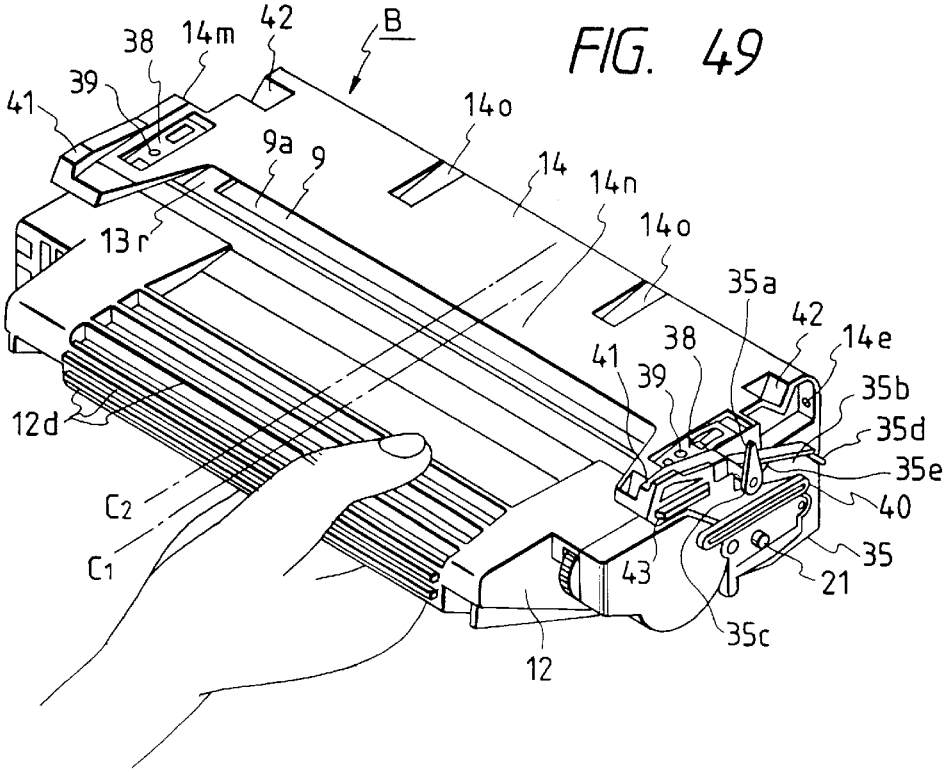
FIG. 49 is a perspective view showing a condition that the gripper portion of the cartridge is gripped by hand.

With this arrangement, when the cartridge B is mounted to the image forming apparatus A, as shown in FIG. 49, the operator grips the right side from the longitudinal center C2 of the cartridge B, i.e., a side where the link portion 35*a* of the drum shutter 35 is provided to insert the cartridge into the frame of the apparatus. To do so, in the longitudinal direction of the cartridge B, the side where the link portion 35*a* is provided is subjected to a force slightly greater than the other side. Due to the offset of force, the load for opening and closing the drum shutter 35 is cancelled, whereby the cartridge B can be smoothly inserted into the image forming apparatus A without any play, as a whole. Further, since the ribs 12*d* are disposed in parallel with the photosensitive drum 7 arranged in the longitudinal direction of the cartridge B, when the cartridge is inserted while gripping the ribs 12*d*, the longitudinal direction of the cartridge can easily be maintained in perpendicular to the cartridge inserting direction, thereby easily eliminating any plays at both longitudinal ends of the cartridge during the insertion of the cartridge.

Figure 50:
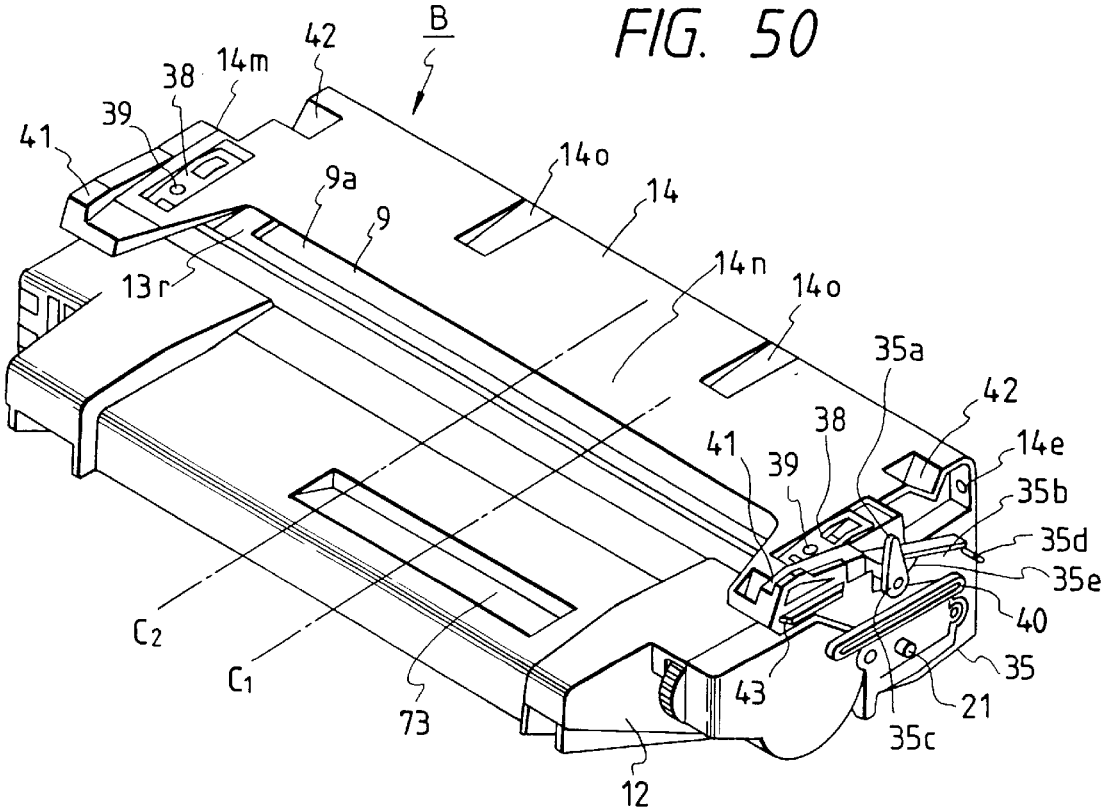
FIG. 50 is a perspective view showing a gripper portion in which a recess is formed.
Figure 51:
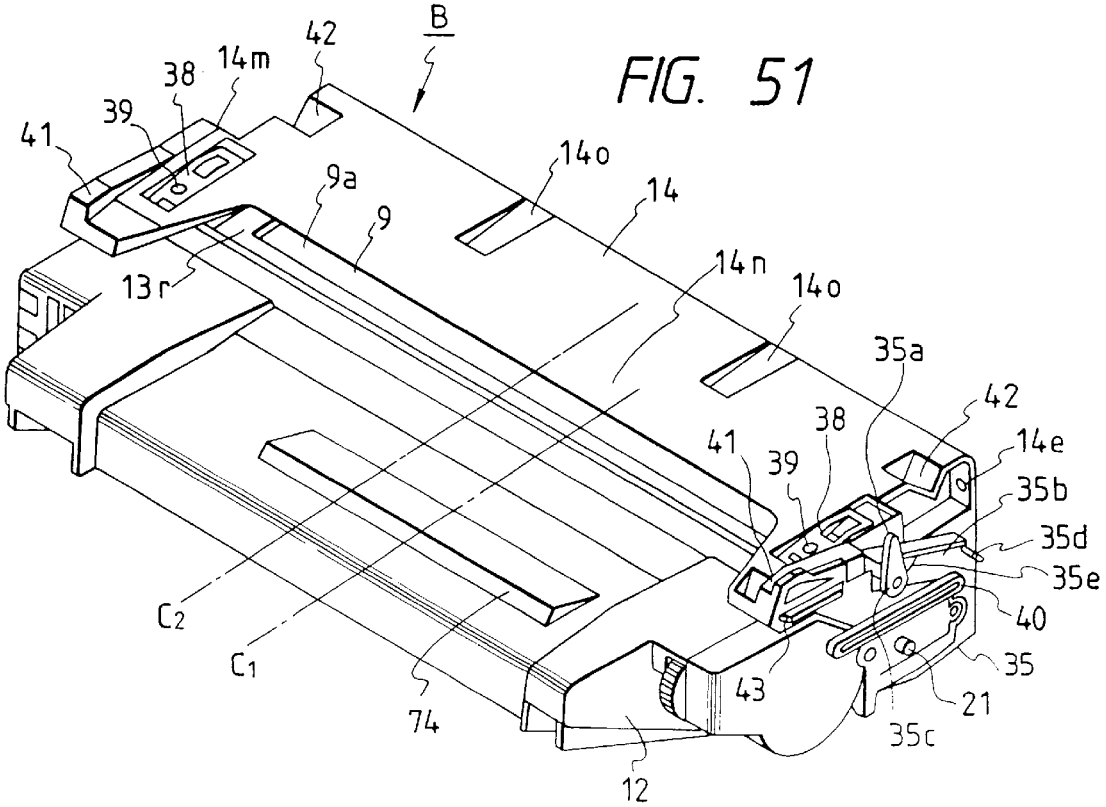
FIG. 51 is a perspective view showing a gripper portion on which a projection is formed.

Incidentally, although the gripper portion can be constituted by the ribs 12*d* as shown in FIG. 48, it may be constituted by a recess 73 formed in the frame as shown in FIG. 50 or may be constituted by a projection or ridge 74 formed on the frame as shown in FIG. 51. That is to say, the gripper portion may have any configuration so long as the operator can easily grip it.

Further, in the illustrated embodiment, while an example that the gripper portion is arranged offset toward the side where the link portion 35*a* of the drum shutter 35 and the metal shaft 21 are provided was explained, the present invention is not limited to this example. For example, when the spring force of the spring 47*b* of the laser shutter 46 is strong and the load for resisting to the biasing force of the coil spring 35*e* is stronger than the load for resisting to the biasing force of the spring 47*b* and the load for deforming the contact member 51, the gripper portion is arranged offset toward a side where the projection 14*m* is provided. In this way, the gripper portion is arranged offset toward a side where the frame is subjected to the greater mounting resistance generated due to the abutment between the parts of the image forming apparatus and the frame when the process cartridge is mounted to the image forming apparatus.

(Explanation of Electric Contacts):

Next, the electric connection between various parts when the process cartridge B is mounted to the image forming apparatus will be explained.

Figure 52:
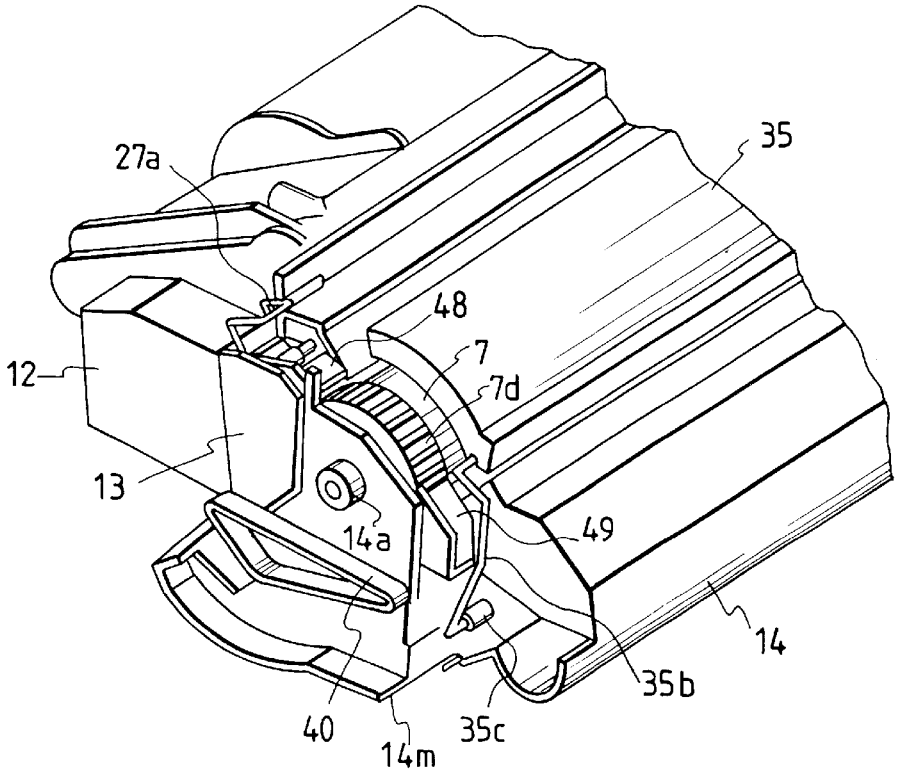
FIG. 52 is a partial perspective view showing the arrangement of various contacts provided on a process cartridge.

When the process cartridge B is mounted to the image forming apparatus A, various contact portions provided on the process cartridge B are contacted with various contact portions provided in the frame 15 of the image forming apparatus, thereby electrically connecting the process cartridge B to the image forming apparatus. That is to say, as shown in FIG. 52, the contact portion 27*a* (made of stainless steel in the illustrated embodiment) as the conductive member provided on the end of the antenna line 27 for detecting the toner remaining amount is exposed from the lower portion of the developing frame 13, and the developing bias contact portion 48 (made of stainless steel in the illustrated embodiment) as the conductive member for applying the developing bias to the developing sleeve 10*d* is also exposed. Further, the charging bias contact portion 49 (made of stainless steel in the illustrated embodiment) as the conductive member for applying the charging bias to the charger roller 8 is exposed from the lower portion of the cleaning frame 14. More particularly, with respect to the photosensitive drum 7, the contact portion 27*a* of the antenna line 27 and the developing bias contact portion 48 are arranged at one side, and the charging bias contact portion 49 is arranged at the other side. Incidentally, the charging bias contact portion 49 is integrally formed with the contact member 26 (FIG. 10).

Figure 53:
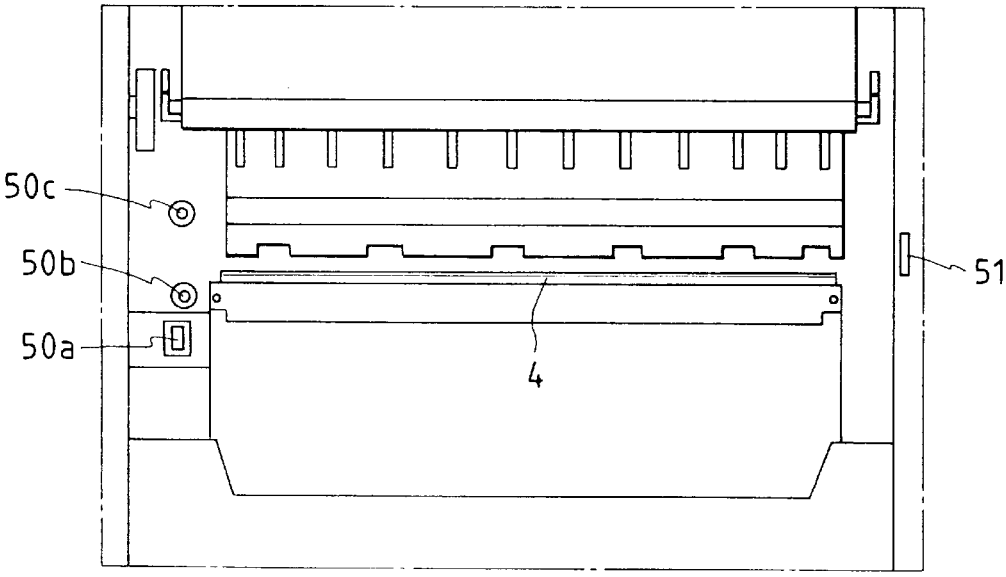
FIG. 53 is a plan view showing the arrangement of various contacts provided on an image forming apparatus.
Figure 54:
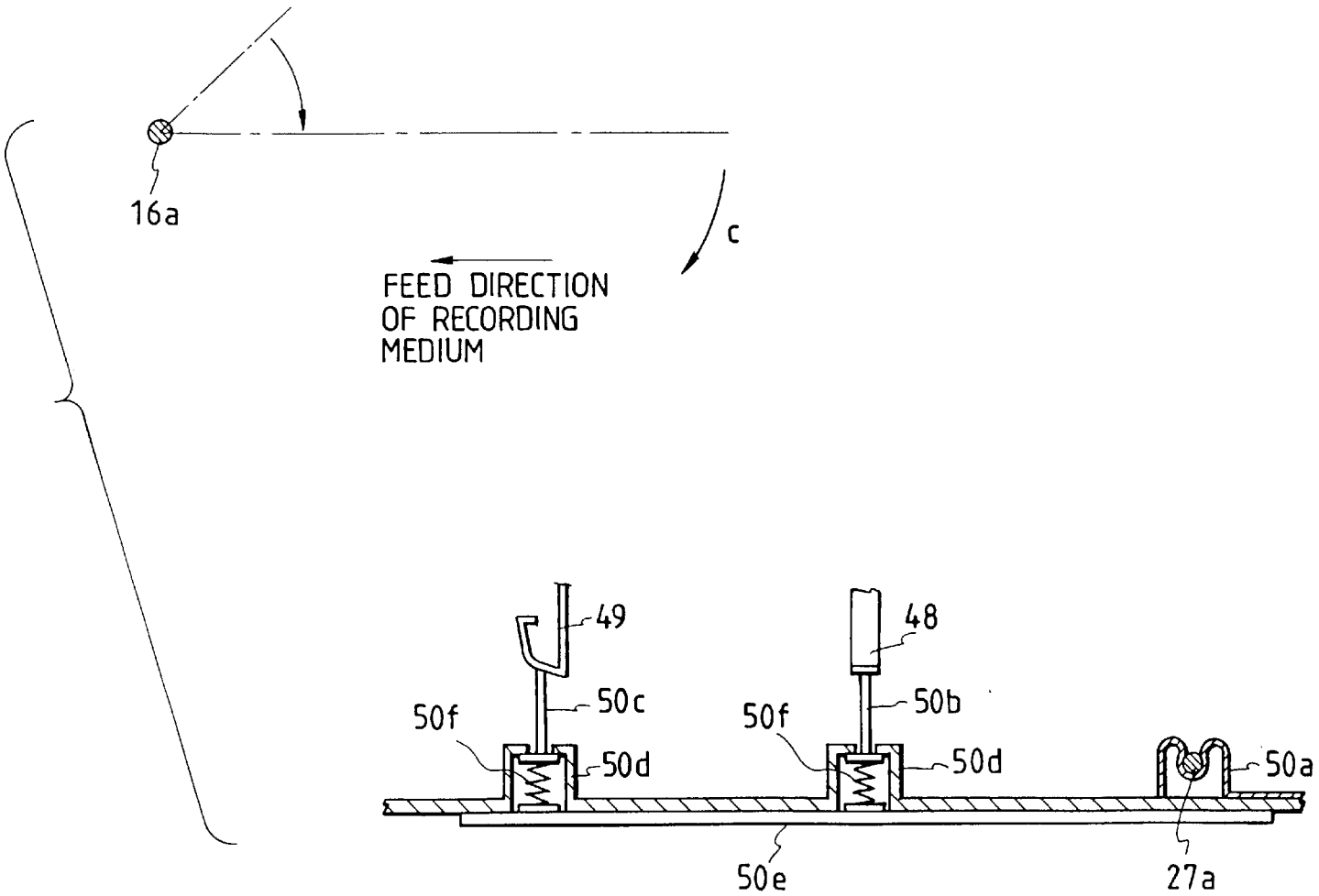
FIG. 54 is a sectional view showing a relation between the contacts and contact pins.

In correspondence to these contacts, as shown in FIG. 53, with respect to the transfer roller 4, an antenna line contact member 50 to which the contact portion 27*a* of the antenna line 27 is contacted when the process cartridge B is mounted and a developing bias contact pin 50*b* to which the developing bias contact portion 48 is contacted are arranged at one side in the recording medium feeding direction, and a charging bias contact pin 50*c* to which the charging bias contact portion 49 is contacted is arranged at the other side. Incidentally, as shown in FIG. 54, the contact pins 50*b*, 50*c* are attached to respective holder covers 50*d* not to slip out of the holder covers and can be protruded from the holder covers. The contact pins are biased upwardly by springs 50*f* and are electrically connected to the wiring pattern on an electric substrate 50*e* to which the holder covers 50*d* are attached via the springs 50*f*. Further, among the contact portions 48, 49 to which the contact pins 50*b*, 50*c* are abutted, the charging bias contact portion 49 is configured as an arcuated shape having straight portions and a curved portion connecting between the straight portions so that the curvature is formed at a side of the pivot hinge 16a of the opening/closing cover 16. Thus, when the opening/closing cover 16 is closed around the hinge 16*a* toward a direction shown by the arrow c after the process cartridge B is mounted, the charging bias contact portion 49 nearest the hinge 16*a* and having the minimum radius of rotation can be smoothly and effectively contacted with the contact pin 50*c*.

Further, the shaft 21 for supporting one end of the photosensitive drum 7 is made of metal, and the photosensitive drum 7 is earthed via the metal shaft 21. To this end, as shown in FIGS. 6 and 48, an earthing contact member 51 comprising a leaf spring earthed via a chassis of the frame 15 and the like is provided at the bearing portion 18*a* of the right guide member 17 on which the shaft 21 is disposed when the process cartridge B is mounted, and, in the condition that the cartridge is mounted, the shaft 21 is contacted with the earthing contact member 51.

Now, the arrangement of the electric contacts will be explained with reference to FIG. 22. As seen in FIG. 22, the contacts 48, 49 are arranged at the side of the photosensitive drum 7 opposite to the side where the helical gear 7*c* is provided, and at the other side (where the helical gear 7*c* is provided) of the photosensitive drum 7, the metal shaft 21 as the drum earthing contact is arranged. In a direction perpendicular to the longitudinal direction of the photosensitive drum 7, i.e., in the recording medium feeding direction, the developing bias contct member 48 is arranged at one side of the drum (side toward the developing means 10), and the charging bias contact member 49 is arranged at the other side (side toward the cleaning means 11). Incidentally, the metal shaft 21 as the drum earthing contact is protruded outwardly of the frame 14 and is positioned on a rotational centerline of the photosensitive drum 7.

Further, the developing bias contact member 48 and the charging bias contact member 49 are arranged along a line with respect to the longitudinal direction of the photosensitive drum 7 and are disposed on both sides of the gear flange (spur gear) 7*d* and the photosensitive drum 7. In addition, the contact members 48, 49 are positioned inwardly of the outer end surface of the gear flange 7*d* of the longitudinal direction of the photosensitive drum 7. With this arrangement, it is possible to reduce the longitudinal size of the process cartridge B, and, thus, to make the process cartridge small-sized.

Further, as mentioned above, the charging bias contact member 49 is arcuated outwardly. That is to say, the contact member 49 has the straight portion which becomes a leading end when the process cartridge is mounted, and is arcuated from the straight portion. With this arrangement, when the process cartridge B is mounted to the image forming apparatus A, even if there arises the dispersion in the abutment angle between the charging bias contact member 49 and the charging bias contact pin 50*c* of the image forming apparatus, such dispersion can be absorbed, thereby abutting the charging bias contact member 49 against the charging bias contact pin 50*c* surely and effectively. Although the charging bias contact member 49 is positioned forwardly when the process cartridge B is mounted to the image forming apparatus A, the contact member 49 and the contact pin 50*c* are not damaged during the cartridge mounting operation.

Furthermore, the contact portion 27*a* of the antenna line 27 for detecting the toner remaining amount of the toner in the toner reservoir 10*a* of the developing means 10 at the side of the image forming apparatus is disposed at the same side as the developing bias contact member 48 with respect to the longitudinal direction of the photosensitive drum 7, and is spaced apart from the photosensitive drum 7 more than the developing bias contact member 48 at one lateral side (toward the developing means 10) of the photosensitive drum 7.

By arranging the contacts as mentioned above, since the charging bias contact member 49 is spaced apart from the metal shaft 21 as the earthing contact, there is no risk of generating the floating capacity between the contacts, thereby stabilizing the charging voltage to avoid the charging discrepancy. That is to say, if the drum earthing contact is arranged near other contacts, the floating capacity will be generated between the wiring and contacts arranged around the drum earthing contact and such other contacts, with the result that the AC voltages used to the developing, charging and toner remaining amount detection tend to go wrong. Particularly, in the case of the charger roller that is contacted with the photosensitive drum 7 to charge the latter, since the constant current control is effected, if the AC voltage is fluctuated due to the floating capacity, it is feared that the image is deteriorated. To the contrary, by arranging the contacts as in the illustrated embodiment, the floating capacity can be eliminated, thus maintaining the AC voltage stably or normally, thereby eliminating the charging discrepancy.

Further, since the developing bias contact member 48 and the charging bias contact member 49 are arranged on both sides with respect to the photosensitive drum 7, the electric interference between these contacts can be avoided.

In view of the above, in the present embodiment, upon assembling the process cartridge B, the metal shaft 21 is attached to the cleaning frame 14 which supports the photosensitive member 7 in the direction protruding outwardly from the drum 7 with respect to the axial direction of the drum 7, and the contact member for charge bias 49 is attached at opposite side of the metal shaft 21 with respect to the axial direction of the drum. Furthermore, to the toner developing frame member C which supports developing means 10 the contact member for developing bias 48 is attached. This contact member 48 is located in the axial direction of the photosensitive drum 7 when the cleaning frame member 14 and the toner developing frame member C are connected each other. Thereafter, the frame members 14 and C are connected to assemble the process cartridge B.

(Toner Remaining Amount Detection and Cartridge Mount Detection Circuits):

Next, the toner remaining amount detection and the process cartridge mount detection in this apparatus will be explained. In this apparatus, as mentioned above, the remaining amount of toner in the process cartridge B is detected on the basis of the change in the electrostatic capacity between the antenna line 27 provided on the cartridge and the developing sleeve 10*d*. To this end, a circuit shown in FIG. 55 is provided.

Figure 55:
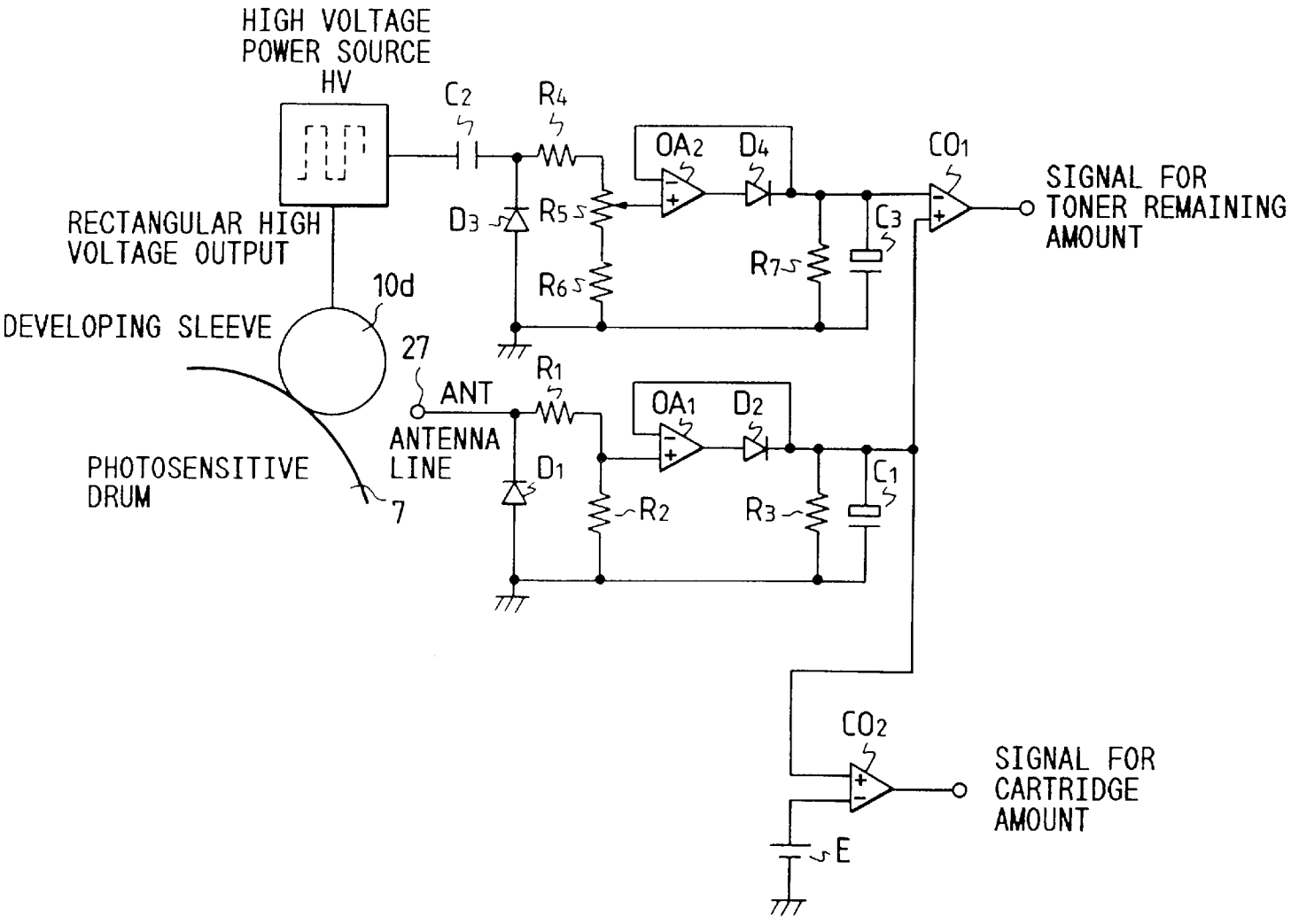
FIG. 55 is a detection circuit for detecting a toner remaining amount.

In the circuit shown in FIG. 55, the developing sleeve 10*d* and the antenna line 27 constitute the equivalent capacitors.

A high voltage power source HV applies a rectangular wave AC voltage (Vpp=about 1600 V) to the developing sleeve 10*d*. The high voltage from the high voltage power source HV has the rectangular building-up and the rectangular building-down, and is detected as the derivative wave form ANT by the electrostatic capacity between the developing sleeve 10*d* and the antenna line 27 and resistors R1, R2. Incidentally, a diode D1 is a clamp diode having the minus output. The derivative wave form ANT is voltage-divided by the resistors R1, R2 and is peak-detected by a first peak hold circuit comprising an operation amplifier OA1, a diode D2 and a capacitor C1, and is converted into a DC signal. Incidentally, a resistor R3 serves to discharge the capacitor C1.

The electrostatic capacity between the developing sleeve 10*d* and the antenna line 27 depends upon an amount of toner existing between the developing sleeve 10*d* and the antenna line 27. That is to say, when the toner exists between both conductors, since the dielectric constant between the conductors increases, the electrostatic capacity between the conductors is increased. Accordingly, as the amount of the toner is decreased, since the dielectric constant between the conductors is decreased and the electrostatic capacity is also decreased, the voltage detected by the first peak hold circuit is decreased as the amount of the toner is reduced.

On the other hand, the output from the high voltage power source HV is supplied to the developing sleeve 10*d* and is also supplied to a derivative circuit comprised of a reference capacitor C2, a resistor R4, a resistor R5 (volume resistor) and a resistor R6. Incidentally, a diode D3 is a clamp diode having the minus output. The derivative wave form detected through the volume resistor R5 is converted into a DC signal by a second peak hold circuit comprising an operation amplifier OA2, a diode D4, a capacitor C3 and a discharging resistor R7. The volume resistor R5 is adjusted so that the output from the second peak hold circuit becomes a desired reference value (about 2.7 V in the illustrated embodiment).

The output (potential of the capacitor C1→value corresponding to the toner remaining amount) of the first peak hold circuit and the output (potential of the capacitor C3→reference value) of the second peak hold circuit are compared by a comparator CO1, and is outputted as a signal representative of the toner remaining amount. Accordingly, when the adequate amount of toner remains between the developing sleeve 10*d* and the antenna line 27, the potential of the capacitor C1 is higher than the potential of the capacitor C3, and the output of the comparator CO1 becomes a high level. As the amount of toner between the developing sleeve 10*d* and the antenna line 27 is reduced, the potential of the capacitor C1 is decreased. When the potential of the capacitor C1 is lowered below the potential of the capacitor C3, the output of the comparator becomes a low level. Therefore, it is possible to detect the toner remaining amount on the basis of the output of the comparator CO1.

Incidentally, in the illustrated embodiment, it is also detected whether the process cartridge B is mounted to the image forming apparatus A or not. That is to say, in the circuit shown in FIG. 55, when the potential of the capacitor C1 becomes smaller than a reference potential E (about 1 V in the illustrated embodiment), the output of a comparator CO2 becomes the low level, thereby judging that the process cartridge B is not mounted to the image forming apparatus A.

For example, when the power source is turned ON, the controller for controlling the apparatus outputs the rectangular wave form alternate current from the high voltage power source HV to the developing sleeve 10*d*. However, if the process cartridge B is not mounted to the image forming apparatus, since the photosensitive drum 7, developing sleeve 10*d* and antenna line 27 do not exist in the circuit of FIG. 55, the signal is not inputted to the operation amplifier OA1. Accordingly, in this case, the potential of the capacitor C1 becomes zero. Thus, by setting the reference potential E to the plus voltage having some margin regarding the zero level and to the potential lower than the potential of the capacitor C1 when the toner in the cartridge is empty, it is possible to detect the presence/absence of the process cartridge B.

Figure 56:
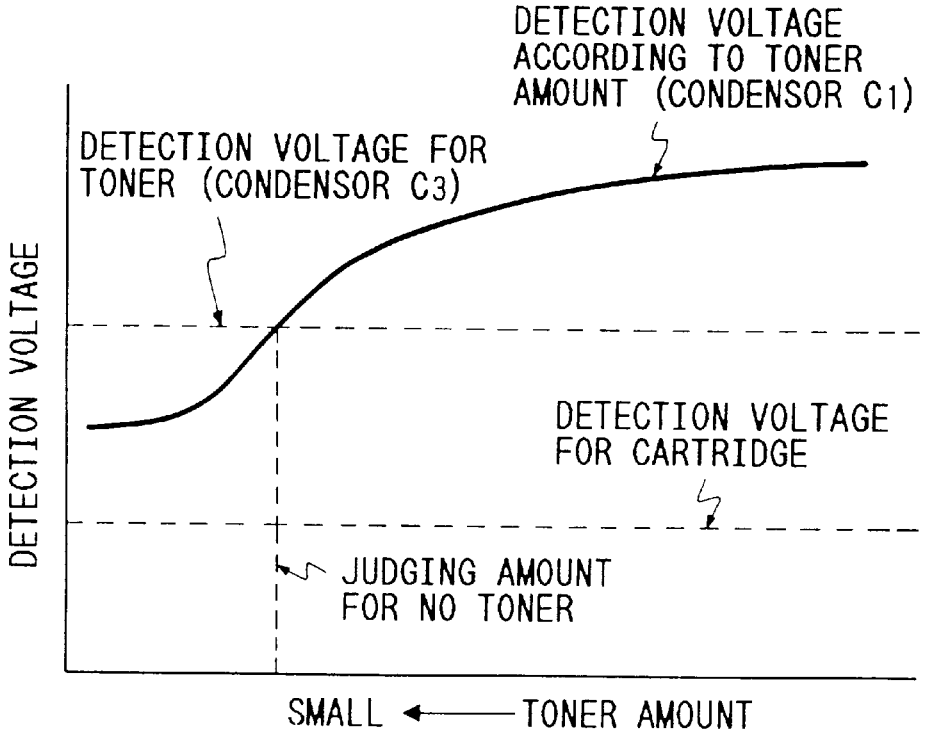
FIG. 56 is a graph showing a relation between a toner amount and a toner remaining amount detection voltage.

A voltage relation between the detection level of the presence of the toner remaining amount and the detection level of the presence of the cartridge mount is shown in FIG. 56. In FIG. 56, a detection reference voltage (potential of the capacitor C3) for the presence/absence of the toner remaining amount may be set to an alarm level for informing of the toner amount insufficient to perform the recording. Incidentally, in the illustrated embodiment, the reference voltage is adjusted by adjusting the volume resistor R5 (at the manufacture thereof) to the electrostatic capacity (about 7.5 pF) corresponding to the case where the toner of about 20 grams exists between the developing sleeve 10*d* and the antenna line 27. Further, the detection reference voltage for the presence/absence of the cartridge mount may be obtained by voltage-dividing the voltage of the power source by resistor(s).

Figure 57:
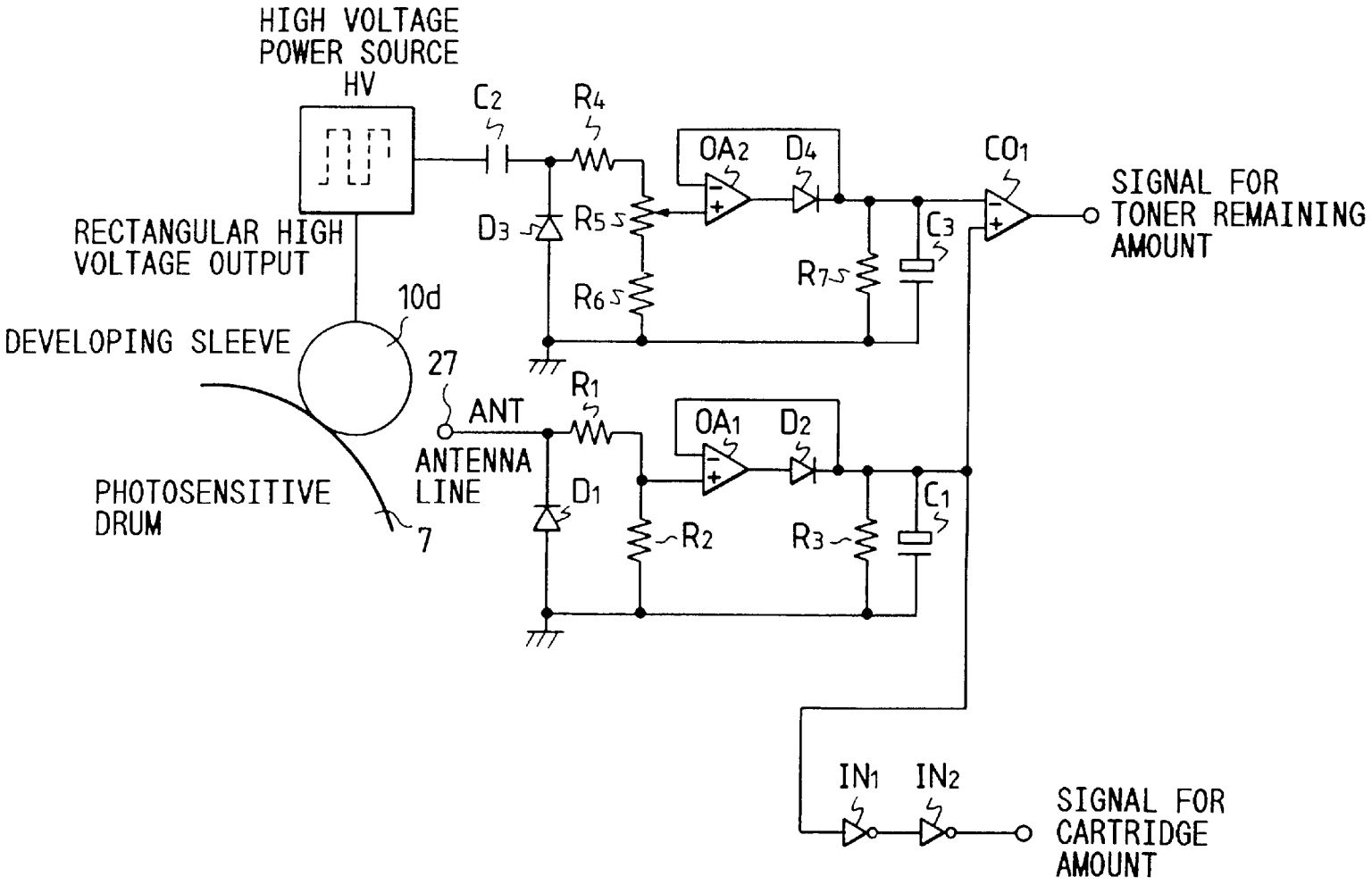
FIG. 57 is a circuit according to an embodiment wherein the cartridge mount is detected by an inverter.

Incidentally, in the circuit of FIG. 55, while the comparator CO2 was used to detect the presence/absence of the cartridge mount, in place of this comparator, as shown by a circuit in FIG. 57, inverters IN1, IN2 having the appropriate slice level may be used. Also in this case, it is necessary to adjust the detection voltage level from the antenna line 27 by the resistors R1, R2, R4, R5, R6 so that the outputs of the inverters IN1, IN2 do not become the low levels when there is no toner in the cartridge.

Figure 58:
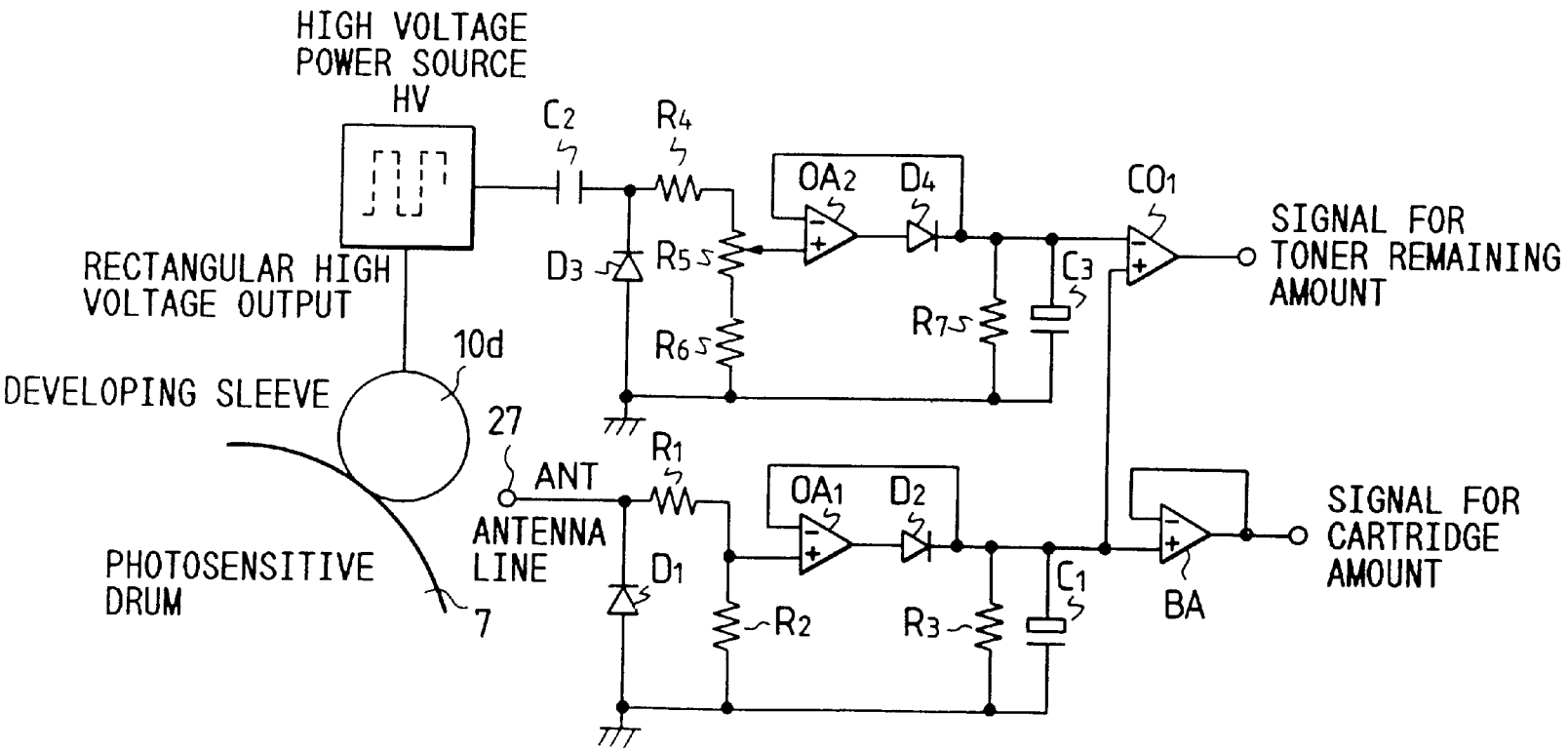
FIG. 58 is a circuit according to an embodiment wherein the cartridge mount is detected by a digital signal.

Further, regarding the detection of the presence/absence of the cartridge mount, as shown in FIG. 58, when the output of the capacitor C1 is sent to the controller via a buffer amplifier BA and the A/D conversion is effected, the detection becomes more reliable.

(Control Portion):

Next, the control system of the image forming apparatus A will be briefly described with reference to a function block diagram shown in FIG. 59.

Figure 59:
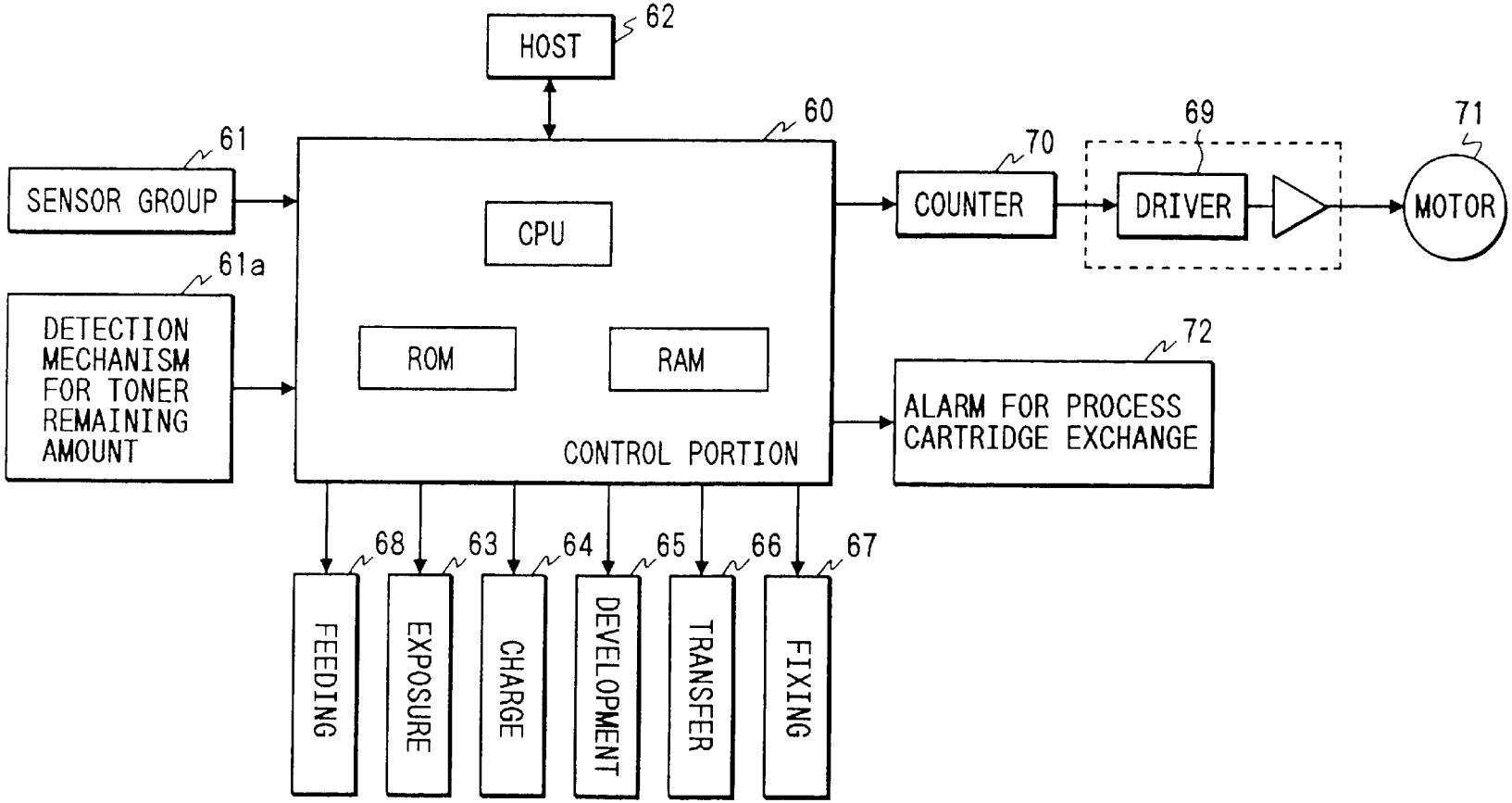
FIG. 59 is a function block diagram of a control means.

In FIG. 59, a control portion 60 for controlling the whole image forming apparatus comprises a CPU such as a microcomputer, a ROM for storing a control program for the CPU and various data, and a RAM used as a work area for the CPU and adapted to temporarily store various data.

The control portion 60 receives signals from a sensor group 61 including a sheet jam sensor and the like. Further, the control portion receives a signal from a toner remaining amount detection mechanism 61*a* for detecting the remaining amount of the toner in the cartridge on the basis of the change in the electrostatic capacity between the developing sleeve 10*d* and the antenna line 27. Further, the control portion receives an image signal from a host 62 such as a computer, a word processor or the like.

On the basis of such information, the control portion 60 controls various processes such as exposure 63, charge 64 (charger roller 8 and the like), development 65 (developing sleeve 10*d* and the like), transfer 66 (transfer roller 4 and the like) and fixing 67 (fixing roller 5*b* and the like), and the feeding 68 of the recording medium (regist rollers 3*d*1, 3*d*2, discharge rollers 3*f*1, 3*f*2 and the like). Further, the control portion controls the drive of a main drive motor 71 via a counter 70 for counting the number of pulses to be applied from the control portion to a driver 69.

Further, in the illustrated embodiment, the control portion 60 receives a signal representative of no toner generated as a result of the toner remaining amount detection, and performs the alarm 72 for the process cartridge exchange (for example, turning lamp or buzzer ON).

(Image Forming Operation):

Next, the image forming operation effected after the process cartridge B is mounted to the image forming apparatus A will be explained.

When the recording medium 2 is set on the sheet supply tray 3*a* shown in FIG. 1 and the setting of the recording medium is detected by a sensor (not shown) or when the cassette 3*h* containing the recording medium 2 is set and the copy start key is depressed, the pick-up roller 3*b* or 3*i* starts to rotate, and the paired separation rollers 3*c*1, 3*c*2 and the paired regist rollers 3*d*1, 3*d*2 are rotated to feed the recording medium 2 to the image forming station. In registration with the feeding timing of the paired regist rollers 3*d*1, 3*d*2, the photosensitive drum 7 is rotated in the direction shown by the arrow in FIG. 1, and, by applying the charging bias to the charger roller 8, the surface of the photosensitive drum 7 is uniformly charged. Then, the laser light corresponding to the image signal is illuminated from the optical system 1 through the exposure portion 9 onto the photosensitive drum 7, thereby forming a latent image on the drum in response to the light illumination.

At the same time when the latent image is formed, the developing means 10 of the process cartridge B is driven to rotate the toner feed member 10*b*, thereby feeding out the toner in the toner reservoir 10*a* to the developing sleeve 10*d* where the toner layer is formed on the sleeve 10*d*. By applying the voltage having the same polarity and potential as the charging polarity of the photosensitive drum 7 to the developing sleeve 10*d*, the latent image on the photosensitive drum 7 is visualized as the toner image. The recording medium 2 is fed between the photosensitive drum 7 and the transfer roller 4, and, by applying the voltage having the polarity opposite to that of the toner to the transfer roller 4, the toner image on the photosensitive drum 7 is transferred onto the recording medium 2. After the transferring operation, the photosensitive drum 7 is further rotated in the direction shown by the arrow in FIG. 1; meanwhile, the residual toner remaining on the photosensitive drum 7 is scraped off by the cleaning blade 11*a*, and the scraped toner is collected into the waste toner reservoir 10*c*.

On the other hand, the recording medium 2 to which the toner image was transferred is sent to the fixing means 5, where the toner image is fixed to the recording medium 2 with heat and pressure. Thereafter, the recording medium 2 is discharged onto the discharge portion 6 by the discharge rollers 3*e*, 3*f*1, 3*f*2. Incidentally, regarding the fixing means, in the illustrated embodiment, while the so-called heat fixing type was used, other fixing means such as pressure fixing type may be used.

(Recycle of Process Cartridge):

Next, the recycle of the process cartridge according to the illustrated embodiment will be explained. In the past, when the toner in the process cartridge was consumed or used up, the process cartridge was dumped. Thus, the reusable parts such as rollers were also dumped together with the process cartridge. However, recently, in consideration of the protection of the earth environment, various electric and electronic equipments are not dumped as conventionally, but parts of such equipments have been recycled (regenerated or reused) from the view point of saving resources, saving energy and the reduction of dust.

Thus, in the process cartridge according to the illustrated embodiment, since the parts such as the charging members, developing members or cleaning members have long service lives, such parts can be still used after the toner in the cartridge is consumed. Therefore, recently, the cartridges in which the toner was consumed have been collected and the reusable parts have been recycled.

Now, the procedure of the recycle of the process cartridge will be described. The procedure of the recycle of the process cartridge includes the following steps; that is, (1) collection, (2) sorting, (3) decomposition, (4) selection, (5) cleaning, (6) check and (7) re-assembling. These steps will be fully explained hereinbelow.

(1) Collection:

The used process cartridges are collected at a collection center with the aid of users and service men.

(2) Sorting:

The used process cartridges collected at the various collection centers are transported to a cartridge recycle factory. And, the collected process cartridges are sorted on the basis of the types.

(3) Decomposition:

The sorted process cartridges are decomposed to pick up parts.

(4) Selection:

The picked-up parts are checked to select or divide them into reusable parts and non-reusable parts which were damaged or the service lives of which were expired.

(5) Cleaning:

Only the parts which pass the selection process are cleaned to reuse as new parts.

(6) Check:

After the cleaning, the parts are checked to determine whether they restore their functions sufficiently and can be reused.

(7) Re-assembling:

A new process cartridge is assembled by using the parts which pass the check.

In the recycling process, the charger roller 8 and the developing sleeve 10*d* and the like are reused by re-assembling them, and the frames 12, 13, 14 are crushed to reuse as material. In this case, if the frames 12, 13, 14 are formed from different materials, when these frames are crushed together, the different materials are mixed, thus deteriorating the mechanical feature of the material which is reused. Thus, each frame 12, 13, 14 must be crushed separately or independently. However, since the toner frame is welded to the developing frame, these frames must be separated from each other by cutting, thereby making the recycle process troublesome. To the contrary, according to the illustrated embodiment, as mentioned above, since the toner frame 12, developing frame 13 and cleaning frame 14 are formed from the same material (polystyrene resin), even when these frames 12, 13, 14 are crushed together to obtain pellets, the mechanical feature of the material is not worsened, thereby improving the recycle process.

Further, in the illustrated embodiment, since the polystyrene resin which is material for the frames is the similar material to the component of the toner (both styrene group), even when the frames are crushed in a condition that the cleaning of the used cartridge is incomplete and the toner is adhered to the frames, the mechanical feature of the material is not deteriorated, unlike the case where the different materials are mixed.

Figure 60:
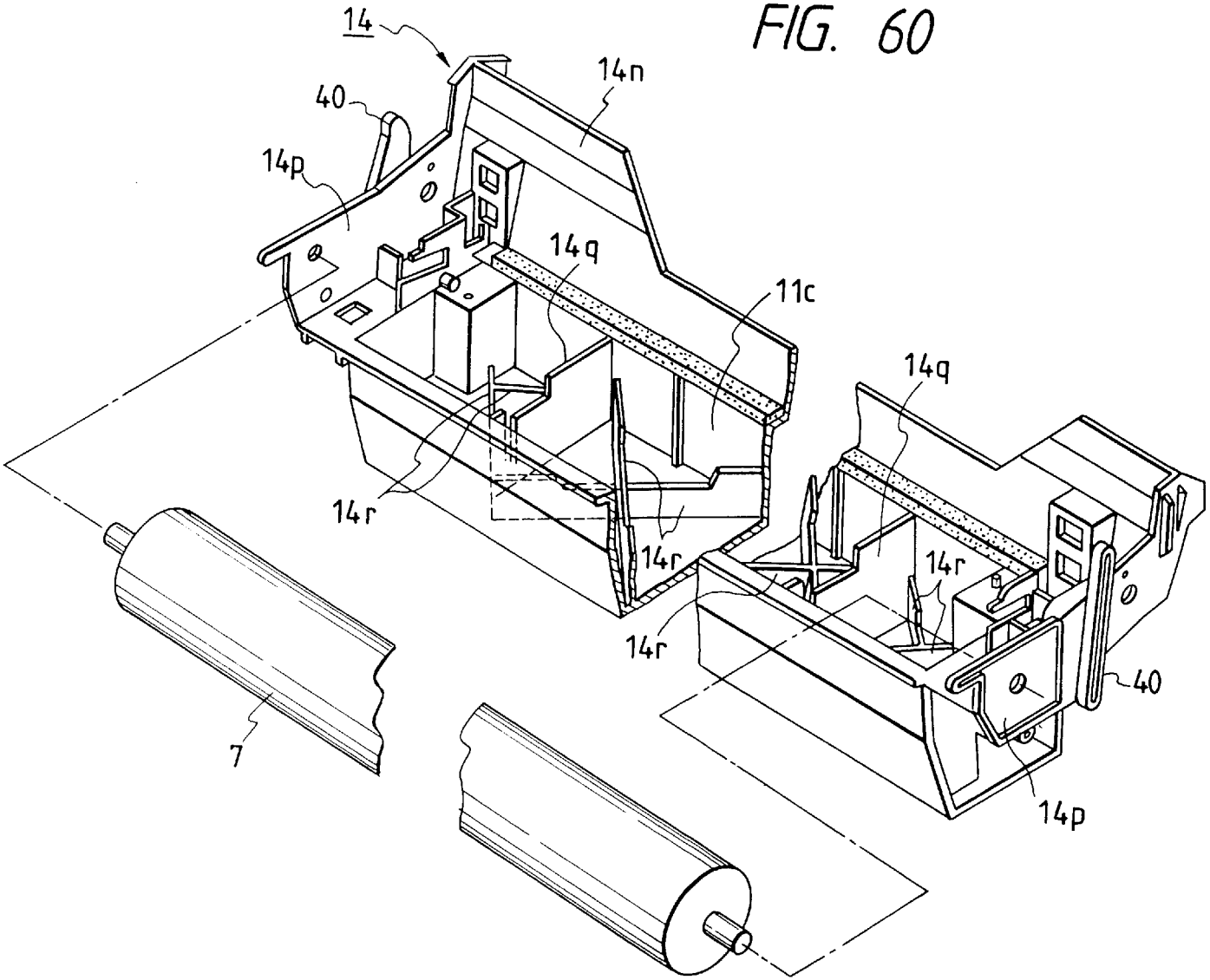
FIG. 60 is an exploded perspective view of a cleaning frame showing an inner construction thereof.

Incidentally, since the cleaning frame 14 can be separated from the toner developing frame C, it is not necessary to form the cleaning frame from the same material as that of the toner developing frame so long as these frames are crushed independently; however, the cleaning frame is preferably formed from the same material as that of the toner developing frame C when these frames are formed from the material similar to the material of the toner component. However, the cleaning frame 14 must have the mechanical strength sufficient to support the photosensitive drum 7 and the like. But, as in the illustrated embodiment, when the cleaning frame 14 is formed from polystyrene resin which is a material similar to as that of the toner developing frame C, the mechanical strength of the cleaning frame is weaker than that of a cleaning frame which is formed from polyphenylene oxide (PPO) or polyphenylene ether (PPE). Thus, as shown in FIG. 60, the cleaning frame 14 according to the illustrated embodiment is provided with an upper wall portion 14*n* (FIGS. 4, 7 and 47–51) for covering an upper portion of the photosensitive drum 7 between both side walls 14*p* (of the frame 14) for supporting the rotary shaft of the photosensitive drum 7, thereby reinforcing the side walls 14*p*.

Further, partition walls 14*q* are provided in the waste toner reservoir 11*c* to divide the interior of the waste toner reservoir into a plurality of chambers, and reinforcing ribs 14*r* are formed on the walls of each chamber at that side, thereby reinforcing the cleaning frame. Incidentally, the partition walls 14*q* limits the inadvertent longitudinal movement of the toner contained in the waste toner reservoir 11*c*, thereby preventing the waste toner from leaking from the waste toner reservoir 11*c*. By reinforcing the cleaning frame 14 as mentioned above, even when the cleaning frame 14 is formed from the same material (polystyrene resin) as that of the toner developing frame C, sufficient mechanical strength can be obtained.

(Another Embodiment Regarding Re-production of Process Cartridge by Recycling)

Next, another embodiment regarding the reproduction of the process cartridge by recycling will be explained. In the above-mentioned recycle procedures, while an example that the frames are crushed to obtain material to be reused was explained, the following example shows an example of simpler recycle for reusing the frames without crushing the latter.

Incidentally, also in this embodiment, the reproduction is effected in the same manner as the aforementioned procedures. Now, the following processes, i.e. (1) Disassembling of process cartridge B, (2) Replenishment of toner to toner reservoir 10*a*, (3) Attachment of cover film 28 to close opening 12*d* and (4) Re-assembling of process cartridge B, will be explained.

Figure 70:
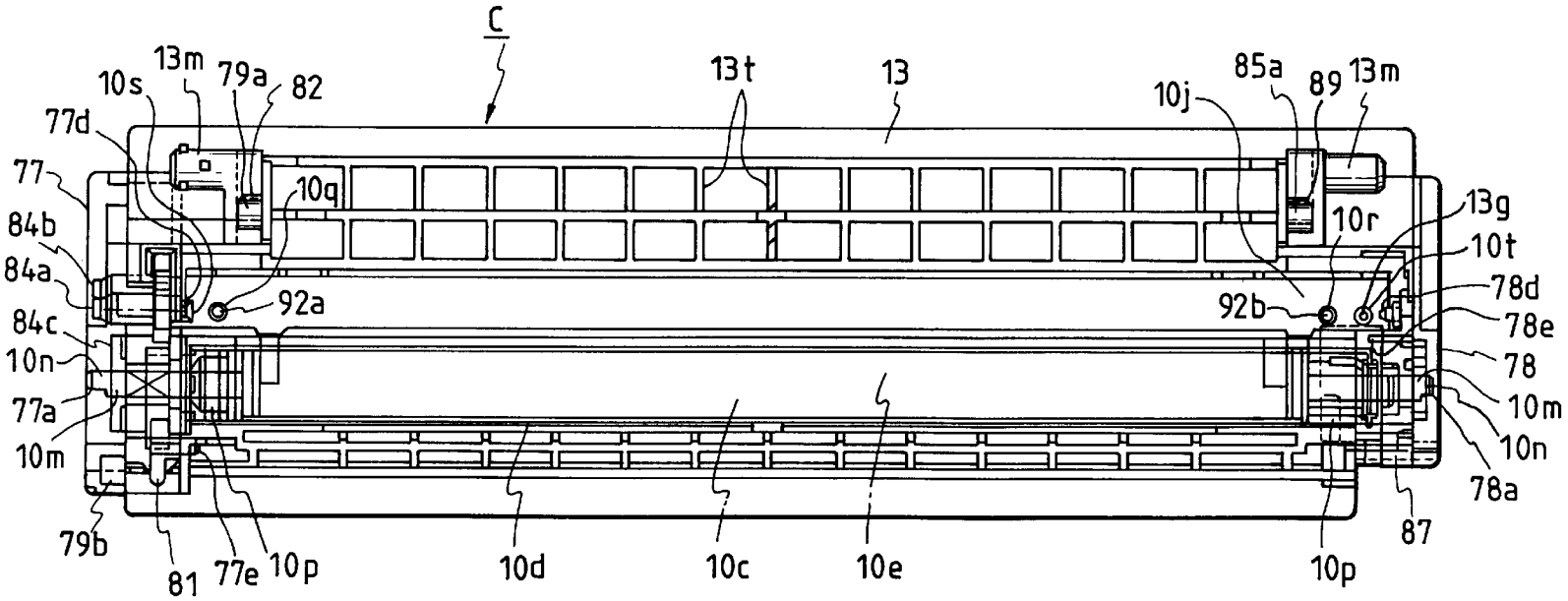
FIG. 70 is a schematic view of a toner developing frame before disassembling.

Before the disassembling process is explained, the construction of the toner developing frame C before disassembling will be briefly explained with reference to FIG. 70. The developing sleeve 10*d* is positioned in the opening 13*e* of the developing frame 13 to which the developing blade 10*e* is attached in such a manner that sleeve flanges 10*p* fitted on both ends of the developing sleeve are rotatably supported by a first support piece 81 and a second support piece 87. Further, shaft portions 10*m* protruding from both end of the magnet 10*c* positioned within the developing sleeve 10*d* extend through the sleeve flanges 10*p*. Free ends of the shaft portions 10*m* are fitted into locking holes 77*a*, 78*a* formed in the first and second support members 77, 78 and the support members 77, 78 are secured to both sides of the toner developing frame C by screws. That is to say, the sleeve flanges 10*p* of the developing sleeve 10*d* are rotatably supported by the first and second support pieces 81, 87 and the free ends of the shaft portions 10*m* of the developing sleeve are positioned and supported by the first and second support members 77, 78. Incidentally, notches are formed in locking portions 10*n* of the shaft portions 10*m* which are engaged by the first and second support members 77, 78, so that the magnet 10*c* is positioned by fitting the notches into the locking holes 77*a*, 78*a* of the first and second support members 77, 78.

(1) Disassembling:

Next, the disassembling of the process cartridge will be explained.

As shown in FIG. 38, the process cartridge B is disassembled and divided into the toner developing frame C and the cleaning frame 14. In disassembling, as shown in FIG. 39B, the screws 39 connected to the female threaded portions 14*j* through the threaded holes 38*b* are unscrewed. Then, the compression spring 38*e* is disengaged from the spring receiving recessed portion 13*n* and then is drawn through the through hole 14*k*. By drawing out the vertical portion 38*c* from the hole 14*i*, as shown in FIG. 38, the connecting member 38 is disassembled. As a result, the toner developing frame C and the cleaning frame 14 which were connected to each other for rotational movement around the connecting projections 13*m* can easily be separated from each other to left and right.

Figure 71:
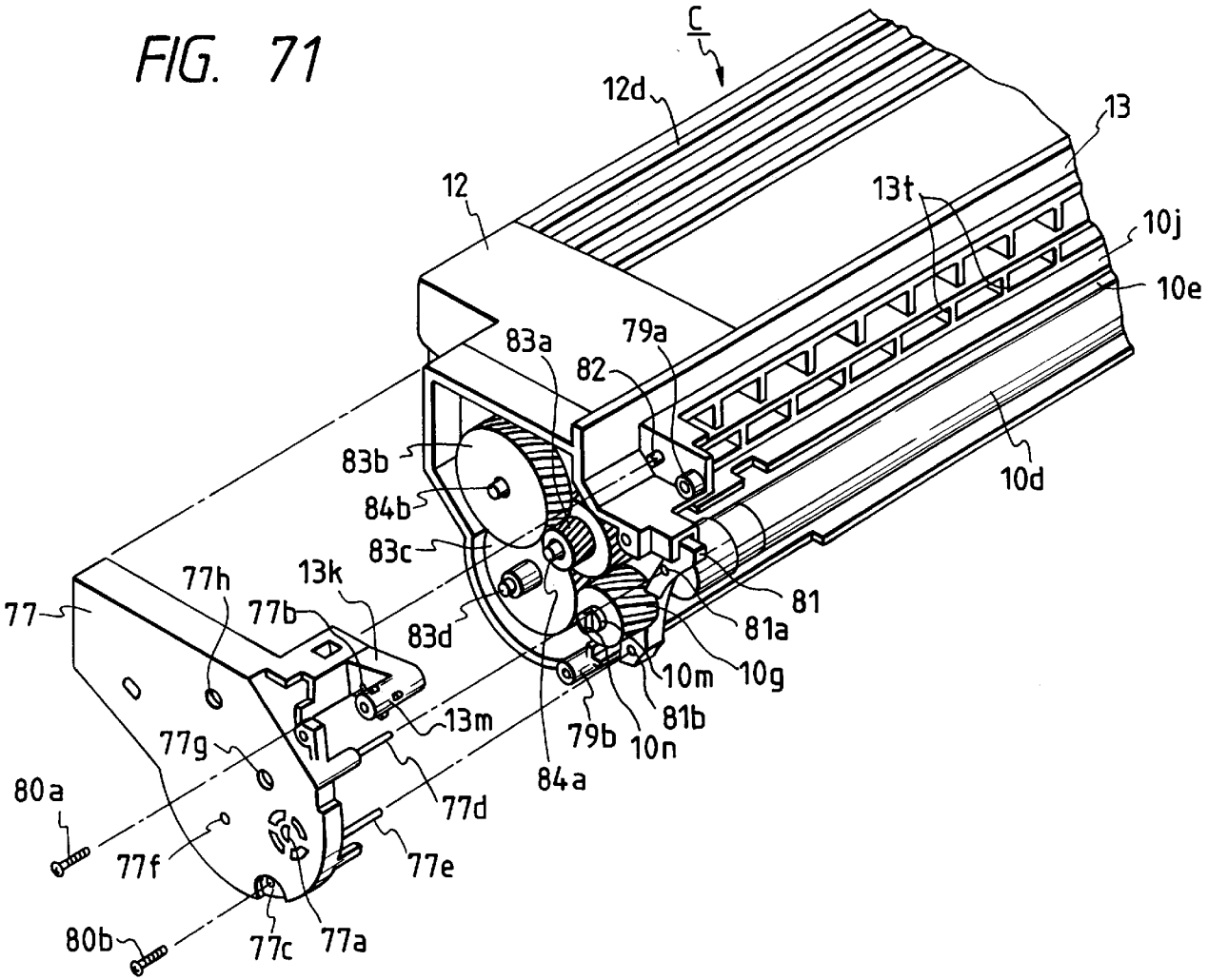
FIG. 71 is a perspective view for explaining a method for disassembling a first support member from the toner developing frame.

Then, both longitudinal end portions of the toner developing frame C are disassembled. In FIG. 71, the first support member 77 is positioned across the side surfaces of the toner frame 12 and the developing frame 13 which are integrally connected to each other, thereby covering the drive transmitting gear train 83 for transmitting the driving force to the toner feed member 10*b* of the developing means 10. Thus, the first support member also acts as an outer frame. Further, in FIG. 73, the second support member 78 covers a side surface of the developing frame 13. Thus, this second support member also acts as an outer frame. The first and second support frames 77, 78 have the locking holes 77*a*, 78*a* for fittingly receiving locking portions 10*n* formed on the free ends of the shaft portions 10*m* of the magnet 10*c* arranged within the developing sleeve 10*d*, thereby supporting the shaft portions.

In order to disassemble the first support member 77, as shown in FIG. 71, screws 80*a*, 80*b* threaded in a threaded hole 77*p* formed in the arm portion 13*k*, a threaded hole 77*c* formed in a lower portion of the first support member and corresponding threaded holes 79*a*, 79*b* formed in the toner developing frame C are unscrewed. Then, pins 77*d*, 77*e* protruding from on an inner surface of the first support member 77 are drawn from pin holes 81*a*, 81*b* formed in the first support piece 81 supporting the sleeve flange 10*p*. Similarly, the first support member is disengaged from a boss 82 of the toner developing frame C, the locking hole 77*a* is disengaged from the locking portion 10*n*, and a fitting hole 77*f* is disengaged from a gear shaft 83*d*. In this way, the first support member 77 is removed from the toner developing frame C.

Incidentally, the pins 77*d*, 77*e* are formed on the first support member 77 at positions corresponding to the pin holes 81*a*, 81*b* of the support piece 81 when the first support piece 81 is attached to the predetermined position. Further, the threaded holes 79*a*, 79*b* are formed in the toner developing frame C at position corresponding to the threaded holes 77*b*, 77*c* of the first support member 77. Thus, the first support member 77 is secured to the toner developing frame C by tightening the screws 80*a*, 80*b* to the frame through the support member, and the first support piece 81 is positioned with respect to the toner developing frame C by inserting the pins 77*d*, 77*e* into the pin holes of the support piece.

Further, the connecting projection 13*m* is integrally molded with an end of the arm portion 13*k* of the first support member 77, which projection is to be fitted into the connecting recess 14*g* of the cleaning frame 14.

Furthermore, the drive transmitting gear train 83 comprises four helical gears meshed with each other and having different diameters. More specifically, the gear train includes a gear 10*g* fitted on the sleeve flange 10*p* arranged on the end of the developing sleeve 10*d*, gears 83*a*, 83*b* attached to and fitted on shafts 84*a*, 84*b* protruding from the toner frame, and a gear 83*c* connected to the end of the toner feed member 10*b* via a fitting portion 84*c*. The gear 10*g* is meshed with the helical gear 7*c* fitted on the end of the photosensitive drum 7 held by the cleaning frame 14. Thus, the rotational force of the photosensitive drum 7 is transmitted to the toner feed member 10*b* via the gears 10*g*, 83*a*, 83*c* and the gear 83*c*, thereby driving the toner feed member 10*b*. Incidentally, as shown in FIG. 72, the gears 83*a*, 83*b*, 83*c* can easily be removed by drawing them from the shafts 84*a*, 84*b* and the fitting portion 84*c*, respectively.

Figure 72:
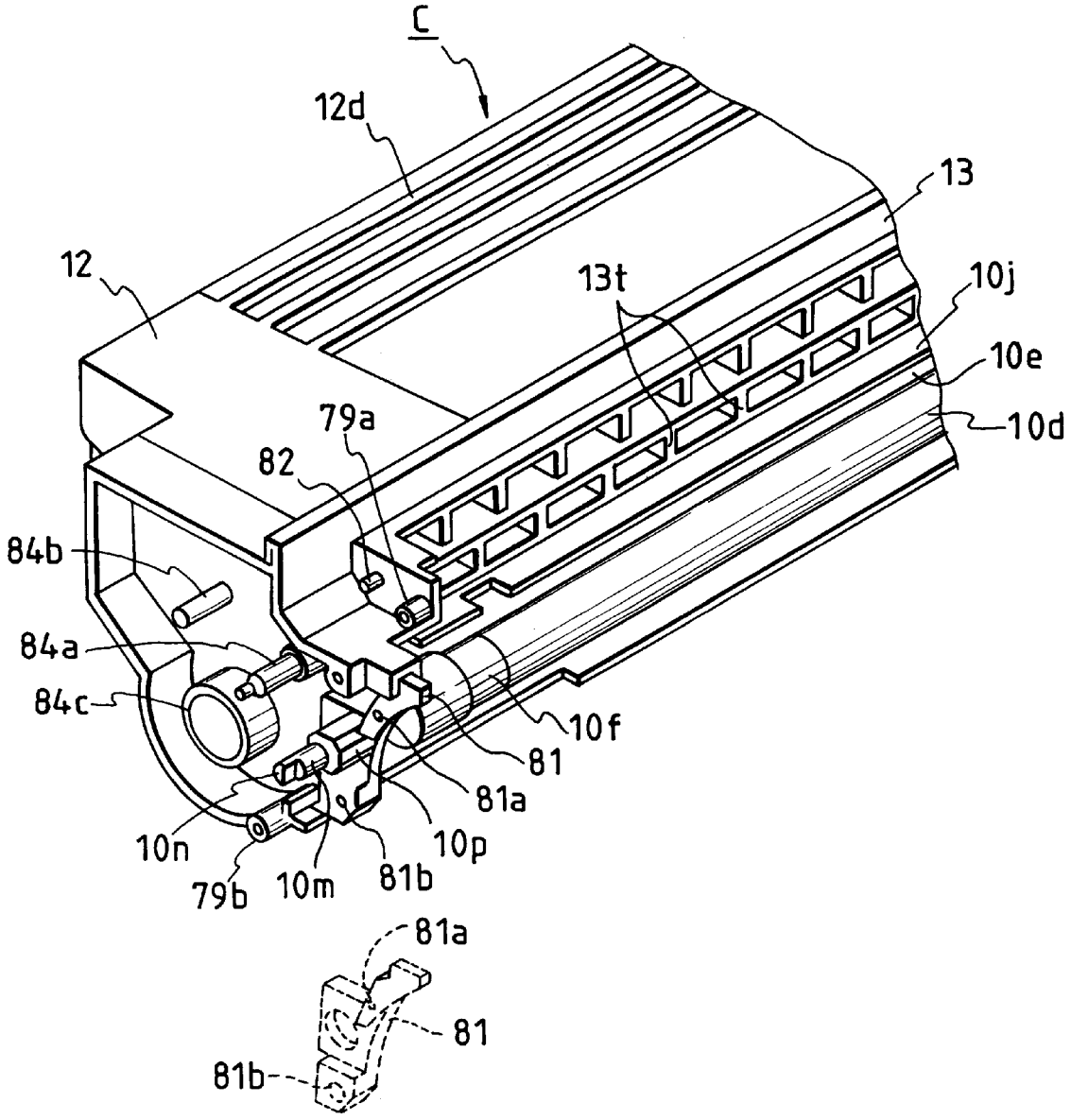
FIG. 72 is a perspective view of the toner developing frame from which a gear train was disassembled.

Further, as shown in FIG. 72, the first support piece 81 can be removed from the developing frame 13 by rotating the support piece freely supported on the sleeve flange 10*p* in a clockwise direction after the gear 10*g* fitted on the sleeve flange 10*p* integrally fitted on the end of the developing sleeve 10*d* is removed.

Figure 73:
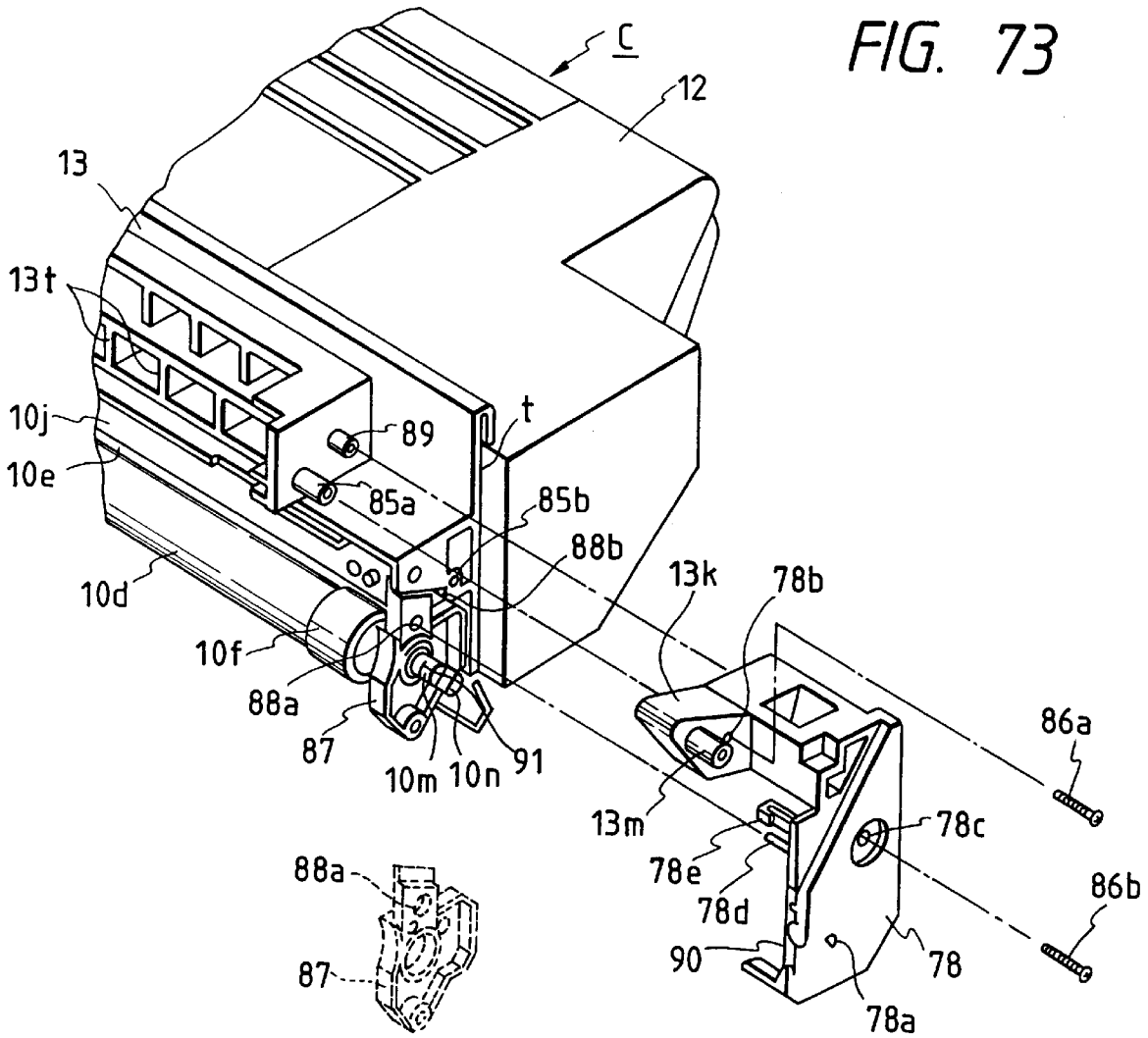
FIG. 73 is a perspective view for explaining a method for disassembling a second support member from the developing frame.

Next, in order to remove the second support member 78, as shown in FIG. 73, screws 86*a*, 86*b* threaded into a threaded hole 78*b* formed in the arm portion 13*k*, a threaded hole 78*c* formed in a central portion of the second support member and corresponding threaded holes 85*a*, 85*b* formed in the developing frame 13 are unscrewed. Then, a pin 78*d* protruding from an inner surface of the second support member 78 is drawn from a pin hole 88*a* formed in the second support piece 87 supporting the sleeve flange 10*p*, and a projection 78*e* protruding from the inner surface of the second support member 78 is drawn from a space 88*b*. Further, the second support member is disengaged from a boss 89 of the developing frame 13 and the locking hole 78*a* is disengaged from the locking portion 10*n*. In this way, the second support member 78 can be removed from the side surface of the toner developing frame C.

Incidentally, the pin 78*d* is formed on the second support member 78 in a position corresponding to the pin hole 88*a* of the second support piece 87 when the second support piece 87 is attached to the predetermined position. Thus, the second support piece 87 is positioned with respect to the toner developing frame C by inserting the pin 78*d* into the pin hole of the second support piece. Further, the connecting projection for fitting the toner developing frame C into the connecting recess 14*g* of the cleaning frame 14 is integrally molded with the end of the arm portion 13*k*.

Furthermore, an electrode 90 for applying the developing bias to the developing sleeve 10*d* is arranged on the inner surface of the second support member 78 around the locking hole 78*a*. Thus, by removing the second support member 78, the electrode 90 is disengaged from a contact piece 91 of the developing sleeve 10*d*.

As shown in FIG. 73, the second support piece 87 is freely mounted on the sleeve flange 10*p* integrally fitted on the end of the developing sleeve 10*d*. Accordingly, the second support piece can be removed from the developing frame 13 by rotating the second support piece 87 in an anti-clockwise direction. That is to say, the sleeve flange 10*p* arranged on one end of the developing sleeve 10*d* is rotatably supported by the first support piece 81, and the other sleeve flange 10*p* is rotatably supported by the second support piece 87.

In this way, since the sleeve flanges 10*p* are supported by the first and second support pieces 81, 87 so that the sleeve flanges can be rotated together with the developing sleeve 10*d*, such support pieces may be made of anti-wear material such as polyacetal resin, polybutylene terephthalate or the like. Further, since the first and second support members 77, 78 serve to securely support the shaft portions 10*m* connected to the magnet 10*c* and do not support any rotating element, such support members are not always made of anti-wear material in consideration of the manufacturing cost. Thus, in this embodiment, such support members are made of polystyrene resin which is cheaper than the anti-wear material. That is to say, in this embodiment, since the first and second support pieces 81, 87 are formed as elements different from the first and second support members 77, 78 and are made of material different from that of the first and second support members 77, 78, the manufacturing cost can be reduced and the assembling operability can be improved.

Thereafter, the developing sleeve 10*d* (both shaft portions 10*m* thereof are released) is removed in a direction perpendicular to the axial direction. Then, screws 92*a*, 92*b* threaded into threaded holes 13*u*, 13*v* of the blade attachment surface 13*f* of the developing frame 13 and corresponding threaded holes 10*q*, 10*r* of the blade attachment member 10*j* are unscrewed. A notched portion 10*s* and a fitting hole 10*t* engaged by left and right positioning bosses 13*g* of the blade attachment surface 13*f* of the developing frame 13 are released from the bosses, thereby removing the developing blade 10*e* from the developing frame 13. In this way, the disassembling operation is finished.

Consequently, the opening 13*a* of the toner developing frame C containing the antenna line 27 and the toner feed member 10*b* can be opened. Incidentally, regarding the above-mentioned disassembling operation, while an example that the second support member 78 is removed after the first support member 77 is removed was explained, the second support frame may be removed before the first support member, or the first and second support members may be removed simultaneously when the disassembling operation is automized. In a disassembling operation which will be described later, the first support member may be removed before the second support member or vice versa, or the first and second support members may be removed simultaneously.

Figure 75:
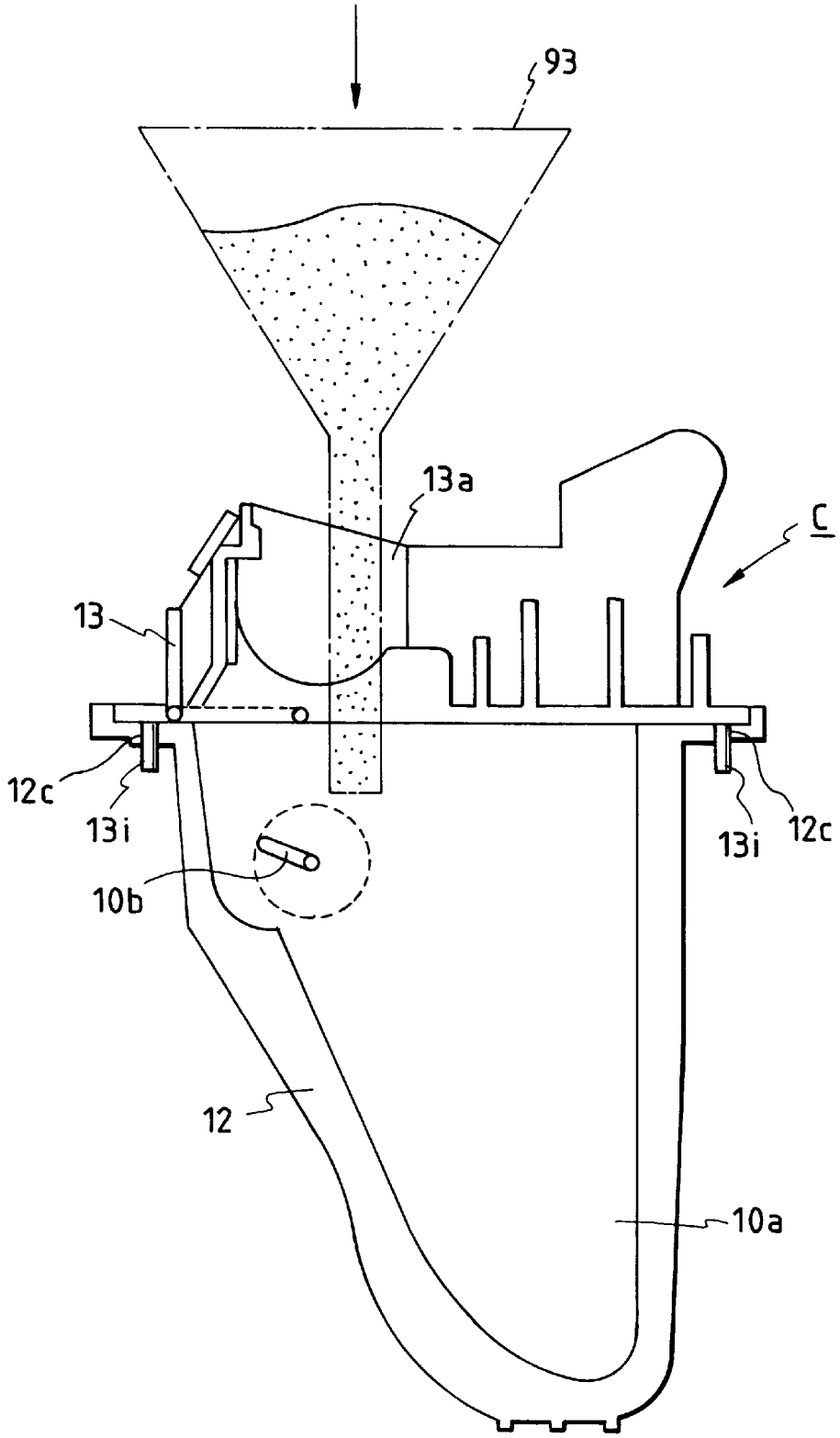
FIG. 75 is a view showing a condition that toner is replenished to the toner developing frame.

(2) Replenishment of toner:

Next, the toner is replenished to the toner developing frame C which was disassembled. In the replenishment of the toner, as shown in FIG. 75, the toner developing frame C is positioned so that the opening 13*a* is oriented upwardly, and a free end of a funnel 93 is inserted into the toner reservoir 10*a* through the opening 13*a*. Then, as shown by the arrow in FIG. 75, new toner is poured into the funnel 93 to fill the toner reservoir 10*a* with the toner. Incidentally, in the replenishment of the toner, it is not limited to the usage of the funnel 93, but any instruments which can replenish the toner to the toner reservoir 10*a* smoothly without leakage of toner can be used. For example, a mechanism capable of automatically injecting a predetermined amount of toner from a nozzle to the toner reservoir to automize the replenishing operation can be used.

(3) Attachment of the cover film:

Then, after the toner is replenished, the opening 12*a* of the toner frame 12 is closed by the cover film 28. Now, a method for attaching the cover film to the opening of the toner frame will be explained. As shown in FIG. 76B, the cover film 28 is wound around both surfaces of a thin stainless plate 94 having a thickness thinner than about 1 mm. An adhesive layer 28*a* is provided on one surface of the cover film 28, and a peel sheet 28*b* is provided on the adhesive layer 28*a*. The peel sheet 28*b* covers the adhesive layer 28*a* so that it is not peeled from the adhesive layer when it is attached to the adhesive layer, and the peel sheet is turned around a tip end 94*a* of the thin plate 94 to overlap with a portion of the peel sheet covering the adhesive layer 28*a*.

Figure 76A:
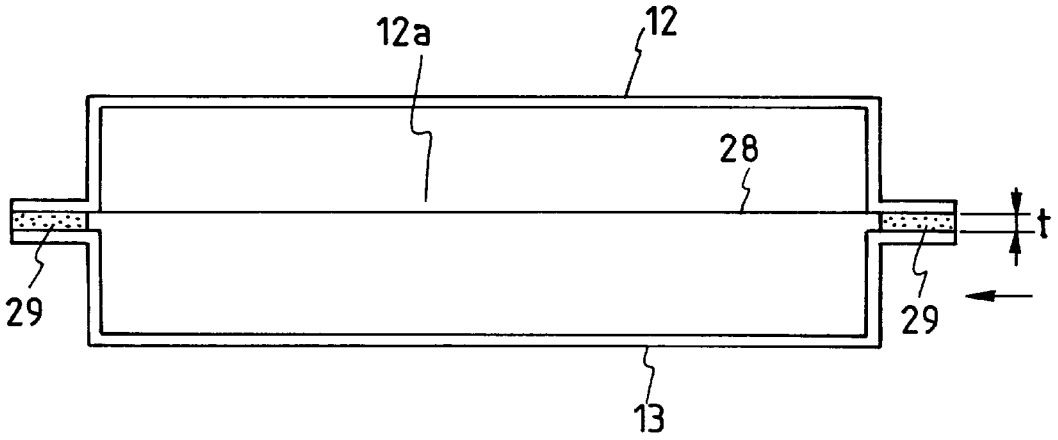
FIG. 76A is a sectional view of a cover film attached to the toner developing frame.
Figure 76B:
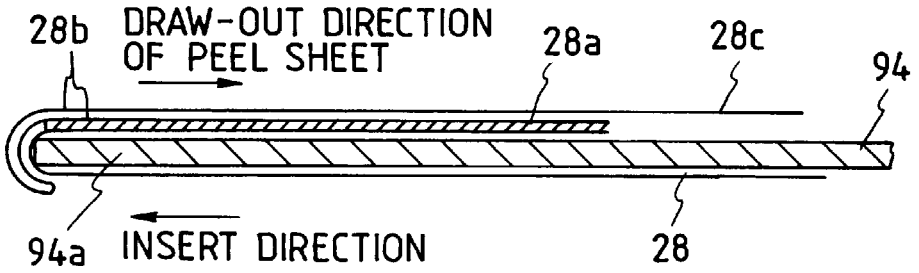
FIG. 76B is an explanatory view for explaining a method for attaching the cover film to the toner developing frame.

Then, as shown in FIG. 76A, the tip end 94*a* of the thin plate 94 holding the film 28 and the peel sheet 28*b* is inserted from a gap t (=about 1 mm) between the toner frame 12 and the developing frame 13 (in a widthwise direction) while compressing the toner leak preventing seals (made of sponge) 29, thereby closing the opening 12*a*. Now, the attaching process of the cover film 28 which is effected between the disassembling/cleaning of the toner developing frame C and the assembling of the developing sleeve 10*d* will be explained concretely with reference to FIG. 77.

Figure 77A:
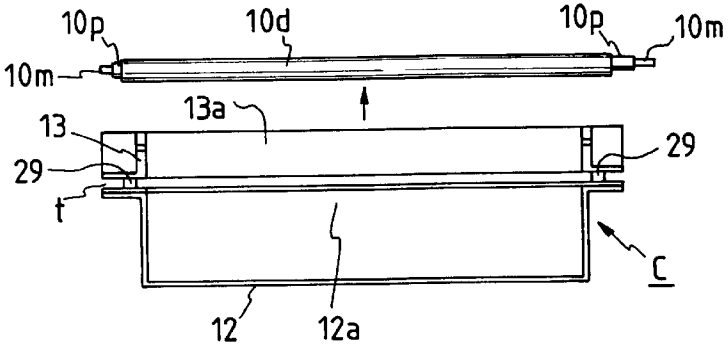
FIGS. 77A to 77F are explanatory views showing processes for attaching the cover film to the toner developing frame.

First of all, as shown in FIG. 77A, as mentioned above, the developing sleeve 10*d* is disassembled from the toner developing frame C. Then, the residual toner remaining in the interior of the opening 13*a* of the developing frame 13, the interior of the opening 12*a* of the toner frame 12 communicated with the opening 13*a*, and the toner reservoir 10*a* communicated with the opening 12*a* is removed by an air gun and the like.

Figure 77B:
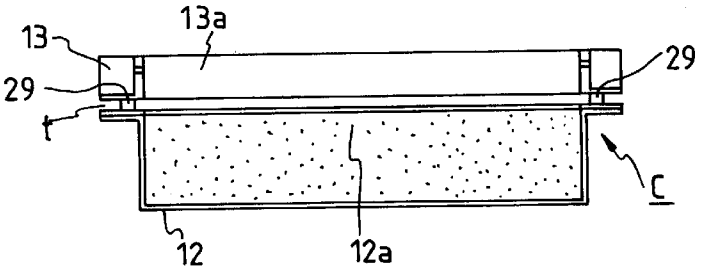
Figure 77C:
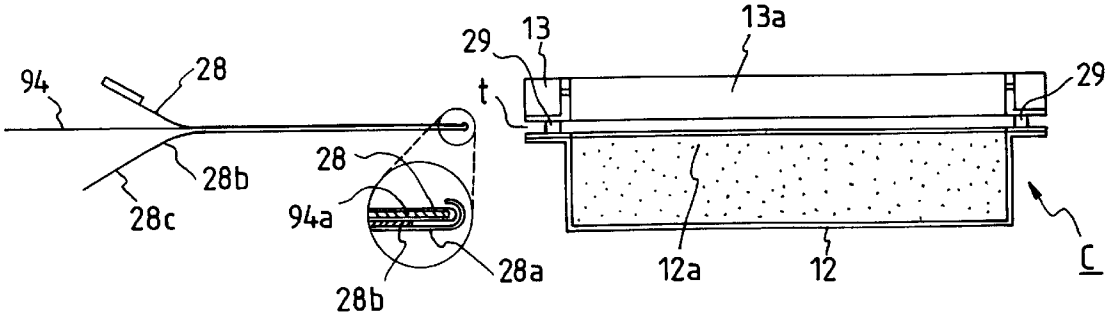

Then, as shown in FIG. 77B, by the above-mentioned process (2) (replenishment of toner), the toner is replenished to the toner reservoir 10*a* through the opening 13*a*. Then, as shown in FIG. 77C, the cover film 28 wound around the tip end 94*a* of the thin plate 94 is prepared. In the illustrated embodiment, the thin plate 94 was formed from a plate made of SUS (stainless steel) having a width of 40 mm, a length of 50 mm and a thickness of 0.3 mm. Of course, the thin plate is not limited to this, but any thin plate may be used.

Figure 77D:
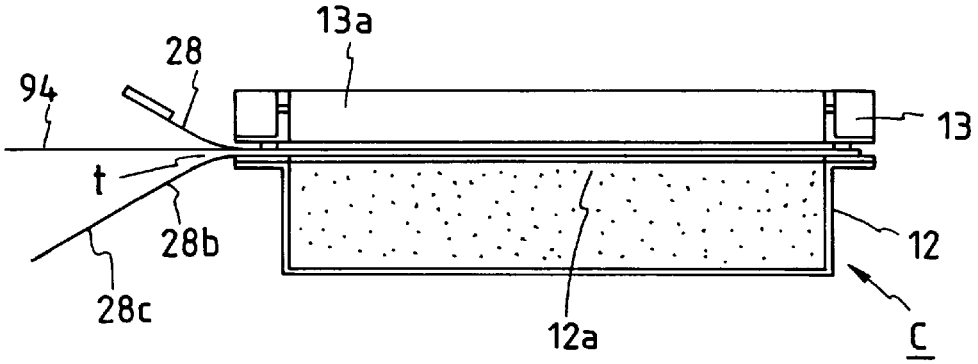
Figure 78:
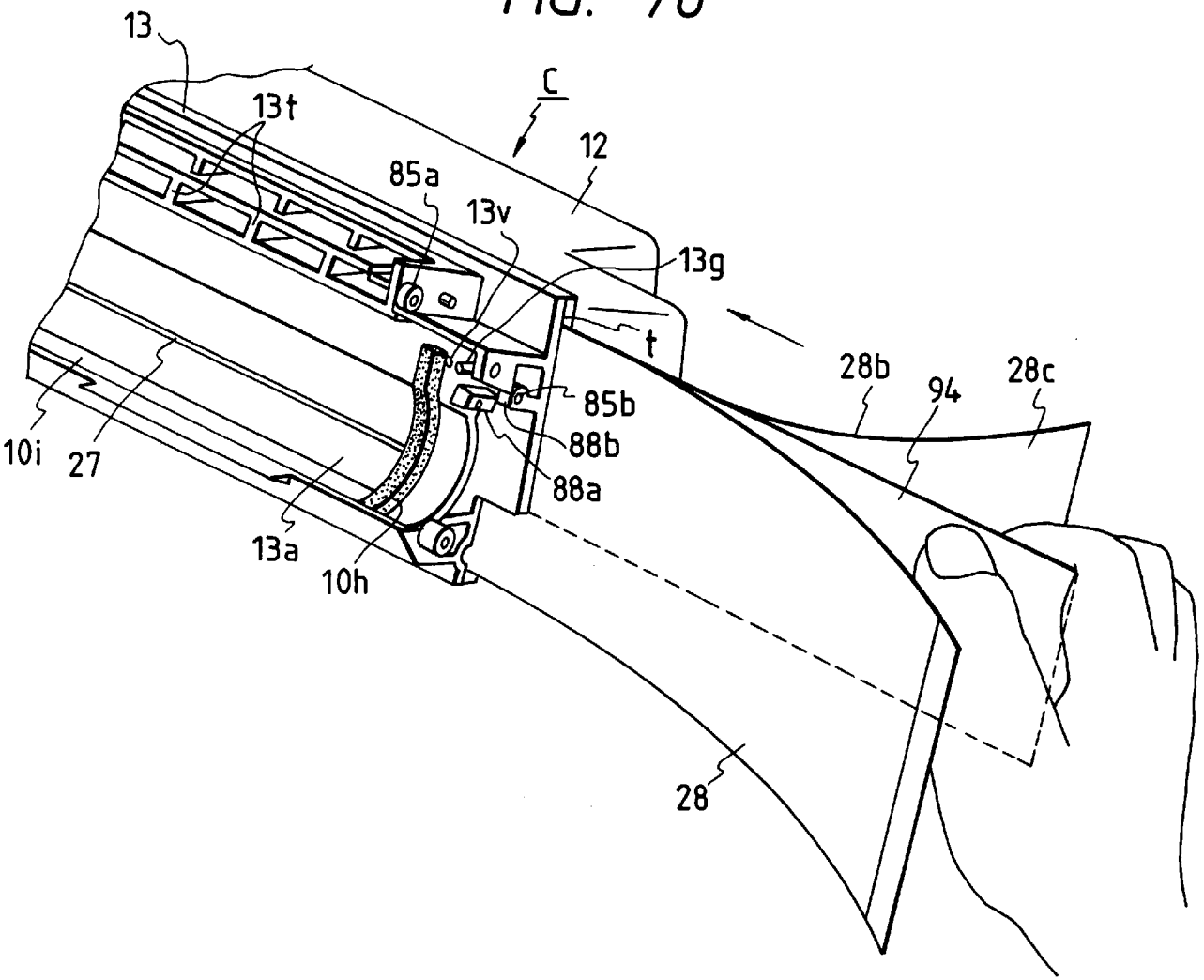
FIG. 78 is a perspective view for explaining a method for attaching the cover film to the toner developing frame.

Then, as shown in FIG. 78, the thin plate 94 around which the cover film 28 is wound is gripped by an operator and is inserted from the clearance t formed in the side (left side in FIG. 78) to which the second support member 78 is to be attached. That is to say, as shown in FIG. 77D, the tip end 94*a* of the thin plate 94 is inserted by the operator into a mid portion between the toner leak preventing seal 29 and the toner frame 12 near the first support member 77 through a space between the toner leak preventing seal 29 and the toner frame 12 near the second support member 78 and the opening 12*a*. Incidentally, in this case, the upper portion of the peel sheet 28*b* bent around the tip end 94*a* of the thin plate 94 is returned toward the adhesive layer 28*a* before the thin plate reaches between the toner leak preventing seal 29 and the toner frame 12.

Figure 77E:
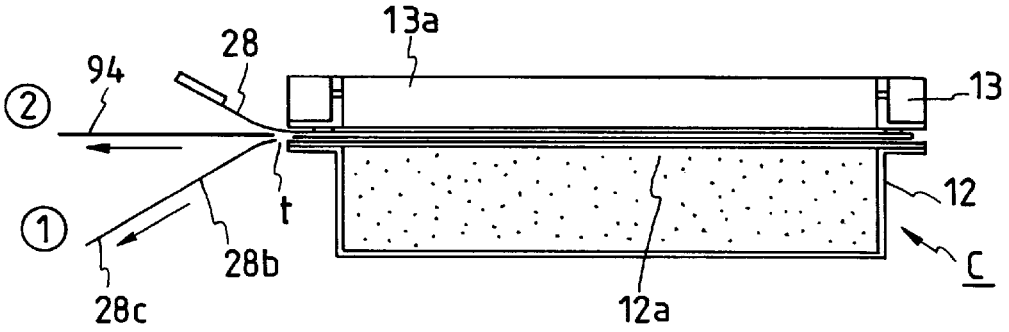

After the thin plate 94 is inserted between the toner leak preventing seal 29 and the toner frame 12 in the way, as shown in FIG. 77E, the peel sheet 28*b* is drawn through the clearance t by gripping an end 28*c* of the sheet without drawing the cover film 28. As a result, the peel sheet 28*b* is peeled from the adhesive layer 28*a* and the adhesive layer 28*a* is gradually adhered around the opening 12*a* by the urging force of the thin plate 94. Then, the thin plate 94 is completely drawn from the clearance t. In this way, the attachment of the cover film sealing the opening 12*a* is completed. Incidentally, when the peel sheet 28*b* is drawn, since the free end of the bent portion of the peel sheet is positioned above the adhesive layer 28*a*, the bent portion can be drawn smoothly.

Figure 77F:
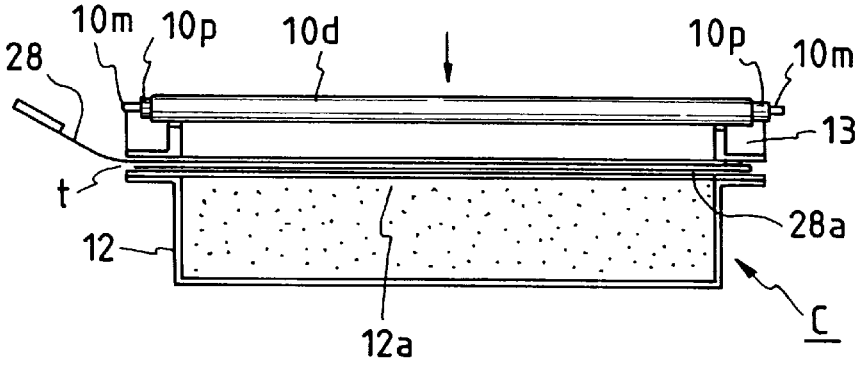

Then, as shown in FIG. 77F, the developing sleeve 10*d* is assembled to the toner developing frame C. This operation will be fully described later in connection with the re-assembling of the process cartridge B (4).

Incidentally, the toner leak preventing seal 29 provided between the toner frame 12 and the developing frame 13 in the widthwise direction is made of sponge and normally has a thickness of about 2 mm. This seal is compressed by inserting it into the clearance t of about 1 mm and by further inserting the seal 28 into the clearance, with the result that the seal condition is effectively maintained by the restoring force of the sponge. Further, the thin plate 94 is not limited to the metallic plate such as the stainless steel plate, but may be made of any material having moderate rigidity, such as plastics. In addition, the cover film 28 used in this embodiment can be made of polyester, OPP, non-woven fabric or the like and is in the form of an elongated sheet having a thickness of about 50 to 150 $\mu$m (standard value of 100 $\mu$m).

Next, another embodiment regarding a method for attaching the cover film 28 will be explained with reference to FIGS. 79A to 79D. Incidentally, since FIG. 79A shows disassembling/cleaning, FIG. 79B shows toner replenishment and FIG. 79C shows assembling are the same as the processes shown in FIGS. 77A, 77B and 77E, these Figures are referred to, and the same elements are designated by the same reference numerals.

Figure 79A:
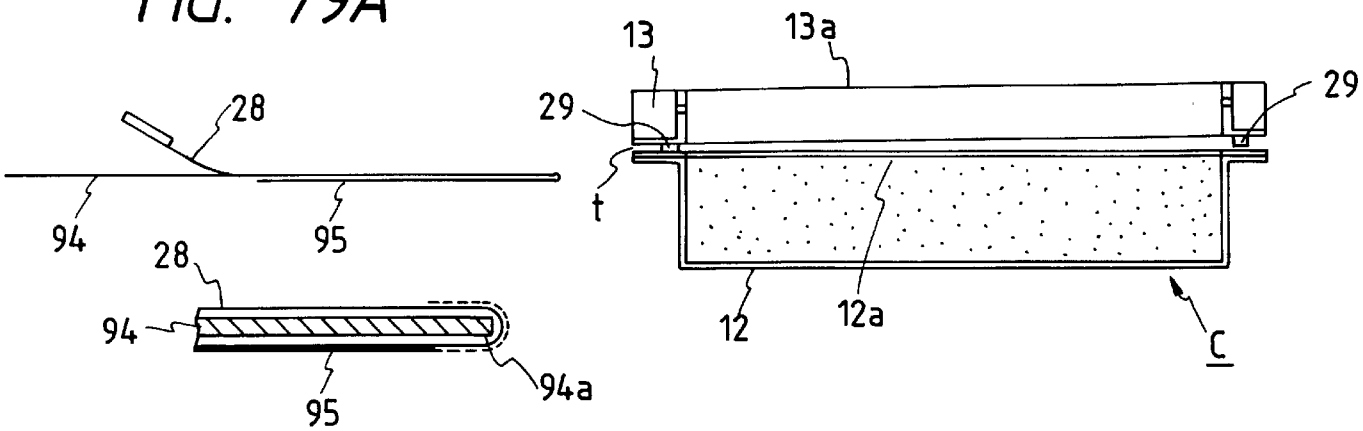
FIGS. 79A to 79D are explanatory views showing processes for attaching a cover film to a toner developing frame, according to another embodiment.
Figure 79B:
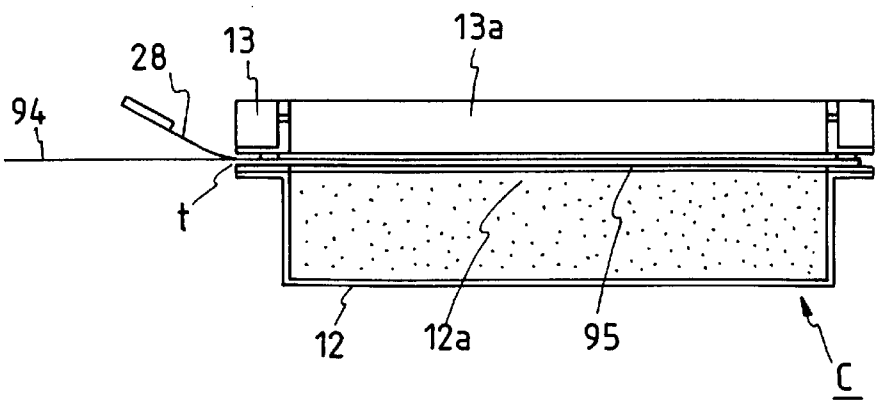
Figure 79C:
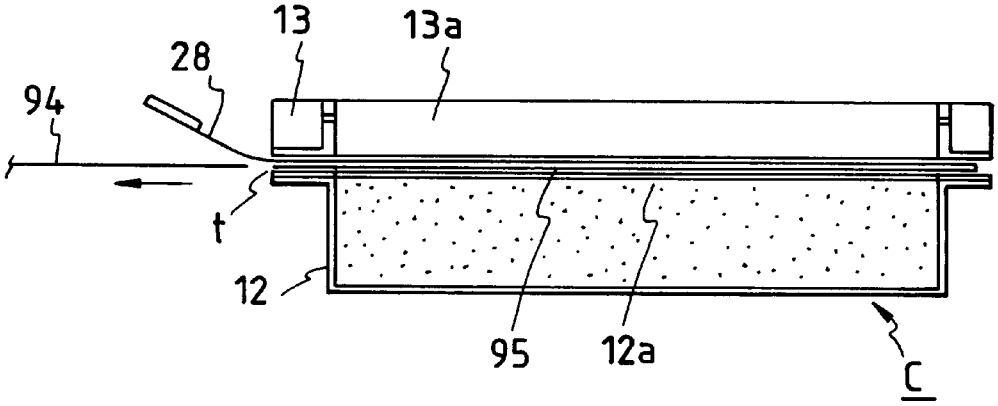

First of all, as shown in FIG. 79A, the developing sleeve 10*d* is disassembled from the toner developing frame C, and the toner developing frame C is cleaned. Then, as shown in FIG. 79B new toner is replenished to the toner developing frame C (refer to FIGS. 77A and 77B).

Then, as shown in FIG. 79A, the cover film 28 wound around the tip end 94*a* of the thin plate 94 is prepared. In this embodiment, similar to FIGS. 77A to 77F, the cover film 28 is held on both surfaces of the thin plate 94. Hot melt 95 is coated on one surface (lower surface) of the cover film 28 up to the proximity of the tip end 94*a* of the thin plate 94 (refer to the thick line in FIG. 79A). The hot melt 95 is molten to act as adhesive when it is heated to about 40 to 80° C. However, under the room temperature, the hot melt has a solid form having a smooth surface. Thus, preferably, as shown by the dot line in FIG. 79A, by coating the hot melt 95 on the cover film 28 exceeding the tip end 94*a* of the thin plate 94, the smoothness of the cover film is improved to facilitate the insertion of the cover film into the clearance t. Incidentally, the hot melt 95 can be made of thermoplastic resin such as nylon group, polyester group, polyolefin group, ethylene vinyl acetate or the like.

Then, the thin plate 94 with the cover film 28 is inserted into a clearance t formed at a side to which the second support member 78 is attached. That is to say, as shown in FIG. 79B, the tip end 94*a* of the thin plate 94 is passed between the toner leak preventing seal 29 and the toner frame 12 (at the side of the second support member 78) and is inserted between the toner leak preventing seal 29 and the toner frame 12 (at the side of the first support member 77) in the way across the opening 12*a*.

Then, as shown in FIG. 79C, the thin plate 94 is completely drawn from the clearance t. In this case, the cover film 28 is held in a condition that the film portion coated by the hot melt 95 is overlapped with the bent film portion (not coated by the hot melt). That is to say, both end portion of the cover film 28 are held by the restoring force of the toner leak preventing seals (made of sponge) 29 disposed between the toner frame 12 and the developing frame 13 in the widthwise direction.

Figure 79D:
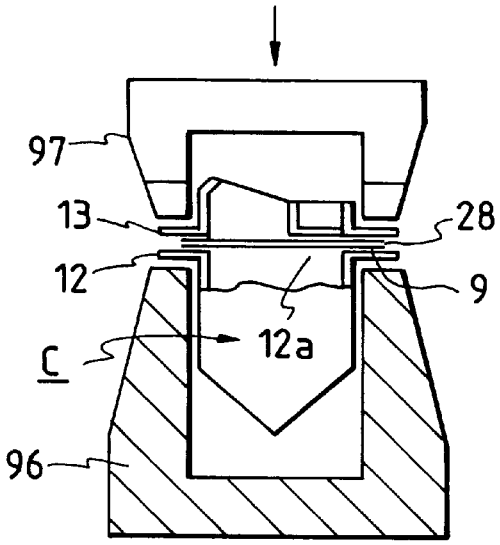

Then, as shown in FIG. 79D, the toner developing frame C is rested on a support base 96 in such a manner that the both longitudinal junction between the toner frame 12 and the developing frame 13 are supported, with the toner frame 12 facing downwardly. Then, the cover film 28 with the hot melt 95 is heated up to about 40 to 80° C. by a heating device 97. Consequently, the heat is transmitted to the toner frame 12 via the developing frame 13, thereby melting the hot melt 95 to obtain the adhesive, with the result that the cover film is adhered around the opening 12*a* of the toner frame 12. In this way, the opening 12*a* is completely sealed by the cover film 28.

Then, as shown in FIG. 79C the developing sleeve 10*d* is assembled to the toner developing frame C (refer to FIG. 77F).

According to this embodiment, the construction of the cover film 28 can be simplified. That is to say, since the peel sheet can be omitted, the operability for attaching the cover film 28 is remarkably improved.

Figure 74:
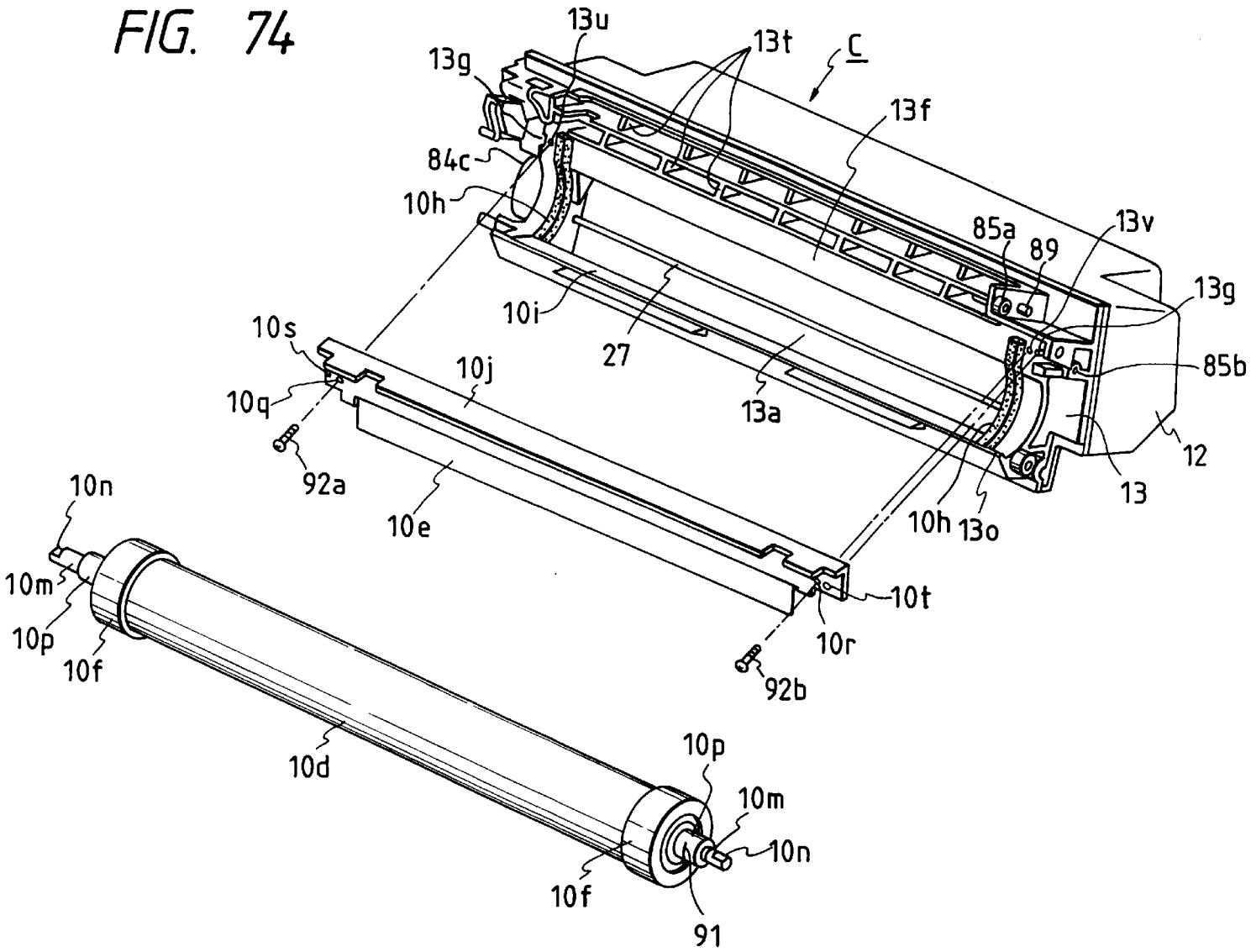
FIG. 74 is a perspective view of the developing frame from which a developing sleeve and a developing blade were disassembled.

(4) Assembling of the process cartridge B:

As mentioned above, after the new toner is replenished to the toner reservoir 10*a* and the opening 12*a* of the toner frame 12 is covered and sealed by the cover film 28, the process cartridge B is re-assembled. In order to re-assemble the process cartridge B, the above-mentioned disassembling process (1) is performed in a reverse manner. That is to say, as shown in FIG. 74, the developing blade 10*e* is attached by securing the blade attachment member 10*j* to the blade attachment surface 13*f* of the developing frame 13 by means of the screws. Thereafter, the developing sleeve 10*d* is arranged in the opening 13*a* so that both ends of the sleeve are abutted against the toner leak preventing seals 10*h*.

Then, as shown in FIG. 73, the second support piece 87 is fitted on the sleeve flange 10*p* of the developing sleeve 10*d* and is locked to the developing frame 13, and the locking portion 10*n* is fitted into the locking hole 78*a* of the second support member 78. Then, these elements are secured to each other by the screws.

Then, as shown in FIG. 72, the first support piece 81 is fitted on the sleeve flange 10*p* of the developing sleeve 10*d* and is locked to the developing frame 13, and the gear 10*g* is attached to the sleeve flange 10*p*. Further, the gears 83*a*, 83*b*, 83*c* are attached to the shafts 84*a*, 84*b* protruding from the toner frame 12 and the fitting portion 84*c*, respectively, and are meshed with each other. Then, the first support member 77 is attached by inserting the pins 77*d*, 77*e* into the pin holes 81*a*, 81*b* and by locking the locking portion 10*n* to the locking hole 77*a* and by fitting the gear shaft 83*d* into the fitting hole 77*f*. Then, the first support piece and the first support member are secured by the screws, thus assembling the toner developing frame C shown in FIG. 70.

Figure 80:
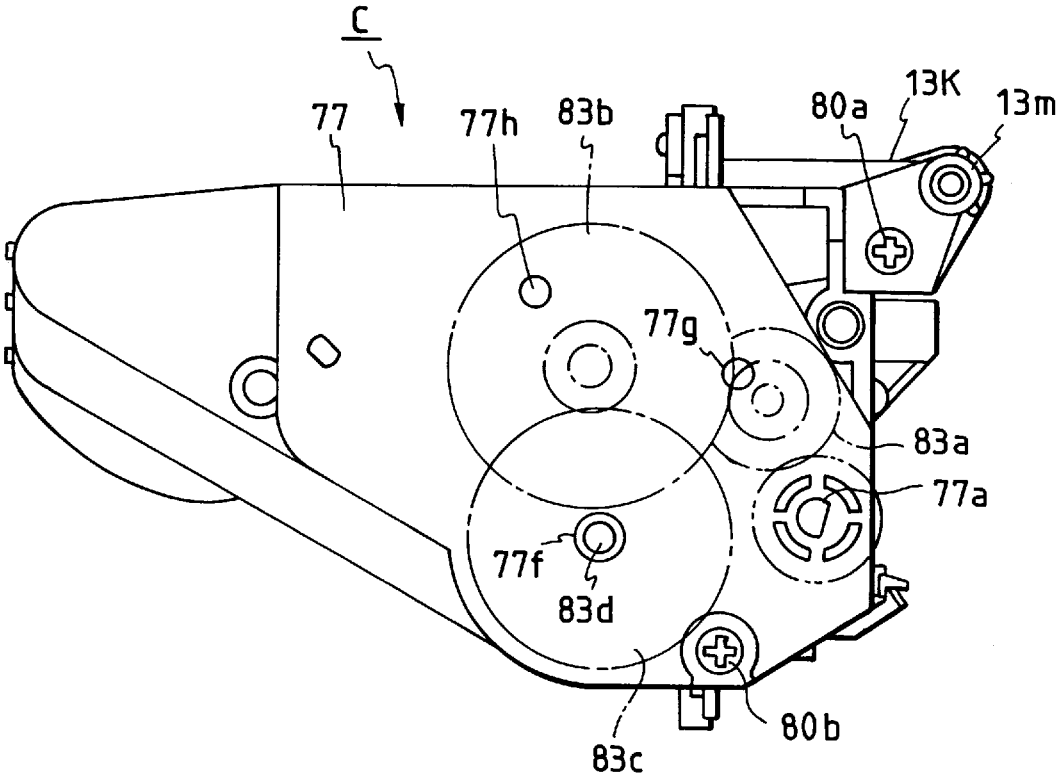
FIG. 80 is a view showing holes formed in the first support member.

In this embodiment, as shown in FIG. 80, holes 77*g*, 77*h* are formed in the first support member 77 in positions corresponding to the drive transmitting gear train 83. Thus, after the toner developing frame C is assembled, the operator can check whether the gears are correctly attached or not by directly observing the gears through these holes 77*g*, 77*h*. Further, if necessary, the rotating condition of the gears can be ascertained by manually rotating the gear 10*g* fitted on the sleeve flange 10*p* and by observing the gears through the holes 77*g*, 77*h*. Accordingly, the assembling operability can be improved remarkably.

Incidentally, only two holes 77*g*, 77*h* may be formed in the first support member 77 to minimize the entering of dust so long as the rotating condition of the gears can be observed by eyes, and the diameter of each hole may be about 2 to 10 mm and preferably about 5 mm. Further, the holes 77*g*, 77*h* are preferably provided at positions where the meshing condition of the gears and the gear itself can be observed. In this embodiment, the holes are provided at a position where the meshing condition of the gears 83*a*, 83*b* can be observed (i.e. a position opposed to the meshing area of the gears) and a position where the gear 83*b* can be observed (i.e. a position opposed to the gear 83*b*), respectively. Incidentally, it is not necessary to provide the above-mentioned holes. Further, when the holes are provided, the number, diameters and positions of the holes may be appropriately selected.

Then, the toner developing frame C is attached to the cleaning frame 14 by fitting the connecting projections 13*m* protruding from the first and second support members 77, 78 into the connecting recesses 14*g* of the cleaning frame 14. Then, the connecting member 38 is attached by fitting the spring 38*e* and the vertical portion 38*c* into the through hole 14*k* and the hole 14*i*, respectively, and by forcibly urging the base 38*a*. Then, by securing the base 38*a* by means of the screws, the connecting member and the base are secured to each other. In this way, the assembling of the process cartridge B is completed.

Incidentally, regarding the above-mentioned assembling operation, while an example that after the second support member 78 is assembled the first support member is assembled was explained, the first support member may be assembled before the second support member, or the first and second support members may be simultaneously assembled when the assembling operation is automized.

Further, in the illustrated embodiment, regarding the assembling of the process cartridge, while an example that the recycle is effected was explained, the present invention is not limited to this example, but the present invention can be applied to a case where a new process cartridge is assembled. Incidentally, in the illustrated embodiment, while an example that the toner is replenished through the opening 13*a* of the developing frame 13 after the developing sleeve 10*d* is disassembled was explained, a hole may be formed in the toner frame 12 at a position corresponding to the toner reservoir 10*a*, and the hole may be sealed by a seal after the toner is replenished to the toner reservoir through the hole. In this case, since the cover film 28 can be attached prior to the replenishment of toner, it is possible to further prevent the toner leakage during the replenishment of toner.

That is to say, when the toner is replenished to the toner reservoir 10*a* through the opening 13*a*, the toner is replenished before the cover film 28 is attached. On the other hand, if the hole is formed in the toner frame 12, the cover film can be attached before the toner is replenished.

Further, the above-mentioned numerical values are merely an example, but do not limit the present invention. In addition, the above-mentioned processes can be automized, for example, by using robots.

[Other Embodiments]

Next, other embodiments of various parts of the aforementioned process cartridge and image forming apparatus will be explained.

Figure 61:
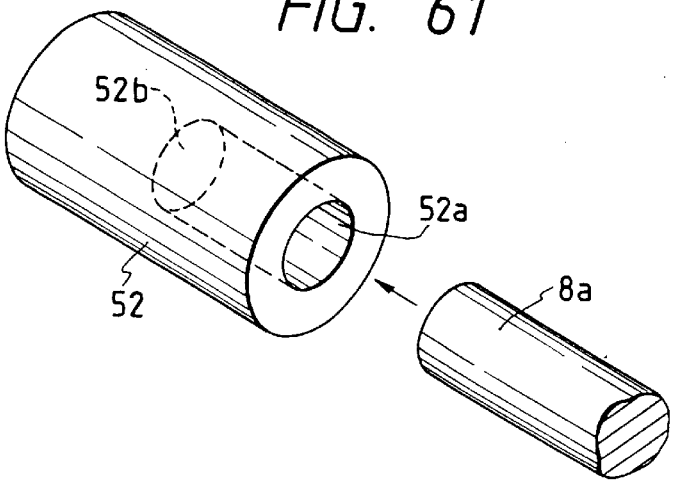
FIGS. 61 and 62 are views showing a bearing for a charger roller according to another embodiment.
Figure 62:
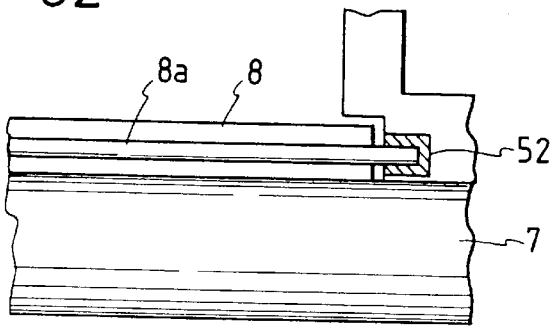

(Charger Means):

In the above-mentioned embodiment, while an example that the axial shifting movement of the charger roller 8 is regulated by abutting one end of the roller shaft 8*a* against the abutment portion 24*a* of the bearing 24 was explained, as another embodiment, as shown in FIGS. 61 and 62, one end of the roller shaft 8*a* may be supported by a bearing 52 having a cylindrical bore 52*a*. In this arrangement, when the roller shaft 8*a* is biased toward a direction shown by the arrow in FIG. 61, an end face of the roller shaft 8*a* is abutted against a bottom 52*b* of the bore 52, thereby positioning the roller shaft. Accordingly, this arrangement can achieve the same advantage as that of the previous embodiment. Incidentally, the bearing 52 is preferably formed from material such as polyacetal having the good sliding feature to the metal, similar to the bearing 24 in the previous embodiment.

Figure 63:
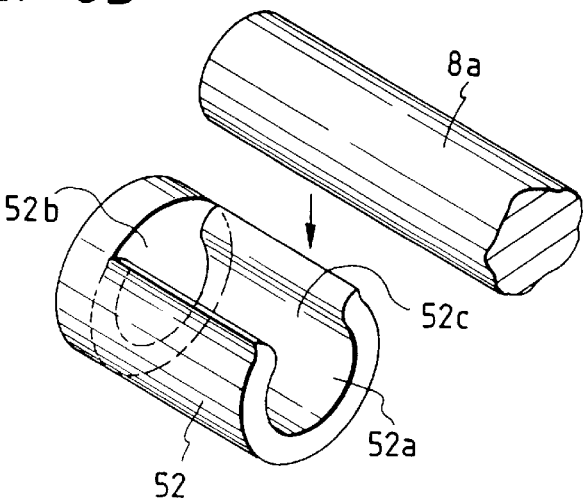
FIG. 63 is a perspective view of a bearing for a charger roller according to a further embodiment.

Further, as shown in FIG. 63, a side notch 52*c* may be formed in the bearing 52, and the roller shaft 8*a* may be forcibly inserted into the bearing while deforming the notch 52*c* elastically. With this arrangement, the assembling ability of the charger roller 8 is improved. Further, when the notch 52*c* is oriented to direct downwardly as the process cartridge B is mounted, even if a small amount of cutting debris remains in the cylindrical bore 52*a*, since such cutting debris drops through the notch 52*c* and is removed from the bore 52*a*, it is possible to stably rotate the roller shaft 8*a* in the bore 52*a*.

Further, in the aforementioned embodiments, while an example that one end of the roller shaft 8*a* is supported by the bearing 24 or bearing 52 was explained, the rotary shaft of the developing sleeve 10*d* and the like may be supported by the bearing 24 or 52.

Figure 64:
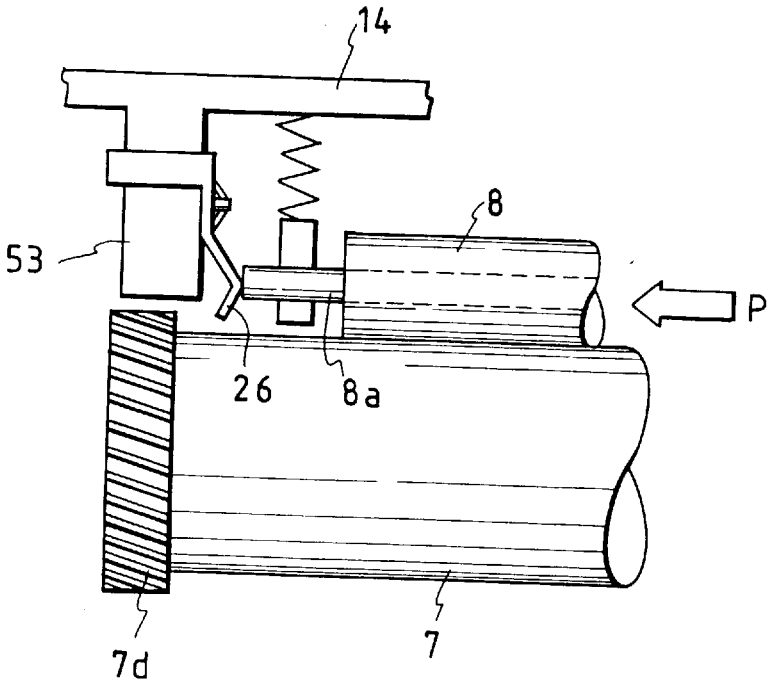
FIG. 64 is a view showing a mechanism for preventing the deformation of a contact member, according to another embodiment.

Furthermore, in the first embodiment, while the regulating member 14*b* was provided for preventing the plastic deformation of the contact member 26 when the roller shaft 8*a* was shifted, as another embodiment, as shown in FIG. 64, a rib 53 as a regulating member may be provided on the cleaning frame 14 and the contact member 26 may be secured to the rib 53 by heat caulking and the like. With this arrangement, even when the changer roller 8 is subjected to a force P shown by the arrow in FIG. 64, the contact member 26 is abutted against the rib 53, thereby preventing the further deformation of the contact member. Thus, in use, even if the cartridge B is dropped to generate the force P during the transportation of the cartridge, it is possible to prevent the damage of the contact member 26.

Figure 65:
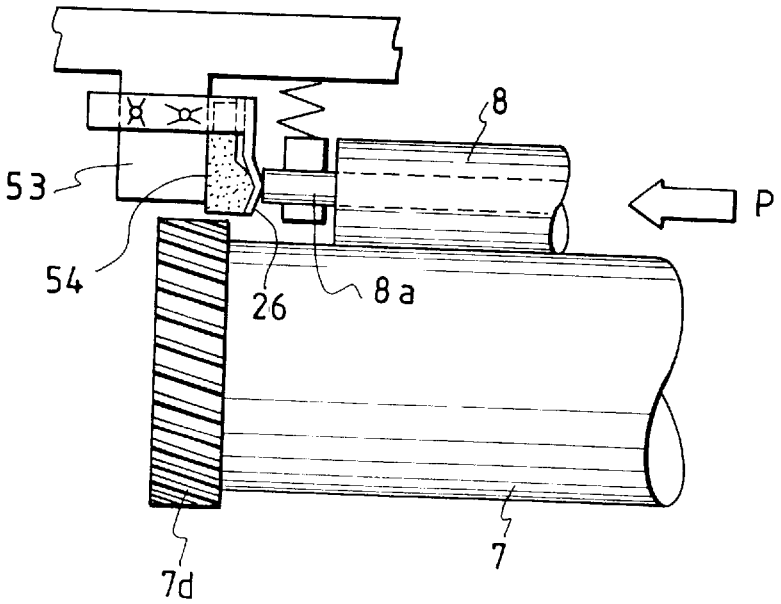
FIG. 65 is a view showing a mechanism for preventing the deformation of a contact member, according to a further embodiment.

Further, as shown in FIG. 65, a buffer 54 made of rubber or the like may be adhered to a side surface of the rib 53 by a both-sided adhesive tape so that the buffer is interposed between the rib 53 and the contact member 26. With this arrangement, even when the charger roller 8 is subjected to a force P shown by the arrow, the plastic deformation of the contact member 26 can be prevented by the buffer 54. Further, if the end portion of the contact member 26 is not contacted with an end face of the rotating roller shaft 8*a* in parallel, the contact member 26 will be eccentrically contacted with the end face of the roller shaft 8*a*, thus causing the vibration and/or noise. However, in this embodiment, since the buffer 54 is provided, the vibration can be suppressed, thereby preventing the generation of the noise.

Figure 66:
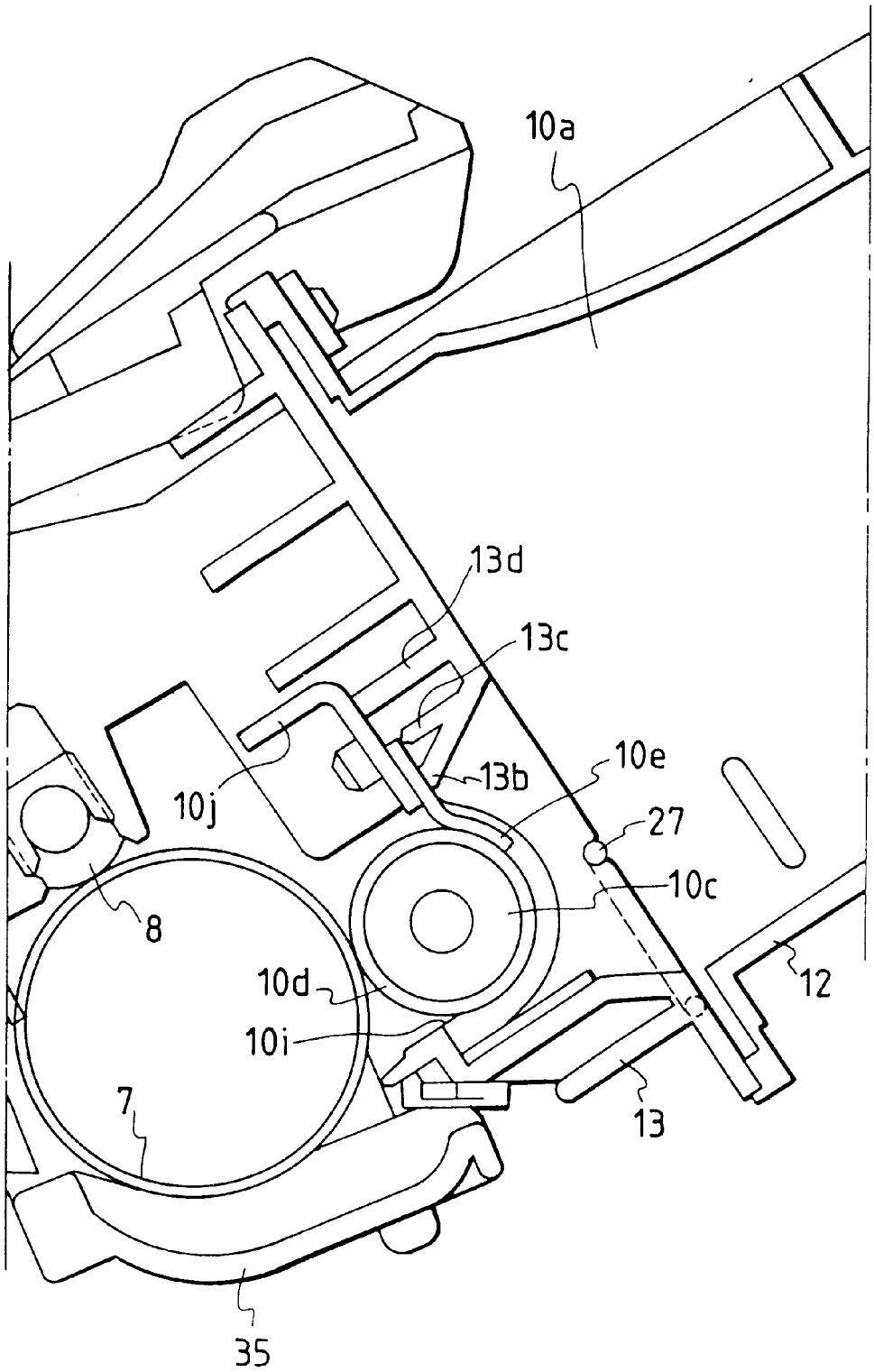
FIG. 66 is a view showing an embodiment wherein a second rib on a developing frame is sharpened.

(Developing Means):

In the aforementioned first embodiment, while the three ribs 13*b*, 13*c*, 13*d* were formed on the developing frame 13 and the sharp wedged end of the second rib 13*c* was penetrated into the developing blade 10*e* as shown in FIG. 15, the end of the second rib may not necessarily be wedged, and, as for example, shown in FIG. 66, the edge of the second rib 13*c* may be sharpened as an arrow shape, and the tip end of the rib 13*c* may be strongly urged against the developing blade 10*e*.

Figure 67A:
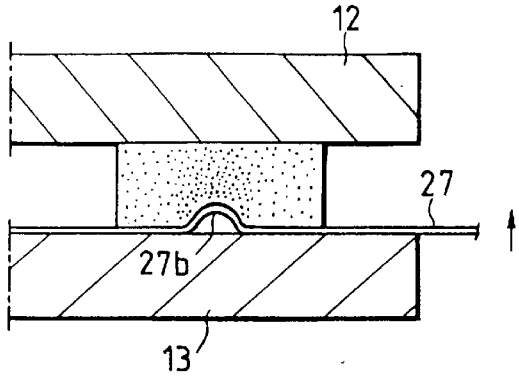
FIG. 67A is an explanatory view showing a condition that an antenna wire is bent to a semi-circular shape.
Figure 67B:
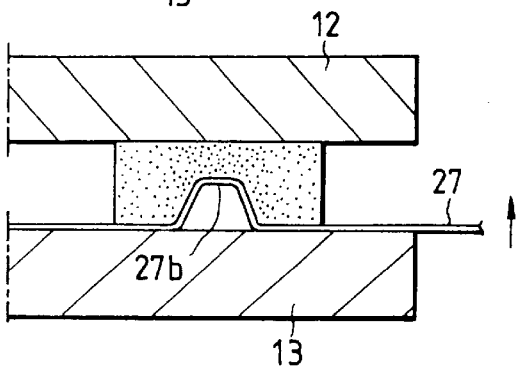
FIG. 67B is an explanatory view showing a condition that the antenna wire is bent to a trapezoidal shape.

Further, in the first embodiment, as shown in FIG. 18, the bent portion 27*b* was formed in the antenna line 27 so that the antenna line 27 did not float from the recessed portion 13*e* of the developing frame 13 when the shock is applied to the exposed portion of the antenna line 27. However, the configuration of the bent portion 27*b* is not limited to that shown in FIG. 18, but may be semi-circular as shown in FIG. 67A or trapezoidal as shown in FIG. 67B.

Figure 68:
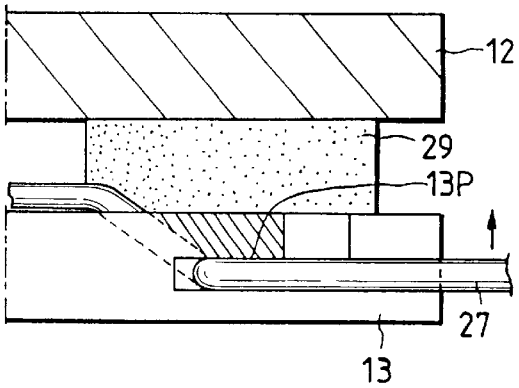
FIG. 68 is a view showing an embodiment wherein a cut-out is formed in a developer frame and the floating of an antenna wire is prevented by inserting the antenna wire into the cut-out.

Further, in order to prevent the floating of the antenna line 27, other than the provision of the bent portion 27*b*, as shown in FIG. 68, a cut-out 13*p* may be formed in the developing frame 13 and the antenna line 27 may be passed through the cut-out 13*p*. With this arrangement, even when the antenna line 27 is subjected to an external force shown by the arrow in FIG. 68, the antenna line 27 does not float from the developing frame 13, thereby preventing the generation of the clearance or gap between the developing frame 13 and the toner leak preventing seals 29.

Figure 69:
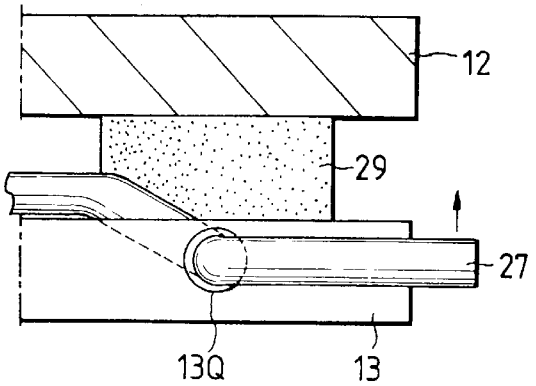
FIG. 69 is a view showing an embodiment wherein a round hole is formed in a developer frame and the floating of an antenna wire is prevented by inserting the antenna wire into the round hole.

Further, in place of the cut-out 13*p*, as shown in FIG. 69, a round bore 13*q* having a diameter which permits the passage of the antenna line 27 may be formed in the developing frame 13 and the antenna line 27 may be passed through the cylindrical bore 13*q*. Also with this arrangement, similar to the cut-out 13*p*, even when the antenna line 27 is subjected to an external force shown by the arrow in FIG. 69, the antenna line 27 does not float from the developing frame 13.

Further, in the first embodiment, while the positioning of the developing sleeve 10*d* in the rotational direction thereof was not explained, such positioning may be effected by abutting one end of the rotary shaft of the developing sleeve against a bearing member, similar to the charger roller 8, and the bearing member may be cylindrical as shown in FIGS. 61 to 63. In addition, when not only the developing sleeve 10*d* but also non-magnetic toner are used, the toner layer is formed on the developing sleeve 10*d* by a coating roller. In this case, the coating roller may be positioned by abutting one end of a roller shaft of the coating roller against a bearing member having the same construction as mentioned above.

(Cleaning Means):

In the aforementioned embodiment, as shown in FIGS. 12, 13A and 13B, while an example that the blow sheet 10*i* is overlapped with the toner leak preventing seals 10*h* was explained, the arrangement shown in FIGS. 12, 13A and 13B may be taken into consideration on the basis of the relation between the cleaning means (cleaning blade 11*a*, dip sheet 11*b*, toner leak preventing seals 11*e*) and the photosensitive drum 7. That is to say, the dip sheet 11*b* may be overlapped with the toner leak preventing seals 11*e* outwardly of both longitudinal ends of the cleaning blade 11*a*.

(Others):

The process cartridge according to the present invention can be suitably applied to form not only a mono-color image as mentioned above, but also a plural color image (for example, two-color image, three-color image or full-color image) by providing a plurality of developing means 10.

Further, as a developing method, a conventional two-component magnetic brush developing method, cascade developing method, touch-down developing method or cloud developing method may be used.

Further, regarding the charger means, in the first embodiment, while a so-called contact charging type was used, a conventional charging arrangement wherein three walls formed from tungsten wires are enclosed by a metal shield such as aluminium and positive or negative ions generated by applying high voltage to the tungsten wires are transferred onto the photosensitive drum 7 thereby to uniformly charge the surface of the photosensitive drum 7 may be used.

Incidentally, the charger means may be of blade (charger blade) type, pad type, block type, rod type or wire type, other than the aforementioned roller type.

Further, the cleaning means for cleaning the residual toner remaining on an image bearing member such as the photosensitive drum 7 may be constituted by a blade, a fur brush and/or a magnet brush.

Further, regarding the image bearing member, as a photosensitive body, for example, organic semi-conductor (OPC), amorphous silicone (A-Si), selenium (Se), zinc oxide (ZnO), or cadmium sulfide (CdS) can be used, and the shape of the image bearing member is not limited to the drum, but may be a belt.

Furthermore, the process cartridge B includes an electrophotographic photosensitive body as an image bearing member, and at least one process means. Accordingly, the process cartridge may integrally incorporate therein an image bearing member and a charger means as a unit which can be removably mounted to an image forming apparatus, or may integrally incorporated therein an image bearing member and a developing means as a unit which can be removably mounted to an image forming apparatus, or may integrally incorporate therein an image bearing member and a cleaning means as a unit which can be removably mounted to an image forming apparatus, or may integrally incorporate therein an image bearing member and two or more process means as a unit which can be removably mounted to an image forming apparatus, as well as the above-mentioned one.

That is to say, the process cartridge integrally incorporates therein an electrophotographic photosensitive body, and a charger means, a developing means or a cleaning means as a unit which can be removably mounted to an image forming apparatus, or integrally incorporates therein an electrophotographic photosensitive body, and at least one of a charger means, a developing means and a cleaning means as a unit which can be removably mounted to an image forming apparatus, or integrally incorporates therein an electrophotographic photosensitive body, and at least a developing means as a unit which can be removably mounted to an image forming apparatus.

Further, in the aforementioned embodiments, while the laser beam printer was explained as the image forming apparatus, the present invention is not limited to the laser beam printer, but may be applied to other image forming apparatuses such as an LED printer, an electrophotographic copying machine, a facsimile system or a word processor.

As mentioned above, according to the present invention, a simple method for recycling the process cartridge can be provided, so that, since the problems regarding the dust and garbage can be solved and the resources can be utilized effectively, the present invention can contribute to the protection of the global environment and the protection of the natural environment.

Further, according to the present invention, in the re-production of the process cartridge, the cartridge is divided into the first frame including the image bearing member, and the second frame including the developing means and the developer containing means for containing the developer used by the developing means. Thus, since the developer can be replenished and the seal can be attached thereafter, the damage of the image bearing member can be prevented.

Furthermore, according to the present invention, since the developer can be replenished through the space generated by removing the developing means such as a developing sleeve, the recycle of the process cartridge can easily be effected.

What is claimed is:

1. A method for recycling a process cartridge removably mountable onto a main body of an image forming apparatus, said method comprising the steps of:

(a) dividing a process cartridge, to expose an electrophotographic photosensitive drum and a developing sleeve disposed so as to be opposed along their respective longitudinal directions, into a first frame supporting the electrophotographic photosensitive drum, and a second frame supporting the developing sleeve for developing a latent image formed on the photosensitive drum, and a developer containing portion for containing developer to be used by the developing sleeve and having a toner supply opening, formed along the longitudinal direction of the developing sleeve supported on the second frame, through which the developer contained in the containing portion is supplied to the developing sleeve for developing the latent image;

(b) thereafter, removing the developing sleeve from the second frame to expose the toner supply opening along a longitudinal direction thereof;

(c) thereafter, re-filling the developer containing portion with developer through the toner supply opening;

(d) thereafter, removably attaching a seal to the toner supply opening for sealing the toner supply opening; and (e) thereafter, attaching the developing sleeve to the second frame along the longitudinal direction of the toner supply opening; and (f) thereafter, coupling the first frame and the second frame to each other so that the photosensitive drum and the developing sleeve are opposed along their respective longitudinal directions, thereby assembling the process cartridge.

2. A method according to claim 1, wherein the photosensitive drum, a cleaning blade for cleaning a peripheral surface of the photosensitive drum, and a charge roller for charging the photosensitive drum are assembled to the first frame.

3. A method according to claim 1, wherein the developing sleeve, which has a magnet arranged therein, and a developing blade for regulating a thickness of a developer layer adhered to a peripheral surface of the developing sleeve are assembled to the second frame.

4. A method according to claim 1, wherein the second frame is constructed by combining a developing frame for supporting the developing sleeve, and a developer frame for supporting the developer containing portion, and the seal for sealing the toner supply opening is removably arranged in a gap between the developing frame and the developer frame.

5. A method according to claim 1, wherein, after the first frame and the second frame are divided, an interior of each frame is cleaned.

6. A method according to claim 1, wherein a part is replaced as necessary with a replacement part before the first frame and the second frame are coupled to each other.

7. A method according to claim 1, wherein parts mountable within the process cartridge are checked before the first frame and the second frame are coupled to each other.

8. A method according to claim 1, wherein the developer is provided as a one-component magnetic developer.

9. A method according to claim 1, wherein the photosensitive drum includes an organic photosensitive material.

10. A method according to either claim 1 or claim 4, wherein an adhesive layer having a peel member on a surface thereof is provided on the seal, and the seal and the peel member are inserted into a gap between a developing frame supporting the developing sleeve and a developer frame supporting the developer containing portion to seal the toner supply opening, and thereafter, the peel member is drawn from the gap to peel the peel member from the adhesive layer, and thereafter, the seal is adhered to the developer frame via the adhesive layer, thereby removably attaching the seal for sealing the toner supply opening in the gap between the developing frame and the developer frame.

11. A method according to claim 10, further comprising the step of using a rigid thin plate to insert the peel member and the seal into the gap between the developing frame and the developer frame.

12. A method according to claim 1, wherein, when the first frame and the second frame are coupled to each other, connecting means having a base substrate on which a regulating member for regulating a rotary shaft around which the first frame and the second frame are rotated, and a compression spring disposed between the photosensitive drum and the developing sleeve, generate an urging force therebetween.

13. A method according to claim 1, wherein the developing sleeve has a magnet therein and assembled to the second frame in such a manner that one end of the magnet is supported by a first support member and one end of the developing sleeve is rotatably supported by the first support member via a first support piece, and a second support member is coupled to said second frame in such a manner that the other end of the magnet is supported by the second support member and the other end of the developing sleeve is rotatably supported by the second support member via a second support piece, thereby assembling the magnet and the developing sleeve to the second frame.

14. A method for recycling a process cartridge removably mountable onto a main body of an image forming apparatus, said method comprising the steps of:

(a) dividing a process cartridge, to expose an electrophotographic photosensitive drum and a developing sleeve disposed so as to be opposed along their respective longitudinal directions, into a first frame supporting the electrophotographic photosensitive drum, and a second frame; the second frame including a developing frame supporting the developing sleeve for developing a latent image formed on the photosensitive drum, and a toner frame having a developer containing portion for containing developer to be used by the developing sleeve and having a toner supply opening, through which the developer contained in the containing portion is supplied to the developing sleeve for developing the latent image, which is formed in a longitudinal direction of the developing sleeve supported on the second frame;

(b) thereafter, removing the developing sleeve from the second frame to expose the toner supply opening along a longitudinal direction thereof;

(c) thereafter, re-filling the developer containing portion with developer through the toner supply opening;

(d) thereafter, removably attaching a seal to the toner supply opening for sealing the toner supply opening by inserting the seal between the developing frame and the toner frame, without detaching the developing frame from the toner frame, using an insertion member, whereby the seal is removably fixed in place by an adhesive;

(e) thereafter, attaching the developing sleeve to the second frame along the longitudinal direction of the toner supply opening; and (f) thereafter, coupling the first frame and the second frame to each other so that the photosensitive drum and the developing sleeve are opposed along their respective longitudinal directions, thereby assembling the process cartridge.

15. A method according to claim 14, wherein the developer is provided as a one-component magnetic developer.

16. A method according to claim 14, wherein the photosensitive drum includes an organic photosensitive material.

17. A method according to claim 14, wherein an adhesive layer having a peel member on a surface thereof is provided on the seal, and the seal and the peel member are inserted into a gap between the developing frame and the toner frame to seal the toner supply opening, and thereafter, the peel member is drawn from the gap to peel the peel member from the adhesive layer, and thereafter, the seal is adhered to the toner frame via the adhesive layer, thereby removably attaching the seal for sealing the toner supply opening in the gap between the developing frame and the toner frame.

18. A method according to claim 17, further comprising the step of using a rigid thin plate to insert the peel member and the seal into the gap between the developing frame and the toner frame.

19. A method according to claim 14, wherein, when the first frame and the second frame are coupled to each other, connecting means having a base substrate on which a regulating member for regulating a rotary shaft around which the first frame and the second frame are rotated, and a compression spring disposed between the photosensitive drum and the developing sleeve, generate an urging force therebetween.

20. A method according to claim 14, wherein the developing sleeve has a magnet therein and is assembled to the second frame in such a manner that one end of the magnet is supported by a first support member and one end of the developing sleeve is rotatably supported by the first support member via a first support piece, and a second support member is coupled to said second frame in such a manner that the other end of the magnet is supported by the second support member and the other end of the developing sleeve is rotatably supported by the second support member via a second support piece, thereby assembling the magnet and the developing sleeve to the second frame.

21. A method for recycling a process cartridge removably mountable onto a main body of an image forming apparatus, said method comprising the steps of:

(a) dividing a process cartridge, to expose an electrophotographic photosensitive drum and a developing sleeve disposed so as to be opposed along their respective longitudinal directions, into a first frame and a second frame, wherein the photosensitive drum, a cleaning blade for cleaning a peripheral surface of the photosensitive drum, and a charge roller for charging the photosensitive drum are assembled to the first frame, and wherein the developing sleeve, which has a magnet arranged therein, and a developing blade for regulating a thickness of a developer layer adhered to a peripheral surface of the developing sleeve are assembled to the second frame in such a manner that one end of the magnet is supported by a first support member and one end of the developing sleeve is rotatably supported by the first support member via a first support piece, and a second support member is coupled to the second frame in such a manner that the other end of the magnet is supported by the second support member and the other end of the developing sleeve is rotatably supported by the second support member via a second support piece; the second frame including a developing frame supporting the developing sleeve for developing a latent image formed on the photosensitive drum, and a toner frame having a developer containing portion for containing developer to be used by the developing sleeve and having a toner supply opening, through which the developer contained in the containing portion is supplied to the developing sleeve for developing the latent image, which is formed in a longitudinal direction of the developing sleeve supported on the second frame;

(b) thereafter, removing the developing sleeve from the second frame to expose the toner supply opening along a longitudinal direction thereof;

(c) thereafter, re-filling the developer containing portion with developer through the toner supply opening;

(d) thereafter, removably attaching a seal having a peel member on a surface thereof to the toner supply opening for sealing the toner supply opening by inserting the seal and the peel member in a gap between the developing frame and the toner frame using a rigid, thin plate, whereby the seal is removably fixed in place by an adhesive without detaching the developing frame from the toner frame;

(e) thereafter, attaching the developing sleeve to the second frame along the longitudinal direction of the toner supply opening; and (f) thereafter, coupling the first frame and the second frame to each other so that the photosensitive drum and the developing sleeve are opposed along their respective longitudinal directions, thereby assembling the process cartridge, wherein, when the first frame and the second frame are coupled to each other, a connecting member having a base substrate on which a regulating member for regulating a rotary shaft around which the first frame and the second frame are rotated, and a compression spring disposed between the photosensitive drum and the developing sleeve, generate an urging force therebetween.

22. A method for re-filling a developer into a process cartridge removably mountable onto a main body of an image forming apparatus, said method comprising the steps of:

(a) disassembling a process cartridge, to expose an electrophotographic photosensitive drum and a developing sleeve disposed so as to be opposed along their respective longitudinal directions, by dividing the process cartridge into a first frame supporting the electrophotographic photosensitive drum, and a second frame; the second frame including a developing frame supporting the developing sleeve for developing a latent image formed on the photosensitive drum, and a toner frame having a developer containing portion for containing developer to be used by the developing sleeve and having a toner supply opening, through which the developer contained in the containing portion is supplied to the developing sleeve for developing the latent image formed on the photosensitive drum, which is formed in a longitudinal direction of the developing sleeve supported on the second frame;

(b) thereafter, removing the developing sleeve from the second frame to expose the toner supply opening along a longitudinal direction thereof;

(c) thereafter, re-filling the developer containing portion with developer through the toner supply opening;

(d) thereafter, removably attaching a seal to the toner supply opening for sealing the toner supply opening by inserting the seal between the developing frame and the toner frame connected to each other by an ultrasonic welding, without detaching the developing frame from the toner frame, using an insertion member, whereby the seal is removably fixed in place by a adhesive;

(e) thereafter, attaching the developing sleeve to the second frame along the longitudinal direction of the toner supply opening; and (f) thereafter, coupling the first frame and the second frame to each other rockably so that the photosensitive drum and the developing sleeve are opposed along their respective longitudinal directions, thereby reassembling the process cartridge.

23. A method according to claim 22, wherein the photosensitive drum, a cleaning blade for cleaning a peripheral surface of the photosensitive drum, and a charge roller for charging the photosensitive drum are assembled to the first frame.

24. A method according to claim 22, wherein the developing sleeve, which has a magnet arranged therein, and a developing blade for regulating a thickness of a developer layer adhered to a peripheral surface of the developing sleeve are assembled to the second frame.

25. A method according to claim 22, further comprising the step of cleaning an interior of each frame after the first frame and the second frame are divided.

26. A method according to claim 22, further comprising the step of replacing a part as necessary with a replacement part before the first frame and the second frame are coupled to each other.

27. A method according to claim 22, further comprising the step of checking parts mountable within the process cartridge before the first frame and the second frame are coupled to each other.

28. A method according to claim 22, further comprising the step of providing the developer as a one-component magnetic developer.

29. A method according to claim 22, wherein the photosensitive drum includes an organic photosensitive material.

30. A method according to claim 22, further comprising the steps of providing an adhesive layer having a peel member on a surface thereof on the seal, inserting the seal and the peel member into a gap between the developing frame and the toner frame to seal the toner supply opening, and thereafter drawing the peel member from the gap to peel the peel member from the adhesive layer, and thereafter adhering the seal to the toner frame via the adhesive layer, thereby removably attaching the seal for sealing the toner supply opening in the gap between the developing frame and the toner frame.

31. A method according to claim 55, further comprising the step of using a rigid thin plate to insert the peel member and the seal into the gap between the developing frame and the toner frame.

32. A method according to claim 22, wherein, when the first frame and the second frame are coupled to each other, connecting means having a base substrate on which a regulating member for regulating a rotary shaft around which the first frame and the second frame are rotated, and a compression spring disposed between the photosensitive drum and the developing sleeve, generate an urging force therebetween.

33. A method according to claim 22, wherein the developing sleeve has a magnet therein and wherein said method further comprises the step of assembling the second frame in such a manner that one end of the magnet is supported by a first support member and one end of the developing sleeve is rotatably supported by the first support member via a first support piece, and a second support member is coupled to said second frame in such a manner that the other end of the magnet is supported by the second support member and the other end of the developing sleeve is rotatably supported by the second support member via a second support piece, thereby assembling the magnet and the developing sleeve to the second frame.

* * * * *

UNITED STATES PATENT AND TRADEMARK OFFICE

CERTIFICATE OF CORRECTION

PATENT NO. : 5,966,566

DATED : October 12, 1999

INVENTOR(S) : Kazuyoshi ODAGAWA et al.

It is certified that error appears in the above-identified patent and that said Letters Patent is hereby corrected as shown below:

COLUMN 5:

Line 52, "vaious" should read --various--.
Line 67, "frame" should read --frame 15--.

COLUMN 6:

Line 8, "id" should read --1d--.

COLUMN 7:

Line 59, "is" should read --are--.

COLUMN 12:

Line 5,"31 50V" should read -- -50V--.

COLUMN 19:

Line 1, "11c," should read --11c1,--.
Line 13, "lie" should read --11e--.

UNITED STATES PATENT AND TRADEMARK OFFICE

CERTIFICATE OF CORRECTION

PATENT NO. : 5,966,566

DATED : October 12, 1999

INVENTOR(S) : Kazuyoshi ODAGAWA et al.

It is certified that error appears in the above-identified patent and that said Letters Patent is hereby corrected as shown below:

COLUMN 23:

Line 12, "Up," should read --up --.

COLUMN 25:

Line 5, "lad." should read --10d.--.

COLUMN 29:

Line 50, "(The" should read --(the--.

COLUMN 31:

Line 40, "conct" should read ---contact--.

COLUMN 45:

Line 24, "changer" should read --charger--.

COLUMN 47:

Line 10, "incorporated" should read --incorporate--.

UNITED STATES PATENT AND TRADEMARK OFFICE

CERTIFICATE OF CORRECTION

PATENT NO. : 5,966,566

DATED : October 12, 1999

INVENTOR(S) : Kazuyoshi ODAGAWA et al.

It is certified that error appears in the above-identified patent and that said Letters Patent is hereby corrected as shown below:

COLUMN 52

Line 42, "55" should read --30--.

Signed and Sealed this

Twenty-fourth Day of October, 2000

*Attest:*

Q. TODD DICKINSON

*Attesting Officer*

*Director of Patents and Trademarks*